US012442579B2

(12) United States Patent
Kim

(10) Patent No.: US 12,442,579 B2
(45) Date of Patent: Oct. 14, 2025

(54) REFRIGERATOR

(71) Applicant: LG Electronics Inc., Seoul (KR)

(72) Inventor: Wonsu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/663,442

(22) Filed: May 14, 2024

(65) Prior Publication Data

US 2024/0295356 A1 Sep. 5, 2024

Related U.S. Application Data

(60) Continuation of application No. 17/373,387, filed on Jul. 12, 2021, now Pat. No. 12,013,169, which is a (Continued)

(30) Foreign Application Priority Data

May 20, 2015 (KR) ..... 10-2015-0070495

(51) Int. Cl.
*F25C 5/20* (2018.01)
*F25D 11/02* (2006.01)
(Continued)

(52) U.S. Cl.
CPC ..... *F25C 5/22* (2018.01); *F25D 11/02* (2013.01); *F25D 17/06* (2013.01); *F25D 23/04* (2013.01);
(Continued)

(58) Field of Classification Search
CPC ..... F25D 23/04; F25D 23/068; F25D 11/02; F25D 17/06; F25D 2323/024;
(Continued)

(56) References Cited

U.S. PATENT DOCUMENTS

2007/0163286 A1* 7/2007 Lim ..... F25D 23/126 62/389
2011/0030412 A1 2/2011 Kim
2012/0111048 A1* 5/2012 Kim ..... F25C 1/10 62/340

FOREIGN PATENT DOCUMENTS

EP 2664880 A2 11/2013
EP 2770280 A2 8/2014

OTHER PUBLICATIONS

Extended European Search Report in European Appln. No. 24203004.7, mailed on Jan. 31, 2025, 10 pages.

* cited by examiner

*Primary Examiner* — Cassey D Bauer
*Assistant Examiner* — Martha Tadesse
(74) *Attorney, Agent, or Firm* — Fish & Richardson P.C.

(57) ABSTRACT

A refrigerator includes a cabinet that includes a refrigerator compartment and a freezer compartment. The refrigerator includes a refrigerator compartment door that is located at a left or a right side of the refrigerator compartment, wherein an ice maker and a dispenser are located at the refrigerator compartment door. The refrigerator includes a main water tank that is located in the refrigerator compartment, and that is configured to cool water. The refrigerator includes a water purifying device that is located at the cabinet, and that is configured to purify water. The refrigerator includes a sub-water tank that is located on the refrigerator compartment door, and that is configured to additionally cool water cooled by the main water tank. The refrigerator includes a water supply path that is defined by connections between the water purifying device, the main water tank, the sub-water tank, the dispenser, and the ice maker.

14 Claims, 39 Drawing Sheets

Related U.S. Application Data continuation of application No. 16/776,021, filed on Jan. 29, 2020, now Pat. No. 11,079,157, which is a division of application No. 15/158,668, filed on May 19, 2016, now Pat. No. 10,584,908.

(51) Int. Cl.

| | |
|---|---|
| ***F25D 17/06*** | (2006.01) |
| ***F25D 23/04*** | (2006.01) |
| ***F25D 23/06*** | (2006.01) |
| ***F25D 23/12*** | (2006.01) |

(52) U.S. Cl.

CPC ..... *F25D 23/068* (2013.01); *F25D 23/126* (2013.01); *F25C 2400/14* (2013.01); *F25D 2323/024* (2013.01); *F25D 2323/121* (2013.01); *F25D 2323/122* (2013.01); *F25D 2400/40* (2013.01)

(58) Field of Classification Search

CPC ..... F25D 23/126; F25D 2323/121; F25D 2323/122; F25C 5/22

See application file for complete search history.

REFRIGERATOR

CROSS-REFERENCE TO RELATED APPLICATION

This application is a continuation of U.S. application Ser. No. 17/373,387, filed on Jul. 12, 2021, which is a continuation of U.S. application Ser. No. 16/776,021, filed on Jan. 29, 2020, now U.S. Pat. No. 11,079,157, which is a divisional of U.S. application Ser. No. 15/158,668, filed on May 19, 2016, now U.S. Pat. No. 10,584,908, which claims priority under 35 U.S.C. § 119 and 35 U.S.C. § 365 to Korean Patent Application No. 10-2015-0070495, filed on May 20, 2015. The disclosures of the prior applications are incorporated by reference in their entirety.

FIELD

This application is related to a refrigerator.

BACKGROUND

A refrigerator is a home appliance which keeps food in a low temperature state, and may include one or both of a refrigerator compartment which keeps the food refrigerated, and a freezer compartment which keeps the food frozen.

Also, recently, a dispenser is installed at a front surface of a door of the refrigerator, and drinking water may be dispensed through the dispenser without opening the door of the refrigerator.

And an ice maker which makes and stores ice may be provided at the door of the refrigerator or an inside of a storage space, and the ice may be dispensed through the dispenser.

SUMMARY

According to an innovative aspect of the subject matter described in this application, a refrigerator includes a cabinet that includes a refrigerator compartment and a freezer compartment that is located under the refrigerator compartment; a refrigerator compartment door that is located at a left or a right side of the refrigerator compartment, where an ice maker and a dispenser are located at the refrigerator compartment door; a main water tank that is located in the refrigerator compartment, and that is configured to cool water; a water purifying device that is located at the cabinet, and that is configured to purify water; a sub-water tank that is located on the refrigerator compartment door, and that is configured to additionally cool water cooled by the main water tank; a water supply path that is defined by connections between the water purifying device, the main water tank, the sub-water tank, the dispenser, and the ice maker; a first branch valve that is located at the water supply path of the cabinet, that connects with outlet ports of the water purifying device and the main water tank, and that is configured to selectively supply purified water or cooled water to the refrigerator compartment door; and a second branch valve that is located at the water supply path of the refrigerator compartment door, that connects with inlet ports of the dispenser and the ice maker, and that is configured to selectively supply purified water passed through the first branch valve to the dispenser or the ice maker.

The refrigerator may include one or more of the following optional features. The sub-water tank is connected to the dispenser by a pipe that branches from the water supply path at an inside of the refrigerator compartment door. A dispensing valve is configured to open and close, is configured to supply water cooled by the sub-water tank, and is located at the water supply path that connects the dispenser with the sub-water tank. The second branch valve and the dispensing valve are connected to a water discharge pipe that is located at the dispenser. The water supply path includes a water supply pipe that connects a water source with the water purifying device; a purified water pipe that connects the water purifying device, the first branch valve, the second branch valve, the dispenser, and the ice maker; a main cold water pipe that branches from the purified water pipe that is connected to the water purifying device and that connects the main water tank with the first branch valve; a sub-cold water pipe that branches from the purified water pipe that is between the first branch valve and the second branch valve and that is connected to the dispenser; and a water discharge pipe that extends from the dispenser and that is configured to discharge cold water or purified water.

A water supply valve that is configured to open and close the water supply pipe, a flow sensor that is configured to measure a flow rate, and a check valve that is configured to prevent water introduced into the refrigerator from flowing back to the water source are located at the water supply pipe. The purified water pipe includes a water inlet part that connects the water purifying device with the first branch valve; a connection pipe that connects the first branch valve with the second branch valve, and that transitions from the refrigerator compartment to an inside of the refrigerator compartment door through a rotating shaft of the refrigerator compartment door; and a water outlet part that connects the second branch valve with the water discharge pipe. The purified water pipe includes a plurality of pipes that are connected by at least one or more connectors. The purified water pipe further includes an ice making path that connects the second branch valve with the ice maker. Based on the purified water being supplied to the dispenser, the first branch valve and the second branch value are configured to supply purified water to the dispenser or the ice maker by the first branch value switching to connect with the water purifying device, and by the second branch valve switching to connect with the dispenser or the ice maker. Based on the cold water being supplied to the dispenser, the first branch valve and the second branch value are configured to supply cold water to the dispenser by the first branch valve switching to connect with the main water tank, and by the second branch valve closing.

According to another innovative aspect of the subject matter described in this application, a refrigerator includes a cabinet that includes a refrigerator compartment and a freezer compartment; a refrigerator compartment door that is configured to open and close the refrigerator compartment, and that includes an ice maker and a dispenser; a hinge that rotatably connects the refrigerator compartment door with the cabinet; a drawer assembly that is located in the refrigerator compartment, and that includes a drawer; a water purifying device that is located at a first space between a side surface of the drawer assembly and a side wall of the refrigerator compartment, and that includes a plurality of filters that are vertically oriented; a main water tank that is located at a second space between a rear surface of the drawer assembly and a rear wall surface of the refrigerator compartment, and that is configured to cool and store water; a water supply path that is defined by connections between the water purifying device, the main water tank, the dispenser, and the ice maker; and a first branch valve that is located at the water supply path of the cabinet, that connects with outlet ports of the water purifying device and the main water tank, and that is configured to selectively supply purified water or cold water to the refrigerator compartment door. A part of the water supply path that is connected to an outlet port of the first branch valve and that passes through the hinge includes a single pipe, and is located in a side of the refrigerator compartment door.

The refrigerator may include one or more of the following optional features. A second branch valve is configured to supply purified water to the dispenser and the ice maker and is located at the water supply path inside the refrigerator compartment door. The water supply path that is located inside the refrigerator compartment door includes a cold water pipe that carries cold water supplied from the main water tank, and a sub-water tank that is connected to the cold water pipe, that cools cold water supplied from the main water tank, and that is located at an inside of the refrigerator compartment door. The cold water pipe connects the sub-water tank with the dispenser, and is connected to a dispensing valve that is configured to selectively supply cold water to the dispenser. The hinge includes a hinge shaft that passes through an upper end of the refrigerator compartment door. The water supply path passes through a hollow of the hinge shaft, and is located in an inside of the refrigerator compartment door. An electric wire that is connected to the dispenser and the ice maker is located in the hollow of the hinge shaft and in the inside of the refrigerator compartment door.

The first branch valve is located at the first space, and is located above the main water tank. An inlet port of the water supply path is located at a side wall of the first space. The path bypasses an evaporator that is located at a rear of the refrigerator compartment. An outlet port of the path is located at a rear surface of the cabinet. An evaporator is located at a rear of the refrigerator compartment and is located in a space. The first space overlaps with the space in a forward and backward direction. The water purifying device forms a side surface of the drawer assembly, and an access guide that is configured to guide the drawer is located at a side surface of the water purifying device. The drawer is located at a front of the main water tank. A shield plate that forms a front surface around the first space and has a cooling air flowing hole that is configured to supply cooling air to the first space is located at a rear of the drawer. A grill pan that is configured to shield an evaporator is located at a rear of the main water tank. The cooling air hole that is located at the grill pan, the main water tank, and the cooling air flowing hole are aligned in a forward and backward direction. A cooling air guide that extends toward the main water tank and that is configured to guide cooling air passing through the cooling air flowing hole to an outer surface of the water tank is located at a circumference of the cooling air flowing hole.

The drawer assembly includes a table that is spaced apart from a bottom surface of the refrigerator compartment and that divides the refrigerator compartment; and a plurality of side plates that extend downward from the table and that support the drawer. At least one of the plurality of side plates forms a side surface of the water purifying device. The drawer includes an accommodation part that defines a food accommodation space; a front surface part that forms an exterior of a front surface of the accommodation part; and a shielding part that extends to a lateral side of the front surface part and that shields the water purifying device from a front of the drawer. The drawer is configured to withdraw a length that is longer than the filter. The water purifying device includes a case that forms a surface of the drawer assembly and that supports the drawer, where the plurality of filters is located in the case. The water purifying device further includes a head unit that is located inside the case, that is selectively connected to an end of each of the plurality of filters, and that is connected with the water supply path. A plurality of filter holes that are configured to receive the plurality of filters are located at a front surface of the case. All of the plurality of filter holes are shielded by a case cover that is installed at the front surface of the case. The water purifying device is oriented in a direction that intersects with the main water tank.

According to another innovative aspect of the subject matter described in this application, a refrigerator includes a cabinet that includes a refrigerator compartment that is located at an upper portion of the cabinet and a freezer compartment that is located at a lower side of the refrigerator compartment; a refrigerator compartment door that is configured to open and close the refrigerator compartment and that includes a dispenser; a water purifying device that is located at the refrigerator compartment; a main water tank that is located at the refrigerator compartment, and that is configured to store and cool water that is supplied from the water purifying device; an ice making chamber that is located at a rear side of the refrigerator compartment door; an ice maker that is located in the ice making chamber; a door recessed portion that is recessed from a rear surface of the refrigerator compartment door and that is located under the ice making chamber; a cover plate that is configured to shield the door recessed portion; a sub-water tank that is located at the cover plate, and that is configured to additionally cool water supplied from the main water tank; a water supply path that is defined by connections between the water purifying device, the main water tank, the sub-water tank, and the dispenser and that is configured to selectively guide cold water and purified water; a dispensing valve that is located at the door recessed portion, that is configured to open and close the water supply path, and that is configured to supply cold water to the dispenser; and a branch valve that is located at the door recessed portion, and that is configured to selectively supply water from the water purifying device to the dispenser and an ice maker by switching the water supply path.

The refrigerator may include one or more of the following optional features. The dispensing valve and the branch valve are connected to a rear surface of the cover plate. The sub-water tank includes a tube through which water flows, and a tube reel around which the tube is wound and that is fixed to the cover plate. The tube is wound several times in one row on the tube reel. The tube reel includes a base that is fixed to the cover plate; a tube base that protrudes from a center of the base and around which the tube is wound; and a plurality of alignment guides that extend radially from a protruding end of the tube base and that are configured to align the tube. The base and the alignment guides are spaced apart from each other by a distance corresponding to a diameter of the tube. A guide opening that is formed in a shape that corresponds to the alignment guide is located at the base. One of the plurality of alignment guides is shorter than other alignment guides. A tank connector connects the water supply path to the sub-water tank. A connector fixing part that is configured to stabilize the tank connector is located at the tube reel.

The refrigerator further includes a folding prevention member that is configured to receive the tube, that is configured to prevent the tube from folding, and that is formed with a predetermined curvature. The folding prevention member is connected to the tube reel. A screw hole is located at the cover plate and is configured to receive a screw that passes through the cover plate, that fastens to the refrigerator compartment door, and that is configured to fix the cover plate to the refrigerator compartment door. A plate guide that is configured to guide the tube to bypass the screw hole and that is located at a lateral side of the screw hole. An inlet port of the branch valve extends downward, and is directly connected to the water supply path that is connected to the water purifying device. An opening part is located at the door recessed portion, is configured to open vertically, and is configured to receive the water supply path. A connector installation part is located at an upper surface of the door recessed portion, is connected to a control part, and is configured to connect to a connector of an electric wire that is connected to the dispensing valve and the branch valve.

According to another innovative aspect of the subject matter described in this application, a refrigerator includes a cabinet that includes a refrigerator compartment that is located at an upper portion of the cabinet and a freezer compartment that is located at a lower side of the refrigerator compartment; a refrigerator compartment door that is configured to open and close the refrigerator compartment, and that includes a dispenser; a hinge that is configured to rotatably connect the refrigerator compartment door with the cabinet; a water purifying device that is located at the cabinet, and that is configured to purify water; a main water tank that is located at the refrigerator compartment, and that is configured to cool and store water supplied from the water purifying device; a sub-water tank that is located at the refrigerator compartment door, and that is configured to additionally cool water supplied from the main water tank; and a water supply path that is defined by connections between the water purifying device, the main water tank, the sub-water tank, and the dispenser, and that is configured to guide cold water and purified water. The water supply path passes through the hinge via an outside of the refrigerator compartment and into the refrigerator compartment door. A volume of an inner space of the sub-water tank is larger than a volume of an inner space of a portion of the water supply path that is located at an outside of the refrigerator compartment.

The refrigerator may include one or more of the following optional features. The volume of the inner space of the sub-water tank is larger than a volume of an inner space of a portion of the water supply path from an outlet port of the main water tank to an inlet port of the sub-water tank. The sub-water tank includes a tube that has a same inner diameter as the water supply path and is spiral-shaped. A length of the tube is longer than a length from an outlet port of the main water tank to an inlet port of the sub-water tank. The sub-water tank is located at a rear of the dispenser.

DETAILED DESCRIPTION

Figure 1:
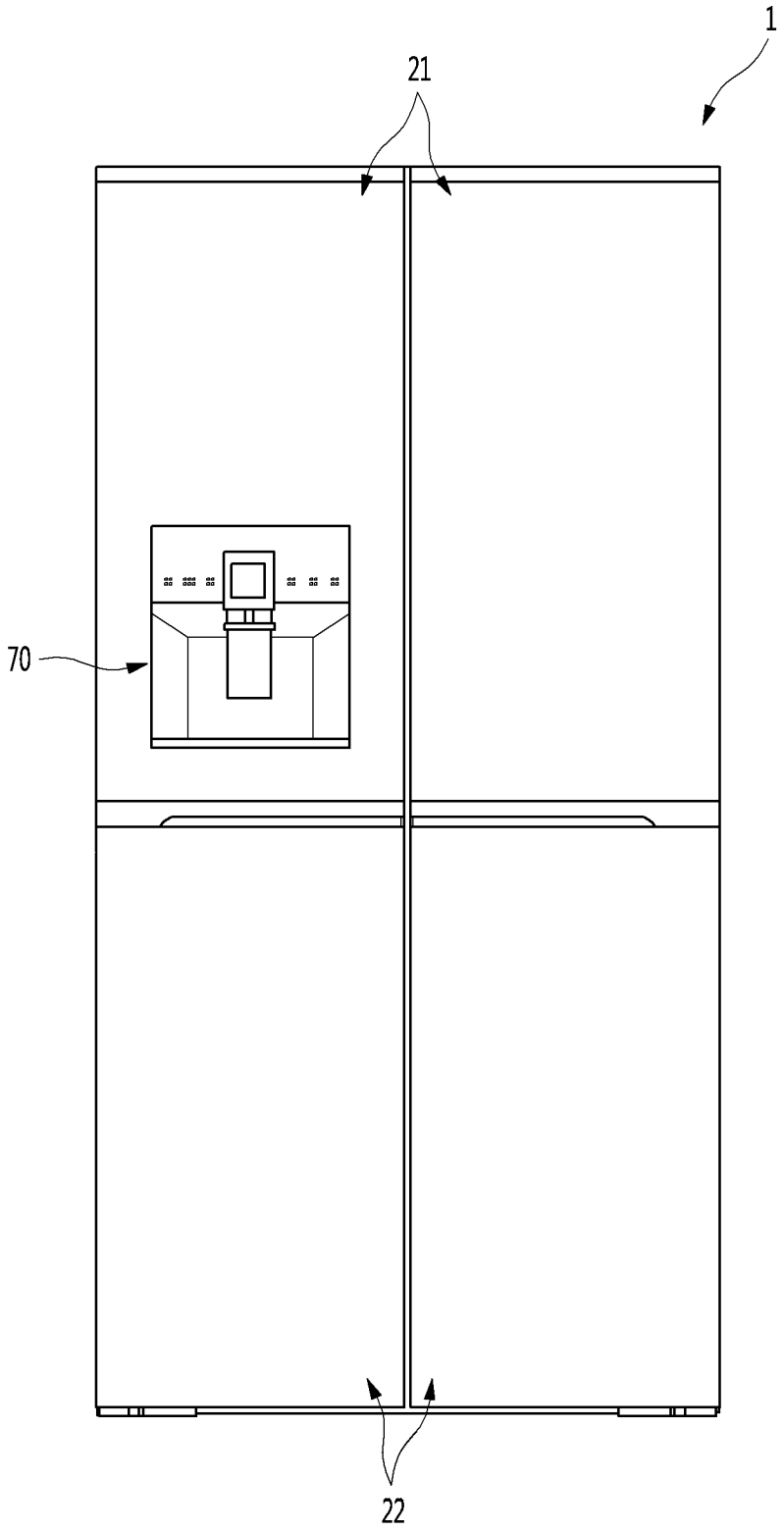
FIG. 1 is a front view of an example refrigerator.
Figure 2:
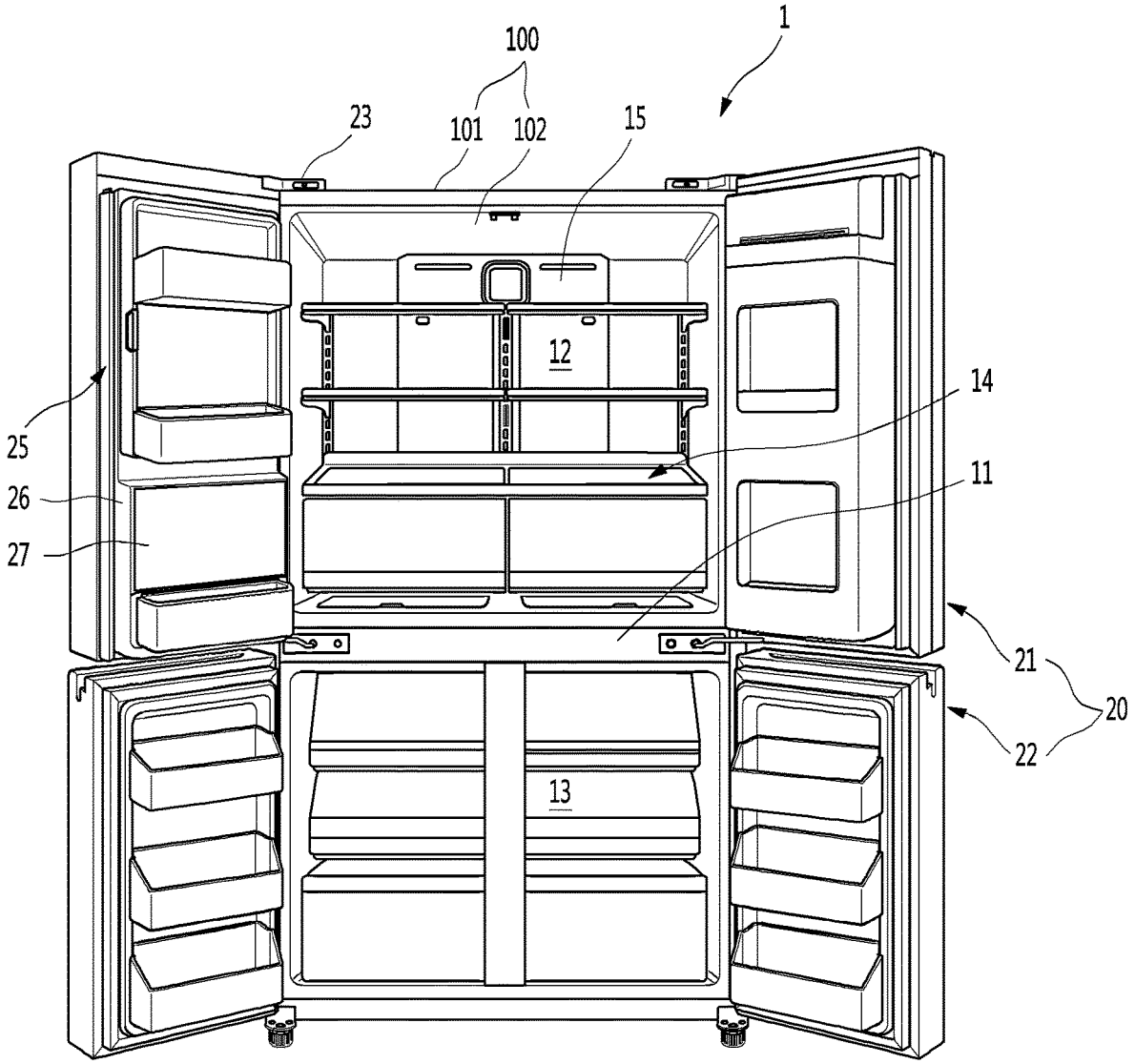
FIG. 2 is a front view of an example refrigerator with a door opened.
Figure 3:
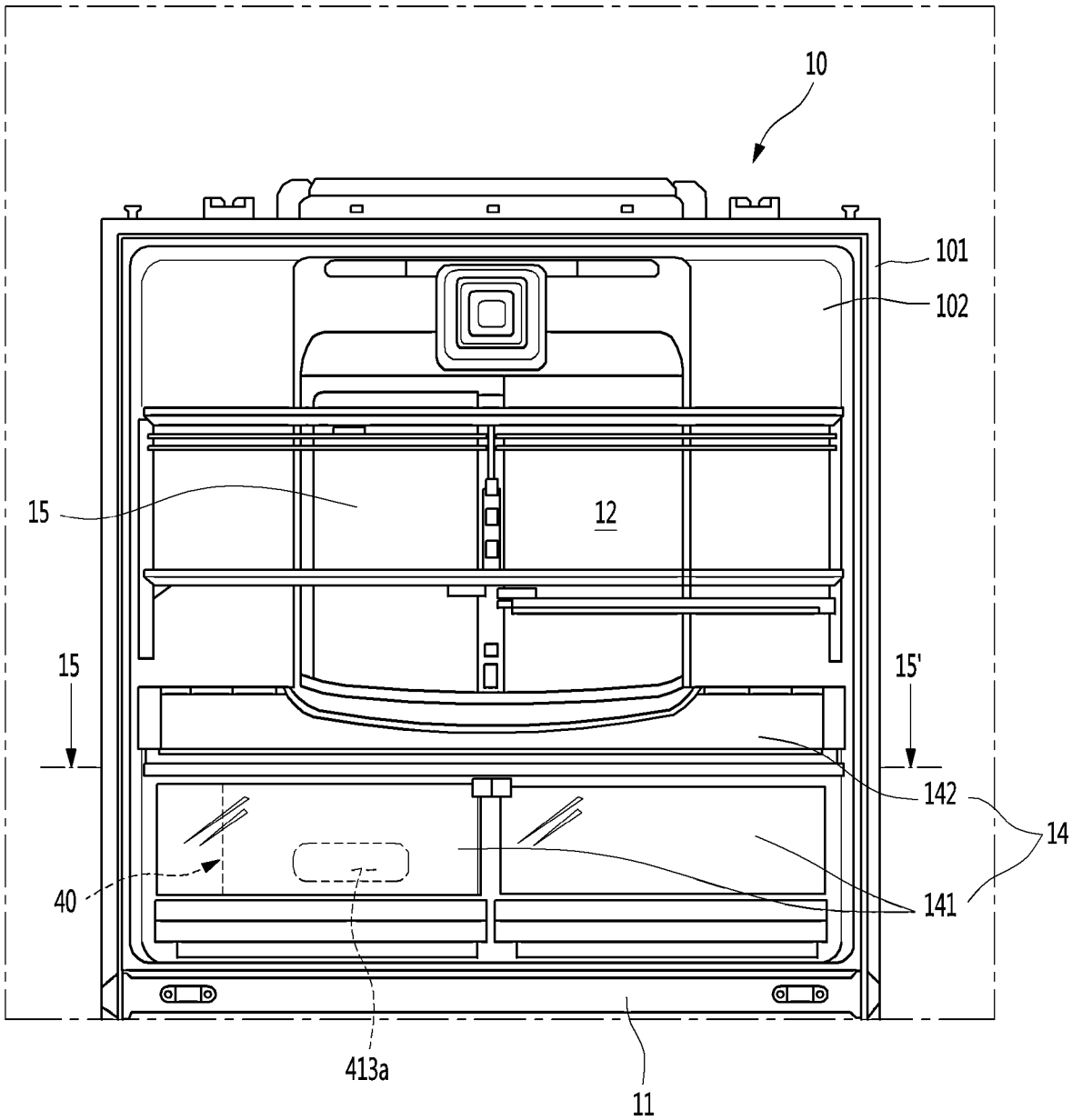
FIG. 3 is a front view of an example refrigerator compartment of a refrigerator.

FIG. 1 illustrates an example refrigerator. FIG. 2 illustrates an example door of a refrigerator. FIG. 3 illustrates an example refrigerator compartment of a refrigerator.

Referring to FIGS. 1 to 3, an external appearance of a refrigerator 1 may be formed by a cabinet 100 which forms a storage space and a door 20 which opens and closes the storage space.

The cabinet 100 may include an outer case 101 which forms an outer side surface and is formed of a metallic material, and an inner case 102 which is coupled to the outer case 101, forms a storage space inside the refrigerator 1, and is formed of a resin. And an insulator 103 fills between the outer case 101 and the inner case 102 so as to insulate the storage space.

The storage space is divided vertically based on a barrier 11, and may include a refrigerator compartment 12 which is provided at an upper side, and a freezer compartment 13 which is provided at a lower side. And the freezer compartment 13 may be further divided horizontally.

The door 20 may include a refrigerator compartment door 21 and a freezer compartment door 22 which separately open and close the refrigerator compartment 12 and the freezer compartment 13, respectively.

All of the refrigerator compartment door 21 and the freezer compartment door 22 may open and close the refrigerator compartment 12 and the freezer compartment 13 in a rotation manner. To this end, each of the refrigerator compartment door 21 and the freezer compartment door 22 may be rotatably connected to the cabinet 100 by a hinge device 23. And the refrigerator compartment door 21 may be a French type door in which one pair of doors are provided at both of left and right sides to be independently rotated.

A dispenser 70 and an ice maker 251 may be provided at one of the pair of refrigerator compartment doors 21.

The dispenser 70 is provided at a front surface of the refrigerator compartment door 21 so as to dispense one or more of water and ice by a user's operation. And an ice making chamber 25 is provided above the dispenser 70. The ice making chamber 25 is an insulated space in which the ice is made and stored, and the ice maker 251 is accommodated, and which may be closed and opened by a separate door. And although not illustrated, the ice making chamber 25 is in communication with the freezer compartment 13 through a cooling air duct while the refrigerator compartment door 21 is closed, and thus cooling air may be necessary to make the ice may be supplied from a freezer compartment evaporator.

And a door recessed portion 26 which will be described below in detail is formed at a lower portion of the refrigerator compartment door 21. The door recessed portion 26 may be shielded by a cover plate 27. The cover plate 27 forms a part of a rear surface of the refrigerator compartment door 21, and if necessary, a basket or the like may be installed thereat.

A plurality of shelves and drawers for accommodating food may be provided inside the refrigerator compartment 12. In particular, a drawer assembly 14 is provided on a bottom surface of the refrigerator compartment 12. The drawer assembly 14 includes a drawer 141 which is provided to be inserted into and withdrawn from an inside of the refrigerator compartment 12, and a table 142 which shields an upper surface of the drawer 141.

The drawer assembly 14 may be formed to be seen through, and may be formed so that at least a part of a main water tank 60 (referring to FIG. 4) provided at a rear side of the refrigerator compartment 12 is seen through a cooling air flowing hole 413*a* when being seen from a front.

And a water purifying device 40 for purifying supplied water may be provided at a lateral side of the drawer assembly 14, and a front surface of the water purifying device 40 may be shielded by the drawer assembly 14.

And the plurality of selves each of which has a cantilever structure may be separably provided above the drawer assembly 14 so that each height thereof is adjustable.

Also, a main duct 15 is provided at a rear surface of the refrigerator compartment 12, and the cooling air generated by a refrigerator compartment evaporator 130 may be supplied to the inside of the refrigerator compartment 12 through a plurality of discharge holes formed at the main duct 15.

Figure 4:
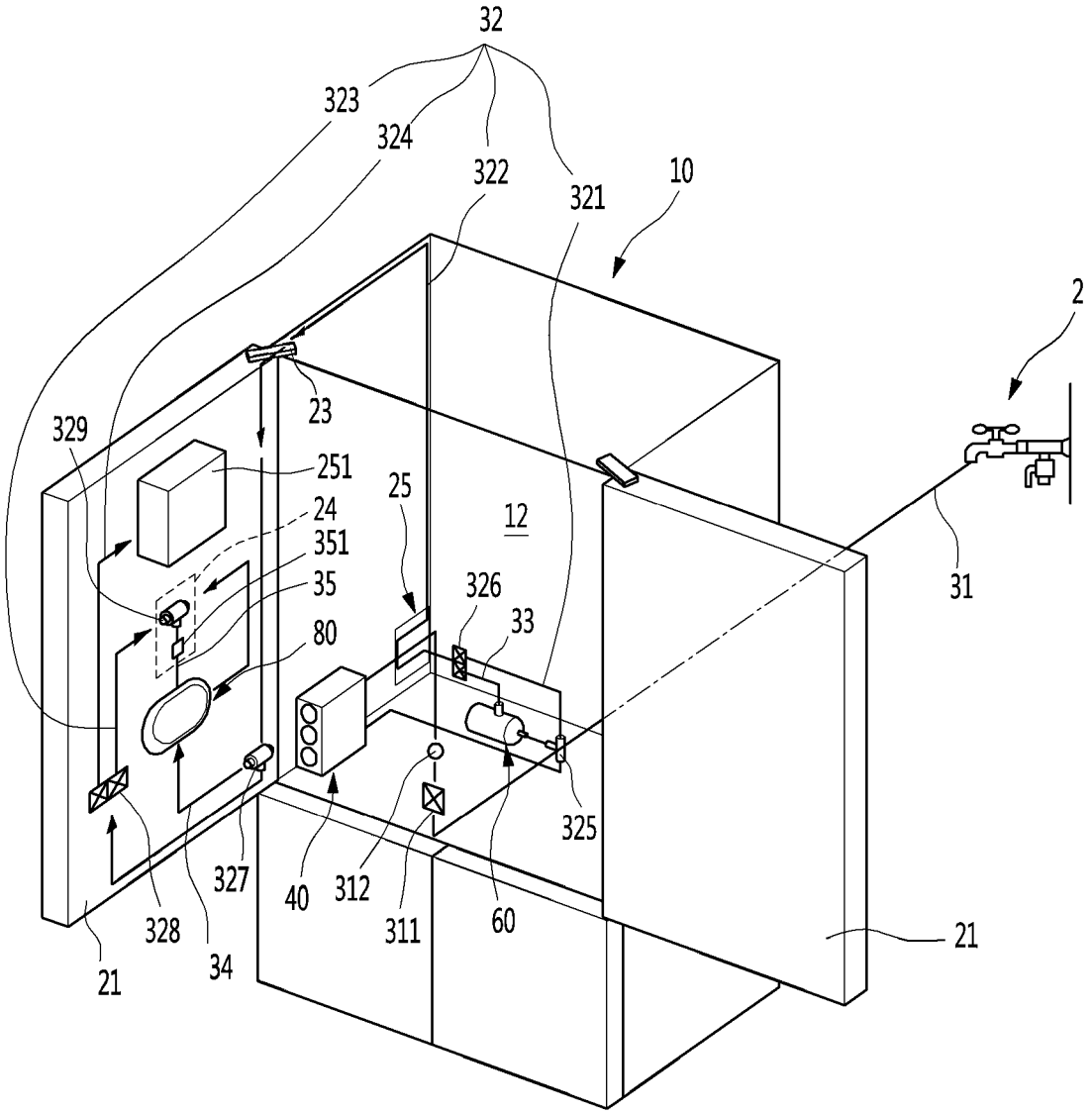
FIG. 4 is a schematic of an arrangement structure of an example water supply path of a refrigerator.

FIG. 4 illustrates an example water supply path of a refrigerator.

Referring to FIGS. 1 to 4, in the refrigerator 1, the water supplied from an external water source may be purified or cooled, and then may be dispensed from the dispenser 70. The refrigerator 1 may include a water supply path through which the purified water is supplied to the dispenser 70 or the ice maker 251.

And the water supply path may include a water supply pipe 31, a purified water pipe 32, a main cold water pipe 33, a sub-cold water pipe 34 and a water discharge pipe 35.

The water supply pipe 31 is directly connected to a water source 2 like a spigot located outside the refrigerator 1, and connected to an inlet port of the water purifying device 40 inside the refrigerator 1. The water supply pipe 31 serves to supply the water of the water source 2 to the inside of the refrigerator 1, and may be inserted into an internal space of the refrigerator 1 through a tube guide 50 installed inside the cabinet 100, or may be withdrawn to an external space of the refrigerator 1.

A water supply valve 311 and a flow sensor 312 may be provided at the water supply pipe 31. The water supply valve 311 may be provided at a rear surface of the cabinet 100 or a machinery chamber in which a compressor or the like is provided. The water supply valve 311 may open and close the water supply pipe 31 so that the water of the water source 2 is selectively supplied to the refrigerator 1.

And the flow sensor 312 is provided at the water supply pipe 31 between the water supply valve 311 and the water purifying device 40, and may measure a flow rate of the water supplied through the water supply pipe 31. In some implementations and if necessary, the flow sensor 312 may be integrally formed with the water supply valve 311.

The purified water pipe 32 connects an outlet port of the water purifying device 40 with the main water tank 60, a first branch valve 326, a second branch valve 328, the ice maker 251 and the dispenser 70, and thus the water purified in the water purifying device 40 is finally supplied to the ice maker 251 or the dispenser 70.

Since the ice maker 251 is formed so that the purified water of the cooled water and the purified water is supplied thereto, it is possible to make the ice having higher quality than that of the ice made of the cooled water.

The purified water pipe 32 may include a water inlet part 321, a connection part 322, a water outlet part 323 and an ice making path 324.

The water inlet part 321 connects the water purifying device 40 with the first branch valve 326 so that the water purified in the water purifying device 40 may be supplied. And the connection part 322 connects an outlet port of the first branch valve 326 with an inlet port of the second branch valve 328 inside the refrigerator compartment door 21 so that the purified water or the cold water is selectively supplied to the refrigerator compartment door 21 through a single pipe according to switching of the first branch valve 326.

Specifically, the connection part 322 may pass through the hinge device 23 which rotatably connects the refrigerator compartment door 21 with the cabinet 100, and may be guided to the inside the refrigerator compartment door 21. At this point, the connection part 322 introduced through the hinge device 23 is a single pipe through which the purified water and the cold water may selectively flow. Also, an electric wire for driving the dispenser 70, the ice maker 251, the second branch valve 328 and a dispensing valve 351 which are provided at the refrigerator compartment door 21 may be inserted and withdrawn through the hinge device 23.

And the connection part 322 may be guided to an outside of the refrigerator compartment 12 through the tube guide 50, and may extend toward the hinge device 23 along outer rear and upper surfaces of the cabinet 100. At this point, at least a part of the connection part 322 passing through an outside of the cabinet 100 may be exposed to the outside of the cabinet 100. As another example, the connection part 322 may extend from an inside of the cabinet 100 toward the hinge device 23.

The water outlet part 323 connects an outlet port of the second branch valve 328 with the dispenser 70, and the ice making path 324 connects the outlet port of the second branch valve 328 with the ice maker 251. The purified water may be selectively supplied to the ice maker 251 or the dispenser 70 according to the switching of the second branch valve 328.

The main cold water pipe 33 is branched from the purified water pipe 32, and formed to connect the main water tank 60 with the first branch valve 326. Therefore, the purified water flowing through the purified water pipe 32 may be branched by a first branch pipe 325, and may be supplied to the main water tank 60, and the cold water stored and cooled in the main water tank 60 passes through the first branch valve 326.

Each of the main cold water pipe 33 connected to an outlet port of the main water tank 60 and the purified water pipe 32 connected to an outlet side of the water purifying device 40 are connected to an input side of the first branch valve 326, and one purified water pipe 32, e.g., the connection part 322 is connected to an output side of the first branch valve 326. Therefore, according to the switching of the first branch valve 326, the purified water passed through the water purifying device 40 may flow through the connection part 322, or the cold water discharged from the main water tank 60 may flow therethrough.

In some implementations, for convenience of explanation, the connection part 322 is defined as a part of the purified water pipe 32. However, since both of the purified water and the cold water may be supplied through the connection part 322, the connection part 322 may be referred to as a separate common pipe.

The sub-cold water pipe 34 is branched from the purified water pipe 32 by a second branch pipe 327 inside the refrigerator compartment door 21, and connected to an inlet port of a sub-water tank 80. And the sub-cold water pipe 34 may further extend from an outlet port of the sub-water tank 80 to a third branch pipe 329.

The water discharge pipe 35 is exposed from one side of the third branch pipe 329 to an outside of the dispenser 70, and the purified water or the cold water may be dispensed therethrough when the dispenser 70 is operated. The dispensing valve 351 may be provided at the water discharge pipe 35, and supplying of the cold water through the dispenser 70 may start by the dispensing valve 351.

Figure 5:
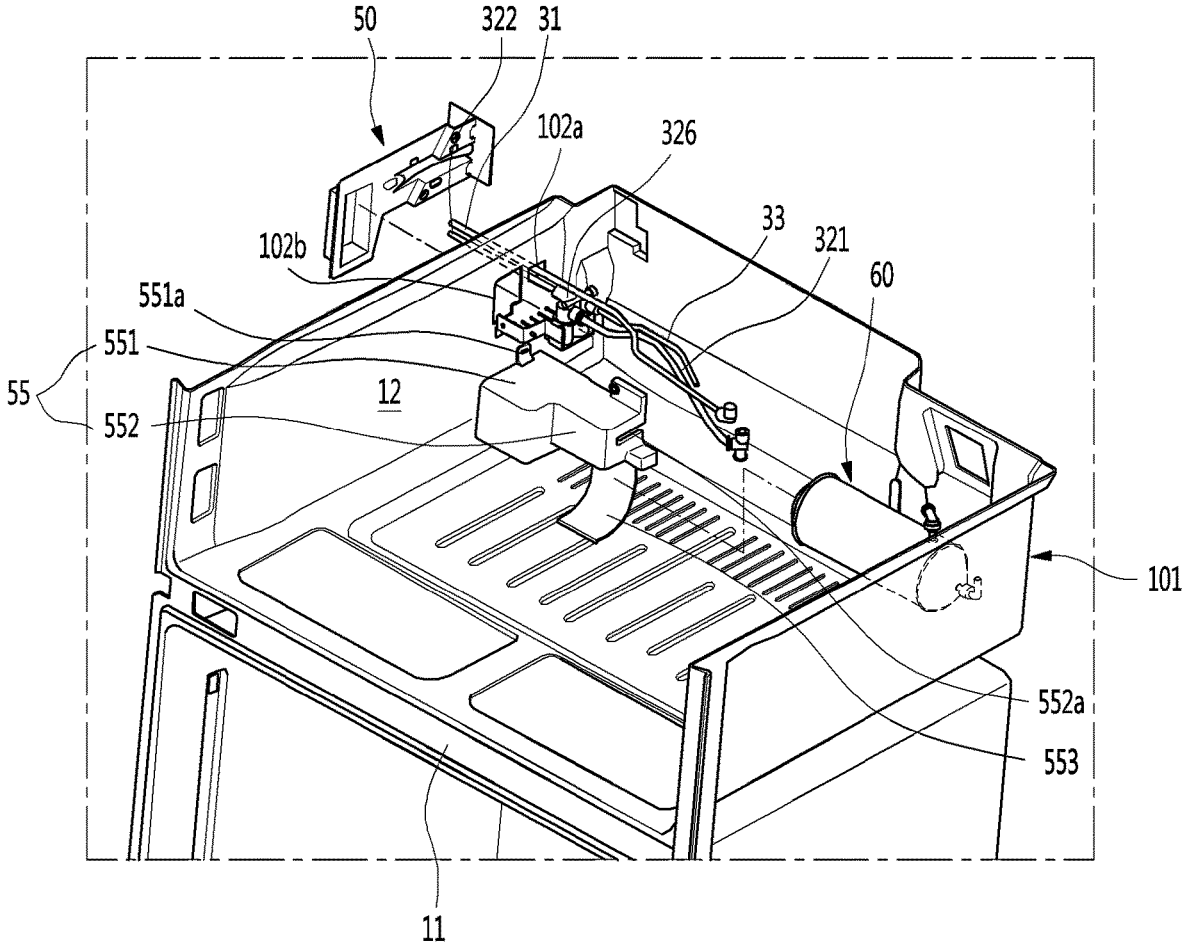
FIG. 5 is an exploded perspective view of an inside of an example refrigerator compartment.
Figure 6:
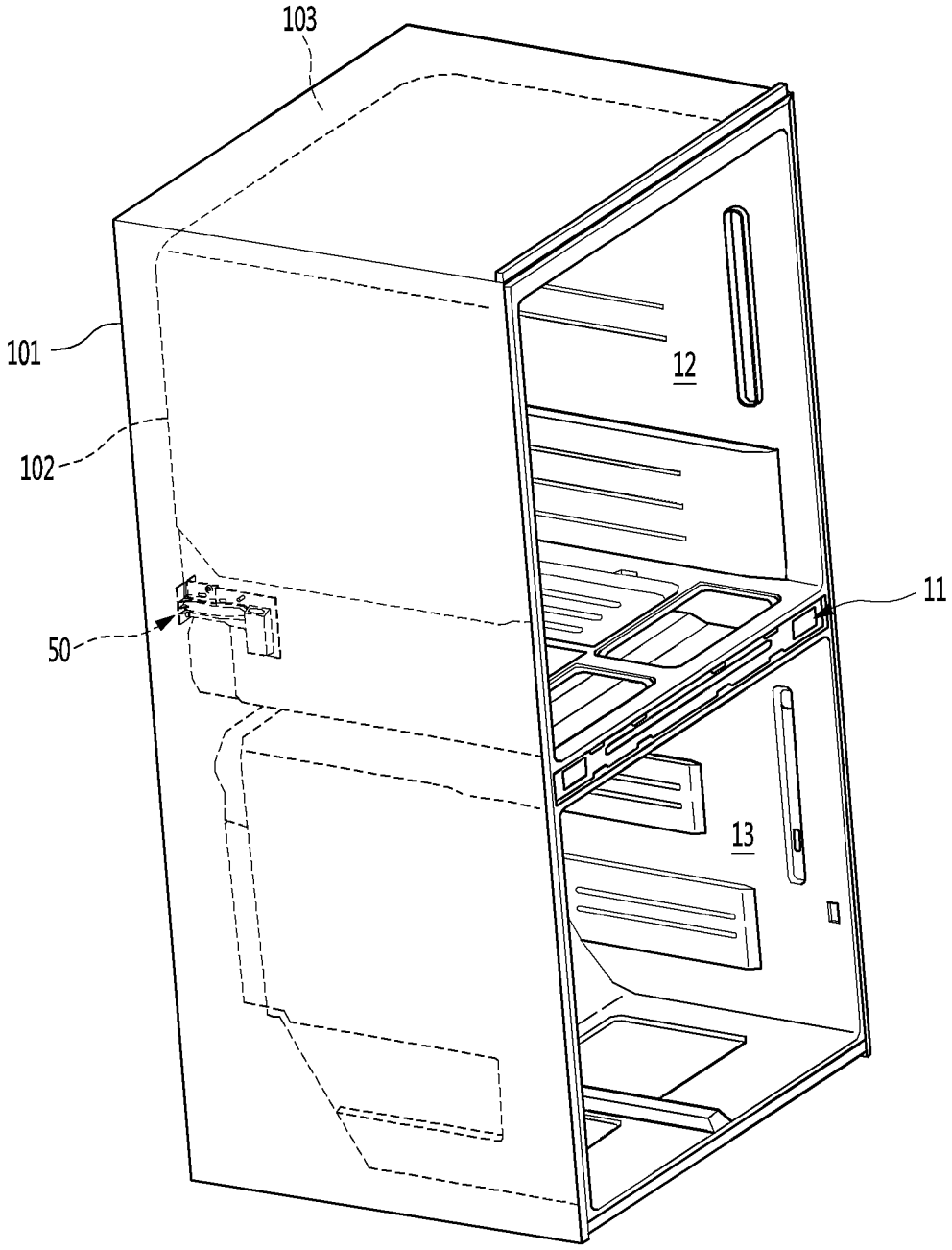
FIG. 6 is a see-through view of an example cabinet in which a tube guide is installed.
Figure 7:
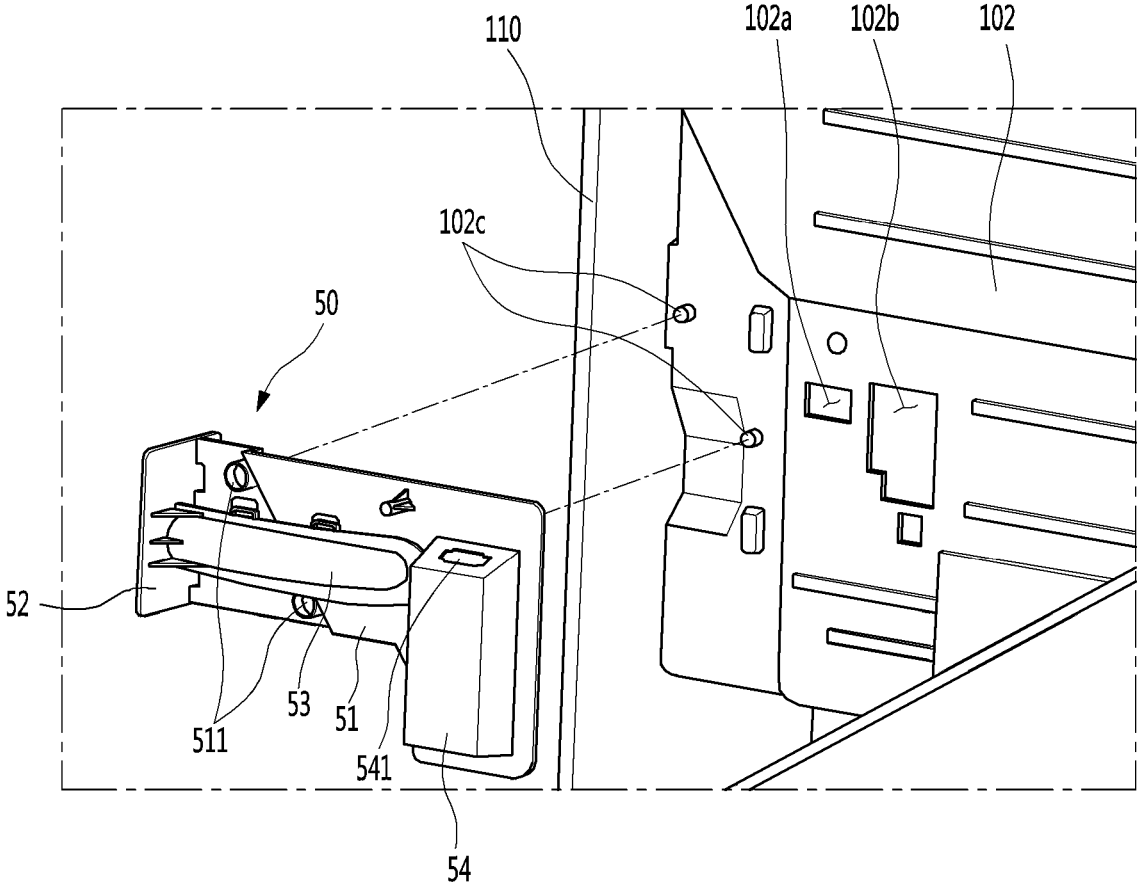
FIG. 7 is an exploded perspective view of an example coupling structure of a tube guide.
Figure 8:
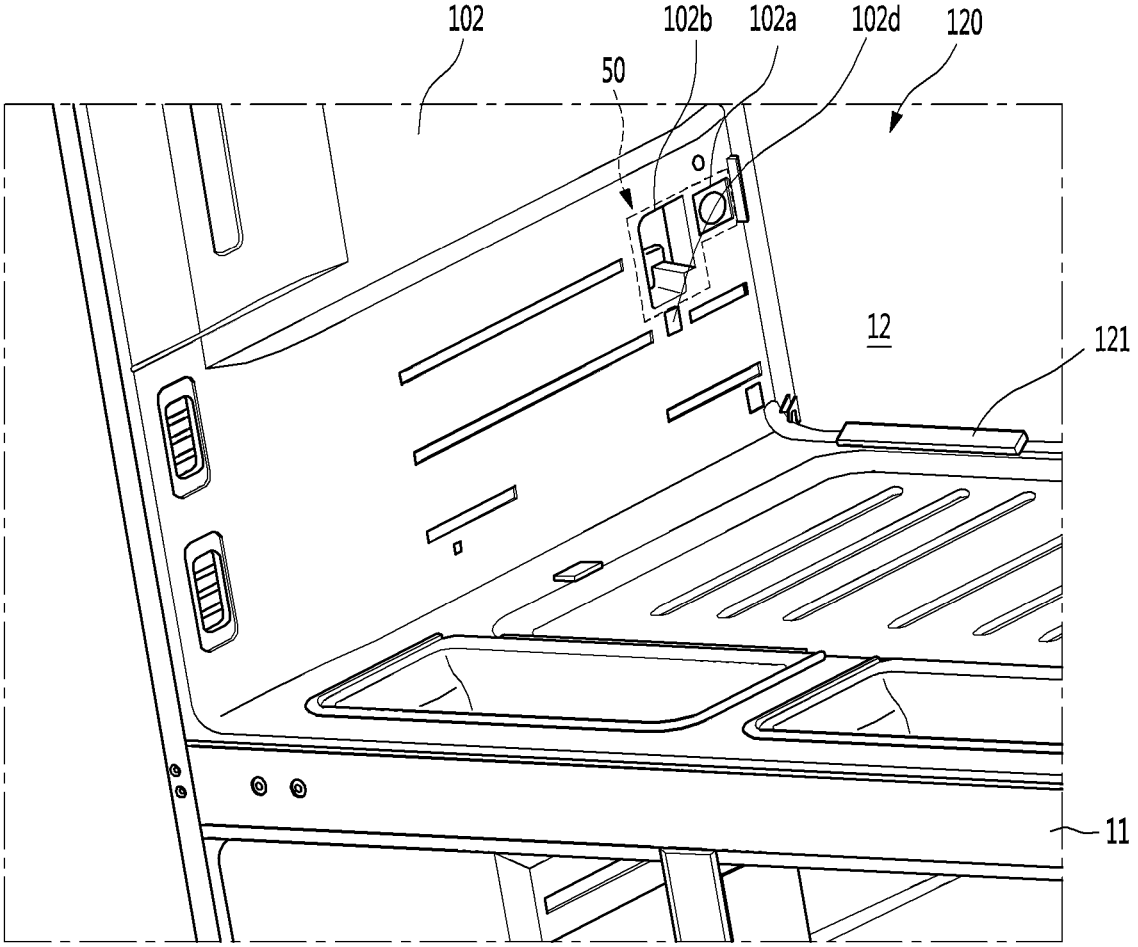
FIG. 8 is a partial perspective view of an inside of an example refrigerator compartment.

FIG. 5 illustrates an example refrigerator compartment. FIG. 6 illustrates an example cabinet. FIG. 7 illustrates an example tube guide. FIG. 8 illustrates an example refrigerator compartment.

As illustrated in the drawings, an inner surface of the refrigerator compartment 12 is formed by the inner case 102, and the water purifying device 40, the main water tank 60, the first branch valve 326 and a valve cover 55 may be provided inside the refrigerator compartment 12.

To supply the water to the water purifying device 40, the main water tank 60 and the first branch valve 326, the water supply path has to be insertable into an inside of the inner case 102, and also the electric wire for driving the first branch valve 326 has to be insertable into the inside of the inner case 102.

To this end, a tube hole 102*a* and an electric wire hole 102*b* are formed at one side surface of the inner case 102. The tube hole 102*a* and the electric wire hole 102*b* may be formed at a second half of the refrigerator compartment 12 close to an installation position of the first branch valve 326 so as to allow access of the water supply path and the electric wires. And the tube guide 50 may be installed at an outer surface of the inner case 102 corresponding to the tube hole 102*a* and the electric wire hole 102*b*.

The tube guide 50 is installed and fixed to an outer wall surface of the inner case 102, and when the tube guide 50 is installed, the tube hole 102*a* and the electric wire hole 102*b* are located at positions corresponding to an inlet port 531 of a tube guiding portion 53 and a connector installation part 54 formed at the tube guide 50.

The tube guide 50 may be disposed at a lower portion and the second half of the refrigerator compartment 12 while being installed at the inner case 102. That is, due to a characteristic of installation positions of the water purifying device 40, the main water tank 60 and the first branch valve 326, the tube guide 50 may be located at a lower half and a second half of a side wall surface of the refrigerator compartment 12 closed to them.

A guide installation groove (or hole) 511 corresponding to a guide installation protrusion 102*c* protruding to an outside of the inner case 102 is formed at the tube guide 50. Therefore, the tube guide 50 may be installed at an exact position of the inner case 102 by matching the guide installation protrusion 102*c* with the guide installation groove 511.

When the insulator 103 fills the inside of the cabinet 100 while the tube guide 50 is attached to the outer surface of the inner case 102, the tube guide 50 is in close contact with the inner case 102, and thus the insulator 103 is prevented from being introduced into the tube hole 102*a* or the electric wire hole 102*b*.

And while the tube guide 50 is installed at the inner case 102, the tube guide 50 is also in contact with the rear surface of the cabinet 100, e.g., a rear surface of the outer case 101, and the water supply path which is inserted and withdrawn through the tube guide 50 may pass through the side surface of the inner case 102, and may pass through the rear surface of the cabinet 100.

Figure 9:
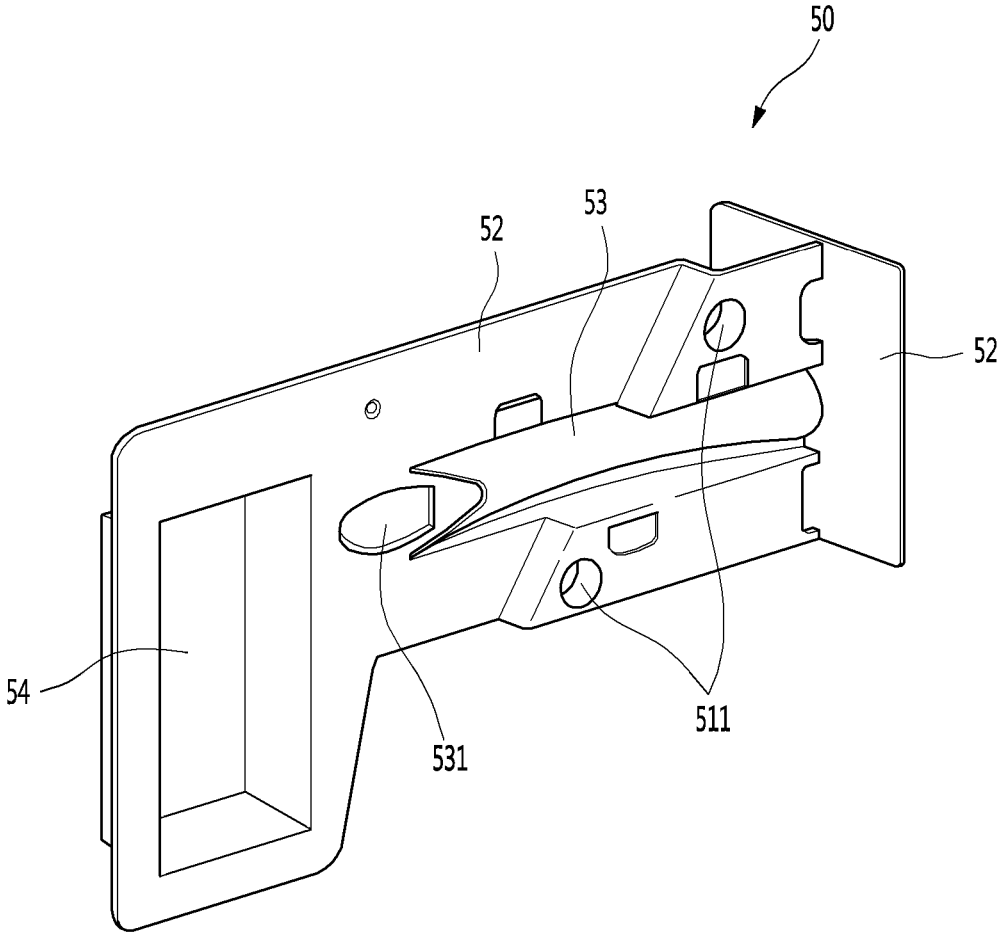
FIGS. 9 and 10 are a perspective views of an example tube guide.
Figure 10:
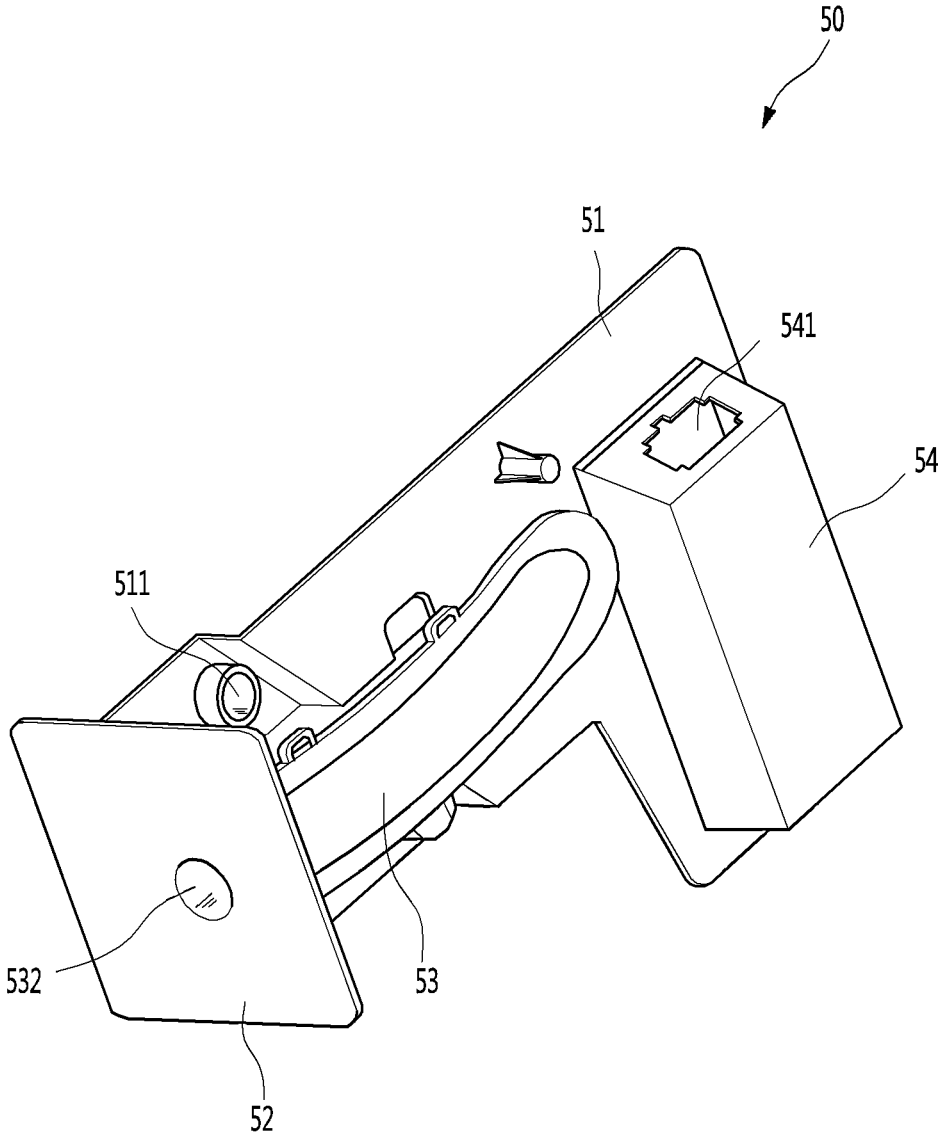

FIGS. 9 and 10 illustrate example tube guides.

As illustrated in the drawings, the tube guide 50 may include a side surface 51 which is in contact with the inner case 102, and a rear surface 52 which is in contact with the outer case 101.

The side surface 51 and the rear surface 52 are formed in plate shapes which are perpendicular to each other, and may be formed to be in close contact with one surface of the inner case 102 forming a side wall surface of the refrigerator compartment 12 and the rear surface of the outer case 101 forming the rear surface of the cabinet 100, respectively.

The tube guiding portion 53 is further formed at the tube guide 50. The tube guiding portion 53 serves to guide the water supply path, which is inserted and withdrawn from the refrigerator compartment 12, at the inside of the refrigerator compartment 12, and may connect the side surface 51 with the rear surface 52.

The water supply path may bypass an area in which the refrigerator compartment evaporator 130 is accommodated by the tube guiding portion 53. That is, the water supply path may be inserted and withdrawn at a side of the refrigerator compartment 12 through the rear surface of the cabinet 100 without interference with the refrigerator compartment evaporator 130 provided at the second half of the refrigerator compartment 12.

And the inlet port 531 and an outlet port 532 which are opened at both ends of the tube guiding portion 53 may be exposed to the side surface 51 and the rear surface 52, respectively, and may be in communication with openings of the inner case 102 and the outer case 101, respectively.

That is, the water supply paths which are respectively connected to the main water tank 60, the water purifying device 40 and the first branch valve 326 may be inserted from the inside of the refrigerator compartment 12 toward the inlet port 531 of the tube guiding portion 53, and then may be withdrawn through the rear surface of the cabinet 100.

Therefore, a connecting operation of the water supply path may be performed at the inside the refrigerator compartment 12, and the water purifying device 40, the main water tank 60 and the first branch valve 326 which are connected to the water supply paths are installed at the refrigerator compartment 12, and the water supply paths may be withdrawn to an outside through the tube guide 50, and thus the connection operation of the water supply path may be completed without a separate operation at the outside of the cabinet 100.

The tube guiding portion 53 may be rounded with a predetermined curvature. Therefore, the water supply path inserted from the inside of the refrigerator compartment 12 may be naturally moved along the curvature of the tube guiding portion 53 to a rear side of the cabinet 100.

The connector installation part 54 is formed at a front side of the tube guiding portion 53. The connector installation part 54 to which the electric wire connected to the first branch valve 326 is connected may form a recessed space having a size corresponding to that of the electric wire hole 102*b*.

And a connector fixing opening 541 is formed at a recessed upper surface of the connector installation part 54. Therefore, a connector 542 which is provided at an end of the electric wire connected to a control part 3 may be installed and fixed to the connector fixing opening 541. Therefore, an electric wire connector connected to the first branch valve 326 may be connected to the connector 542 at an inside of the connector installation part 54.

That is, when the first branch valve 326 is assembled, the connector 542 fixed to the connector fixing opening 541 may be exposed through the electric wire hole 102*b* in a state in which the tube guide 50 is installed, and the electric wire connector is coupled to the connector 542, and thus the first branch valve 326 may be electrically connected to the control part 3.

Figure 11:
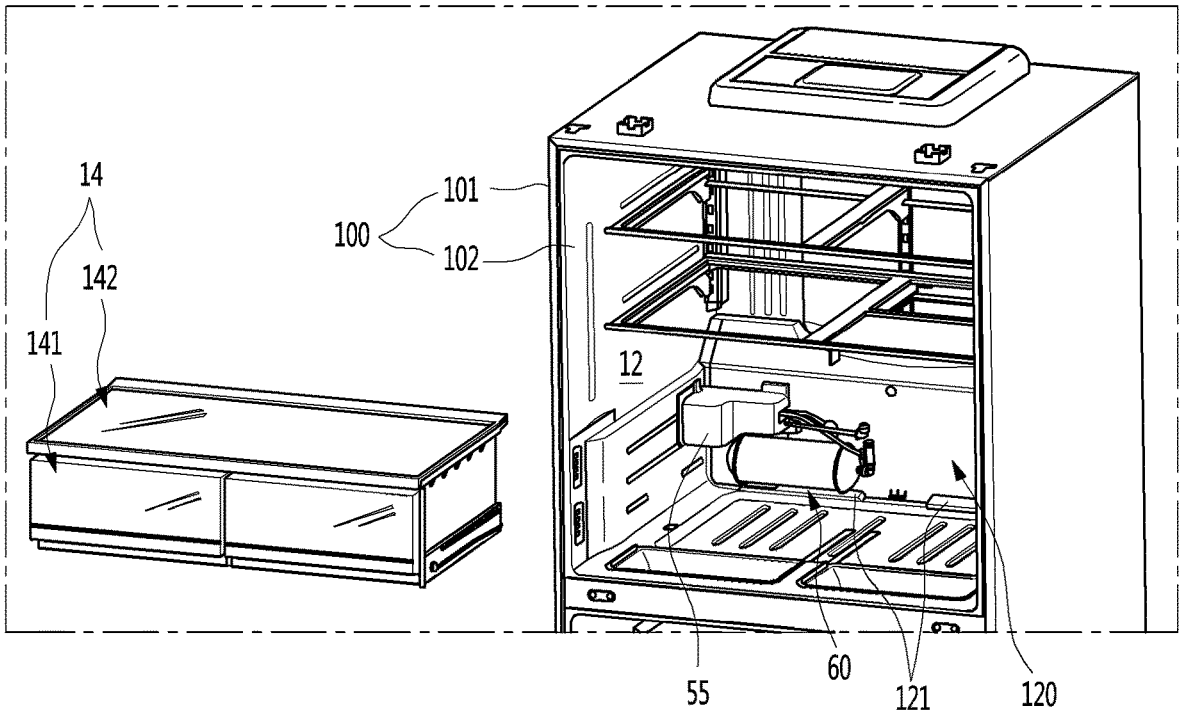
FIG. 11 is an exploded perspective view of an example installation structure of a drawer assembly.
Figure 12:
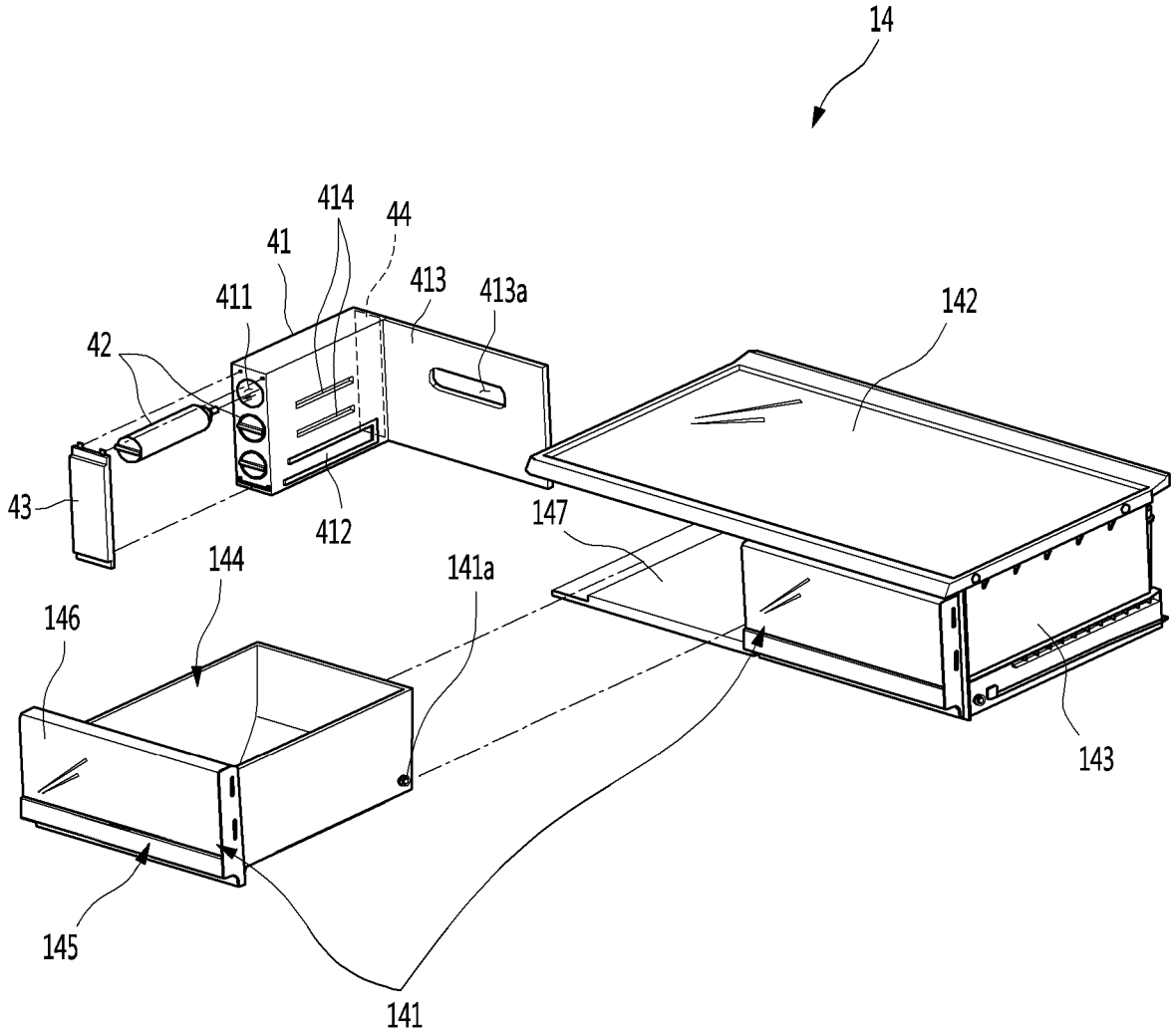
FIG. 12 is an exploded perspective view of an example drawer assembly.
Figure 13:
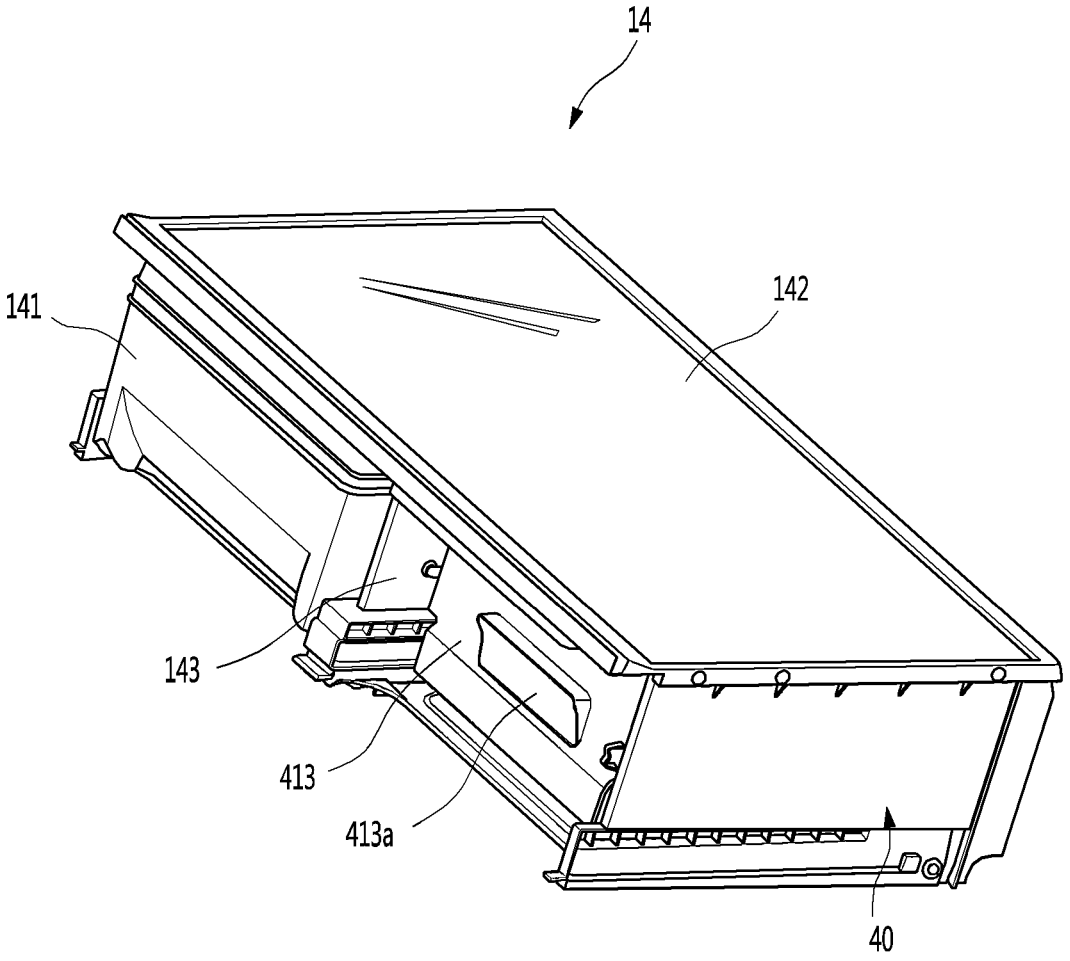
FIG. 13 is a rear perspective view of an example drawer assembly.

FIGS. 11-13 illustrate an example drawer assemblies.

As illustrated in the drawings, the drawer assembly 14 may be seated on the bottom surface of the refrigerator compartment 12. While the drawer assembly 14 is installed at the inside of the refrigerator compartment 12, spaces in which the main water tank 60 and the water purifying device 40 are respectively installed may be formed at a rear side and a lateral side of the drawer assembly 14.

Therefore, when the drawer assembly 14 is installed, the drawer assembly 14 shields the main water tank 60 at a front side thereof, and the water purifying device 40 may also be shielded by a front surface of the drawer 141 forming the drawer assembly 14.

The drawer assembly 14 may include the table 142 and the drawer 141. The table 142 is disposed at a position which is spaced apart from the bottom of the refrigerator compartment 12, vertically divides the refrigerator compartment 12, and thus forms a space, in which the drawer 141 is disposed, at a lower side of the table 142.

And the table 142 may serve as a shelf in a state in which the drawer assembly 14 is installed, and may cover an upper side of the drawer 141 which is provided to be inserted and withdrawn.

A side plate 143 which extends downward and supports both side surfaces of the drawer 141 may be formed at a lower surface of the table 142. The side plate 143 forms a space in which the drawer 141 is accommodated. And a drawer rail 412 which guides inserting and withdrawing of the drawer 141 may be provided at the side plate 143.

And a bottom plate 147 may be further provided at a lower end of the side plate 143. The bottom plate 147 forms a bottom surface of the drawer assembly 14, and is in contact with a lower surface of the refrigerator compartment 12.

The drawer 141 may be accommodated at an inside of a space formed by the table 142, the side plate 143 and the bottom plate 147.

For example, two drawers 141 are disposed at both of left and right sides, and front surfaces of the two drawers 141 may be formed to have the same size and shape when being seen from a front.

The drawer 141 may include an accommodation part 144 which are opened upward, and forms an accommodation space, and a front surface part 145 which forms a front surface of the accommodation part 144, e.g., the front surface of the drawer 141. And a roller 141*a* may be provided at a rear end of each of both side surfaces of the drawer 141. The roller 141*a* is rotatably accommodated inside the drawer rail 412, and enables the drawer 141 to be smoothly inserted and withdrawn.

The drawer 141 may be formed of a plastic material which is seen through, and thus the food accommodated therein may be recognized. In some implementations, the table 142 may also be formed of a transparent material so that the inside of the drawer 141 is checked through the table 142 without opening of the drawer 141.

Of the drawers 141 provided at both of the left and right sides, one drawer 141 close to the water purifying device 40 may be formed smaller than the other drawer 141. That is, the drawer 141 close to the water purifying device 40 is formed so that a width and a length of the accommodation part 144 are smaller, and thus the space in which the water purifying device 40 and the main water tank 60 are installed may be ensured. However, since the size and the shape of the front surface part 145 of each of the drawers 141 are the same as each other, the both of the left and right drawers 141 may be seen as having the same size.

Therefore, the front surface part 145 of the drawer 141 close to the water purifying device 40 may include a shielding part 146 which further extends toward a lateral side of the accommodation part 144, and the shielding part 146 protrudes laterally from a front end of the drawer 141. And while the drawer 141 is closed, the shielding part 146 may shield the water purifying device 40 from a front side thereof.

While the drawer 141 is closed, the water purifying device 40 may not be exposed to an outside, and thus the inside of the refrigerator compartment 12 may look like a neat state. In some implementations, since the shielding part 146 covers the water purifying device 40, a malfunction of the water purifying device 40 may also be prevented from occurring due to a user's careless operation.

The water purifying device 40 may be provided at a lateral side of the drawer 141. The water purifying device 40 may be accommodated between the table 142 and the bottom plate 147.

The water purifying device 40 may include a plurality of filters 42 which purify the supplied water, a case 41 in which the plurality of filters 42 are accommodated, and a case cover 43 which shields a front surface of the case 41.

Specifically, the plurality of filters 42 may be installed at the case 41, and may be disposed vertically. As the plurality of filters 42 are vertically stacked, a space of the refrigerator compartment 12 may be efficiently used. And even when a leakage occurs at the water purifying device 40, only a narrow area of the inside of the refrigerator compartment 12 is contaminated, and thus the space may be efficiently and safely configured.

The plurality of filters 42 may be connected by a head unit 44 provided inside the case 41, and the plurality of filters 42 may be disposed in parallel by coupling between the plurality of filters 42 and the head unit 44.

In some implementations, for example, the number of the plurality of filters 42 may be three. For example, the plurality of filters 42 may include a pre-carbon filter which is connected to a water inlet side of the head unit 44, a post-carbon filter which is connected to a water outlet side of the head unit 44, and a membrane filter which is disposed between the pre-carbon filter and the post-carbon filter, and thus may purify the water passing through the water purifying device 40. In some implementations, the number and the type of the filters 42 are not limited. However, the number of filters which can be accommodated in the water purifying device 40 and different types of functional filters for effectively purifying the water may be applied.

The case 41 is formed to have a size which forms one side surface of the drawer assembly 14, but formed slightly smaller than a forward and backward directional width of the table 142, and formed so that the space in which the main water tank 60 and the first branch valve 326 are accommodated is provided at a rear of the water purifying device 40.

A plurality of filter insertion holes 411 in which the plurality of filters 42 are respectively inserted are formed at the front surface of the case 41. Each of the plurality of filter insertion holes 411 may be formed corresponding to a cross-sectional size of each of the filters 42, and may be formed so that the filters 42 are inserted from a front.

And according to an arrangement structure of the plurality of filters 42, the plurality of filter insertion holes 411 may also be vertically disposed.

And a filter guide 414 which guides movement of the filter 42 when the filter 42 is inserted and enables the filter 42 to be connected to the head unit 44 may be further formed at an inner surface of the case 41. The filter guide 414 may extend in an insertion direction of the filter 42, and may protrude from the inner surface of the case 41 or may be recessed inward from an outer surface of the case 41.

And the drawer rail 412 may be further formed at the outer surface of the case 41. The drawer rail 412 serves to accommodate the roller 141*a* installed at one of both side surfaces of the drawer 141, and enables the roller 141*a* to be rotated when the drawer 141 is inserted and withdrawn.

Like this, the case 41 of the water purifying device 40 supports the drawer 141 and also forms the side surface of the drawer assembly 14, and thus may be referred to as an element corresponding to the side plate 143.

A shielding plate 413 which is formed to extend laterally may be provided at a rear end of the case 41. The shielding plate 413 may shield a rear space of the drawer 141, and may enable a complicated piping state connected to the main water tank 60 provided at a rear of the drawer 141 and other attached structures not to be exposed.

And the cooling air flowing hole 413*a* is formed at the shielding plate 413 so that the cooling air located at a side of the drawer 141 flows to the rear of the drawer 141. At this point, the cooling air flowing hole 413*a* may be located at a front of the main water tank 60, and thus the cooling air passing through the cooling air flowing hole 413*a* may be collected to a side of the refrigerator compartment evaporator 130 while passing through the main water tank 60.

Specifically, the cooling air flowing hole 413*a*, the main water tank 60 and a cooling air hole 121 of a grill pan 120 are arranged forward and backward, and the cooling air supplied to the inside of the refrigerator compartment 12 flows from a lower portion of the refrigerator compartment 12 to the cooling air flowing hole 413*a*, the main water tank 60 and the cooling air hole 121 in turn. Therefore, the cooling air may be smoothly circulated in the refrigerator compartment 12, and cooling efficiency of the main water tank 60 may be enhanced. And due to a structural characteristic of the main water tank 60 formed in a cylindrical shape, the cooling air may flow toward the cooling air hole 121 along a circumference of the main water tank 60.

And by the cooling air flowing hole 413*a*, a user may check the main water tank 60 from an outside through the drawer 141, and since the main water tank 60 formed of stainless steel is visually exposed, the user may intuitionally recognize a function of the cold water.

In some implementations, the shielding plate 413 may not be integrally formed with the case 41 of the water purifying device 40, but may be coupled to another element of the drawer assembly 14, or may be independently installed at a rear space of the drawer 141.

The case cover 43 may be separably provided at the front surface of the case 41. The case cover 43 may shield the entire filter insertion hole 411 while being installed at the case 41, and forms an exterior of the front surface of the water purifying device 40. And the case cover 43 may be in contact with a rear surface of the shielding part 146 of the drawer 141 while being installed at the case 41, and may prevent movement of the drawer 141.

While the case cover 43 is separated from the case 41, the filter 42 may be separated or installed. At this point, to separate or install the filter 42, the drawer 141 may be first withdrawn. While the drawer 141 is withdrawn, the case cover 43 may be separated from the case 41. When a withdrawn distance of the drawer 141 is longer than a length of the filter 42, the filter 42 may be separated from the case 41 through a lateral space of the drawer 141. At this point, to smoothly separate the filter 42, the withdrawn distance of the drawer 141 should be set longer than the length of the filter 42.

Figure 14:
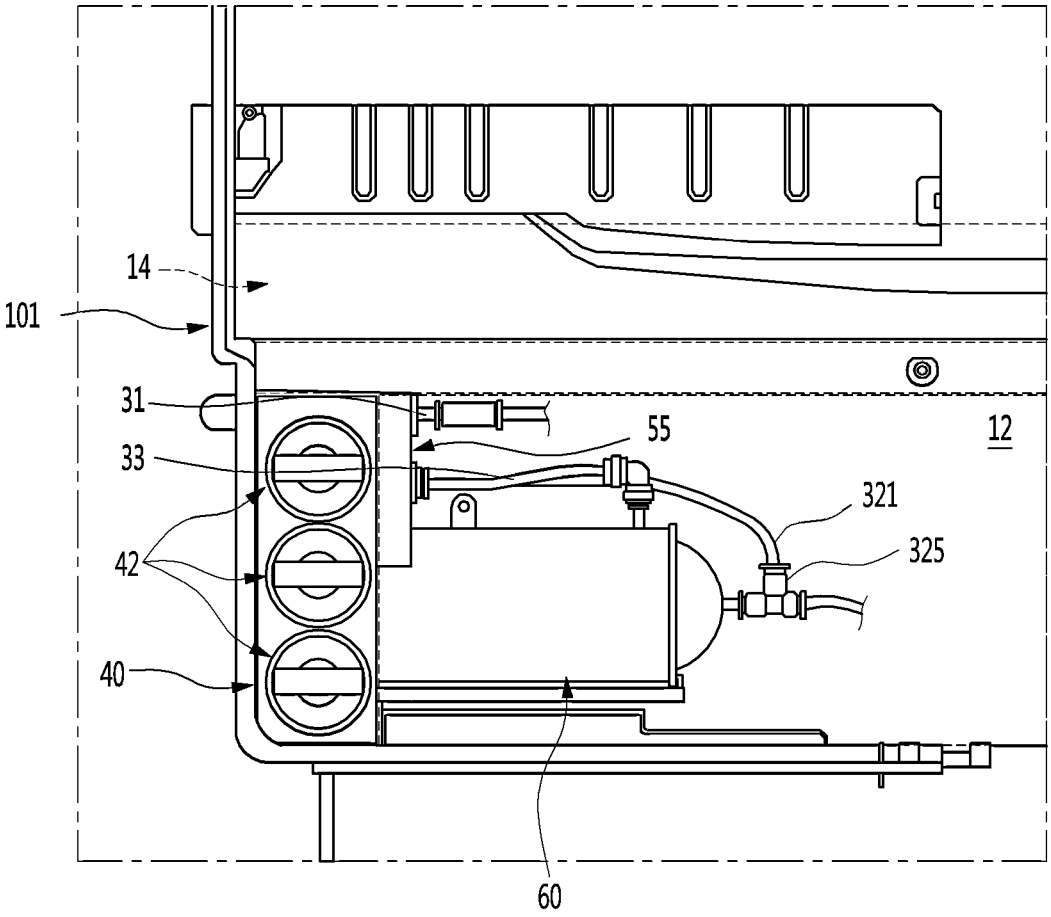
FIG. 14 is a partial front view of an example refrigerator compartment in which a drawer assembly is separated.
Figure 15:
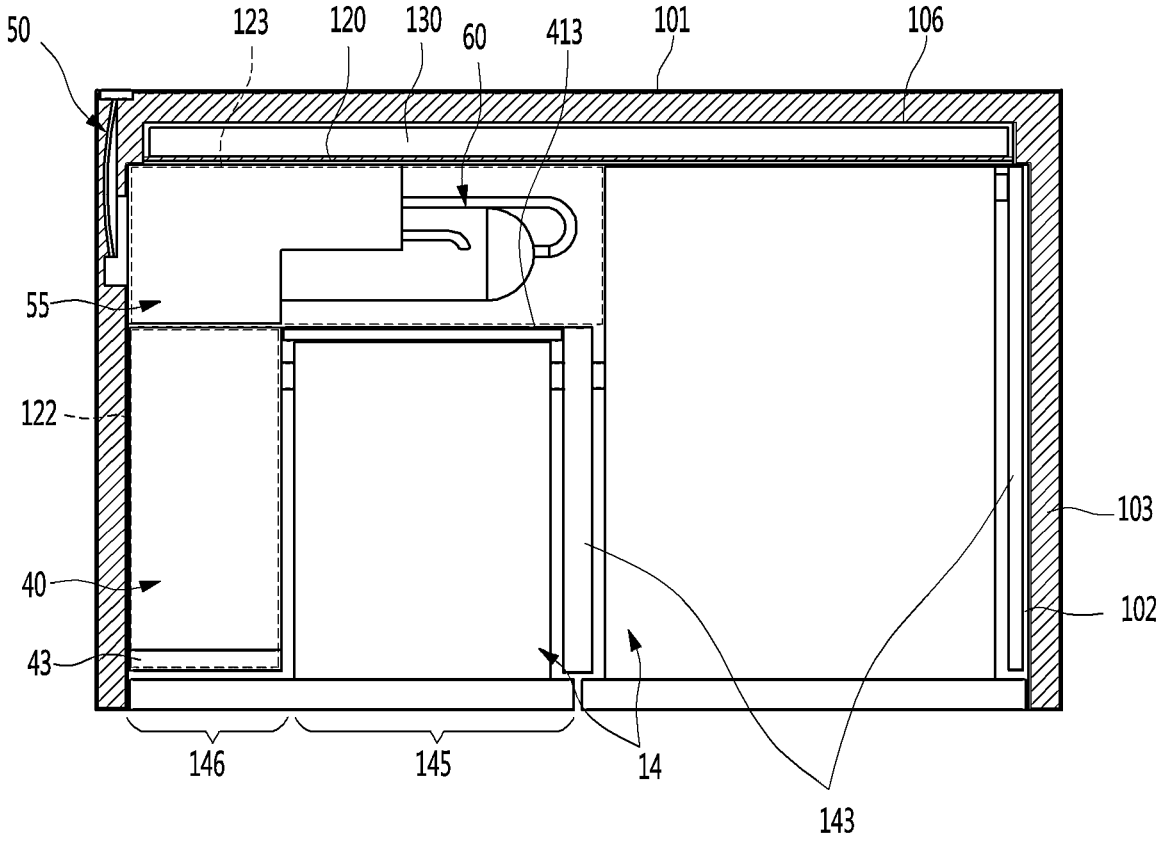
FIG. 15 is a cross-sectional view taken along line 15-15' of FIG. 3.
Figure 16:
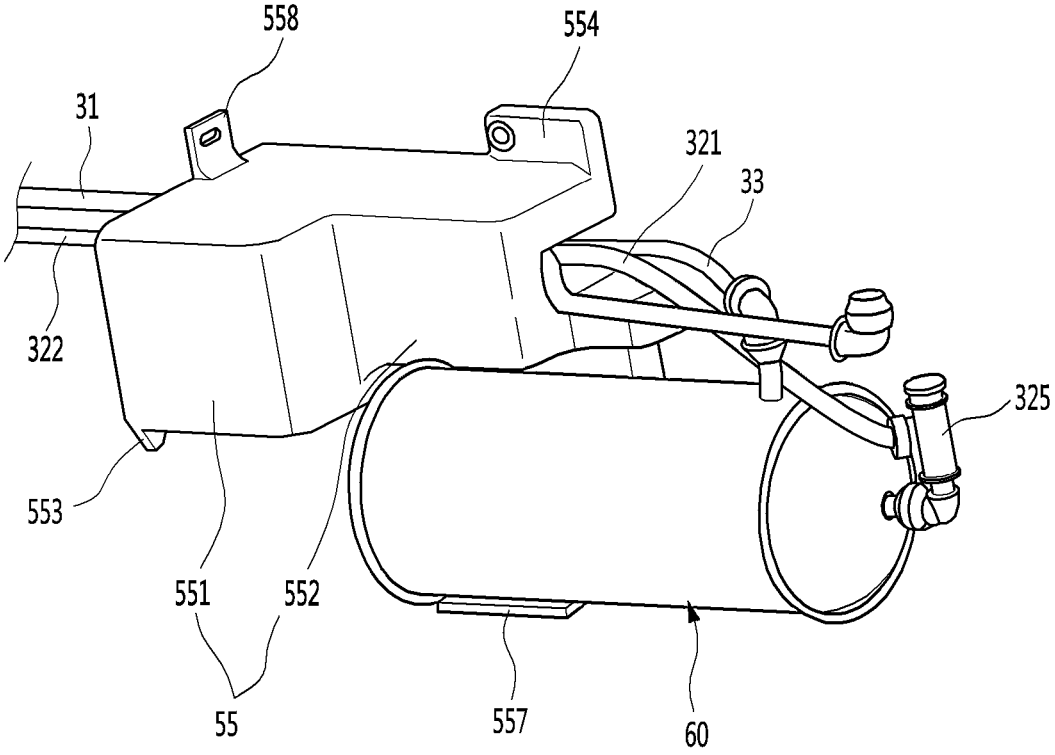
FIG. 16 is a perspective view of an example main water tank and an example valve cover coupled together.
Figure 17:
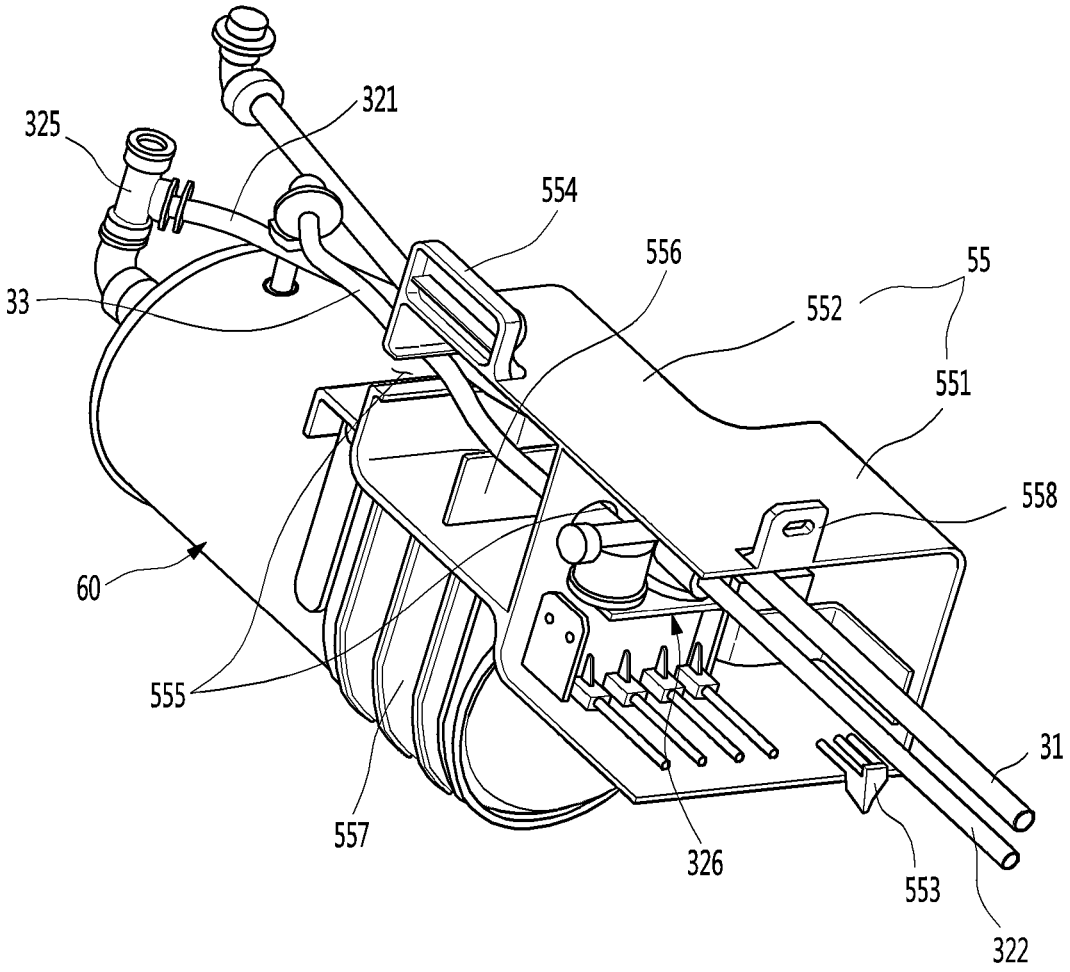
FIG. 17 is a rear perspective view of an example main water tank and an example valve cover coupled together.
Figure 18:
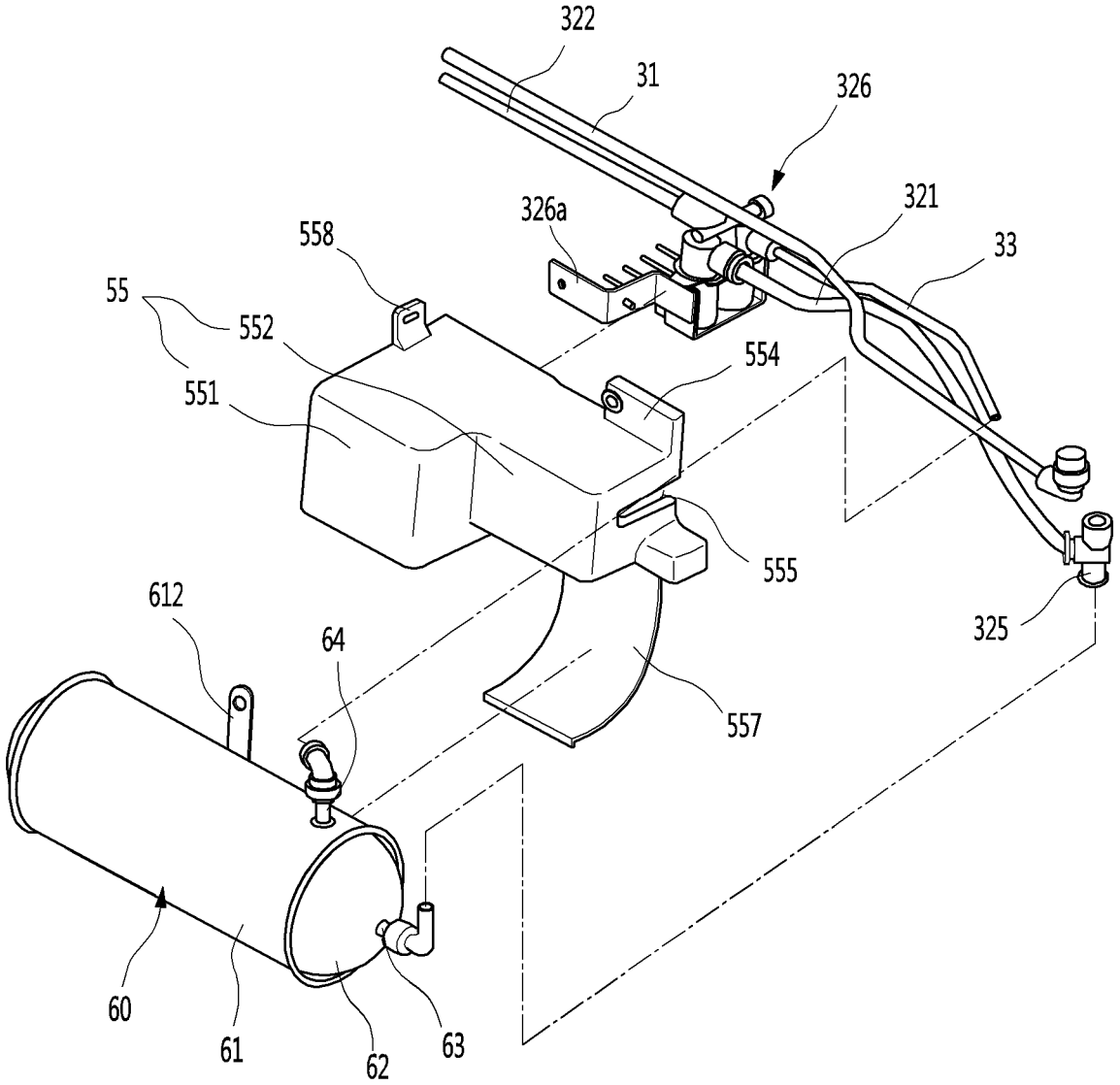
FIG. 18 is an exploded perspective view of an example main water tank and an example valve cover.
Figure 19:
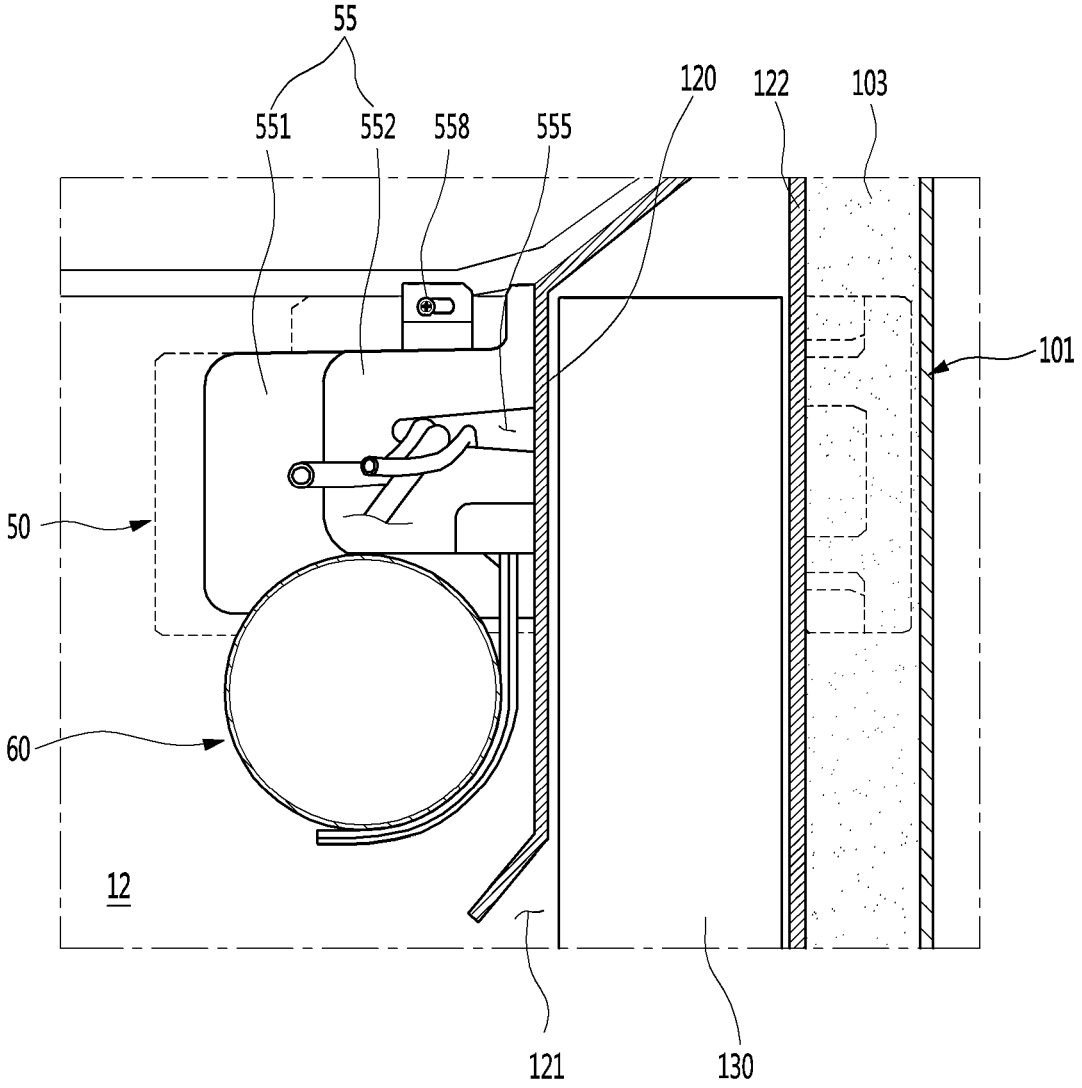
FIG. 19 is a cross-sectional view of an example main water tank and an example valve cover.

FIG. 14 illustrates example refrigerator compartment. FIG. 15 illustrates an example cross-sectional view taken along line 15-15' of FIG. 3.

As illustrated in the drawings, the water purifying device 40 becomes in close contact with one side wall surface of the refrigerator compartment 12, and the main water tank 60 and the first branch valve 326 are disposed to be in close contact with the grill pan 120. And the water purifying device 40 and the main water tank 60 are disposed such that ends thereof are close to each other and also perpendicular to each other. That is, the water purifying device 40 and the main water tank 60 may be disposed at one side corner of the second half of the refrigerator compartment 12.

And the first branch valve 326 and the valve cover 55 which accommodates the first branch valve 326 are disposed at a space located at the rear of the water purifying device 40 and an upper side of the main water tank 60. Such an arrangement structure relates to a position of the tube guide 50 for an access of the water supply path and the electric wire to an inside of the refrigerator. The water purifying device 40, the main water tank 60 and the first branch valve 326 are disposed at a position close to a side surface at which the tube guide 50 is located, and thus an arrangement of the water supply path may be facilitated, and connecting and assembling of the path may also be facilitated.

An internal space of the refrigerator compartment 12 may be divided by installing the drawer assembly 14. Specifically, based on the drawer 141 close to the water purifying device 40, a first space 122 at which the water purifying device 40 is installed is formed at one lateral side of the drawer 141, and a second space 123 is formed at the rear of the drawer 141 when the drawer assembly 14 is installed.

Specifically, the first space 122 may be a space between the case 41 and a side wall of the refrigerator compartment 12, and the case 41 may have horizontal and vertical widths corresponding to those of the first space 122. And the second space 123 is a space among the drawer 141, a rear of the first space 122 and the grill pan 120, and the main water tank 60 may be provided at the second space 123. The first branch valve 326 and the valve cover 55 may be located at the rear of the first space 122.

That is, by installing the drawer assembly 14, predetermined spaces (the first space and the second space) are defined in the refrigerator compartment 12, and the water purifying device 40, the main water tank 60 and the first branch valve 326 are disposed in the predetermined spaces, and also the water supply paths connecting them may also be disposed therein.

In addition, the first branch valve 326 and the main water tank 60 may be installed before installing the drawer assembly 14. At this point, the water supply paths may be withdrawn from the inside of the refrigerator compartment 12 to the outside of the cabinet 100 through the tube guide 50.

Therefore, while all of the water purifying device 40, the first branch valve 326 and the main water tank 60 are connected by the water supply paths, the water supply paths may be withdrawn to the outside through the tube guide 50, and thus an additional connection operation in the refrigerator compartment 12 is not required, and assemblability may be considerably enhanced.

FIGS. 16-19 illustrate example main water tanks and example valve covers.

As illustrated in the drawings, the valve cover 55 is installed and fixed to an inner wall surface of the refrigerator compartment 12, and the first branch valve 326 is accommodated in the valve cover 55. And the main water tank 60 may be installed at one side of the valve cover 55.

Specifically, the valve cover 55 accommodates the first branch valve 326 therein, guides the water supply paths introduced into the refrigerator compartment 12, and enables the main water tank 60 to be fixed.

The valve cover 55 may include a valve accommodation part 551 in which the first branch valve 326 is accommodated, and a cover extension part 552 at which the main water tank 60 is installed.

The valve accommodation part 551 has a predetermined space to accommodate the first branch valve 326, and is in close contact with the side wall surface of the refrigerator compartment 12. At this point, a position of the valve accommodation part 551 may correspond to a position of the tube guide 50, and the electric wire hole **102*b* and the tube hole 102*a* may be located inside an opened surface of the valve accommodation part 551. Therefore, the electric wire connected to the first branch valve 326 and the connection part 322 of the purified water pipe 32 connected to the outlet port of the first branch valve 326 may have access to the valve accommodation part 551**.

A cover fixing piece 553 protrudes downward from a lower end of an opened end of the valve accommodation part 551, and a first cover fixing part 558 extends upward from an upper end thereof. The cover fixing piece 553 is inserted into a cover fixing groove **102*d* which is formed at one side of the inner case 102 or the valve cover 55 to have a corresponding shape, and provisionally fixes the valve cover 55. And while the valve cover 55 is provisionally fixed, a screw passing through the inner case 102 and the tube guide 50 is fastened to the first cover fixing part 558, and thus the valve cover 55** may be fixed.

The cover extension part 552 extends from the valve accommodation part 551 in a direction that intersects with the valve accommodation part 551. The cover extension part 552 is also formed so that one surface thereof is opened, and the opened surface is in close contact with the grill pan 120 corresponding to the rear surface of the refrigerator compartment 12. Therefore, the valve cover 55 may be in close contact with a corner formed by the side wall of the refrigerator compartment 12 and the grill pan 120.

The cover extension part 552 extends in a predetermined length, and a second cover fixing part 554 which extends upward is formed at an upper end of the cover extension part 552. A screw passing through the second cover fixing part 554 and the grill pan 120 is fastened to the second cover fixing part 554, and thus the valve cover 55 may be in close contact with the grill pan 120.

A cover hole 555 may be formed at a side surface of the cover extension part 552 and a dividing plate of the cover extension part 552. The water supply paths, more specifically, the water supply pipe 31, the main cold water pipe 33 and the water inlet part 321 of the purified water pipe 32 may have access through the cover hole 555. And a support part 556 which supports the water supply path may be formed inside the cover extension part 552, and the water supply path may be prevented from sagging or being twisted, and may be maintained in an arranged state.

And a water tank installation part 557 which extends downward is provided at a lower end of the cover extension part 552. The water tank installation part 557 may be formed to extend downward and to cover a circumferential surface of the main water tank 60. Therefore, the main water tank 60 may be seated on the water tank installation part 557. While the main water tank 60 is seated on the water tank installation part 557, the main water tank 60 is spaced apart from the bottom surface of the refrigerator compartment 12, and thus the air may smoothly flow.

The main water tank 60 installed at the valve cover 55 may be fixed to a position close to the grill pan 120 by the water tank installation part 557 and a tank fixing part 612 provided at the main water tank 60. For example, the first space 122 may be disposed to be overlapped with a space, at which the refrigerator compartment evaporator 130 is located, in a forward and backward direction.

And since the refrigerator compartment evaporator 130 for cooling the refrigerator compartment 12 is provided at a rear of the grill pan 120, the main water tank 60 located at a position close to the refrigerator compartment evaporator 130 may be directly cooled. At the same time, the main water tank 60 is located at a front of the cooling air hole 121 formed at the grill pan 120, and thus indirectly cooled by a flow of the cooling air collected through the cooling air hole 121. In particular, the main water tank 60 is formed of a stainless steel material, and thus may be effectively cooled.

Figure 20:
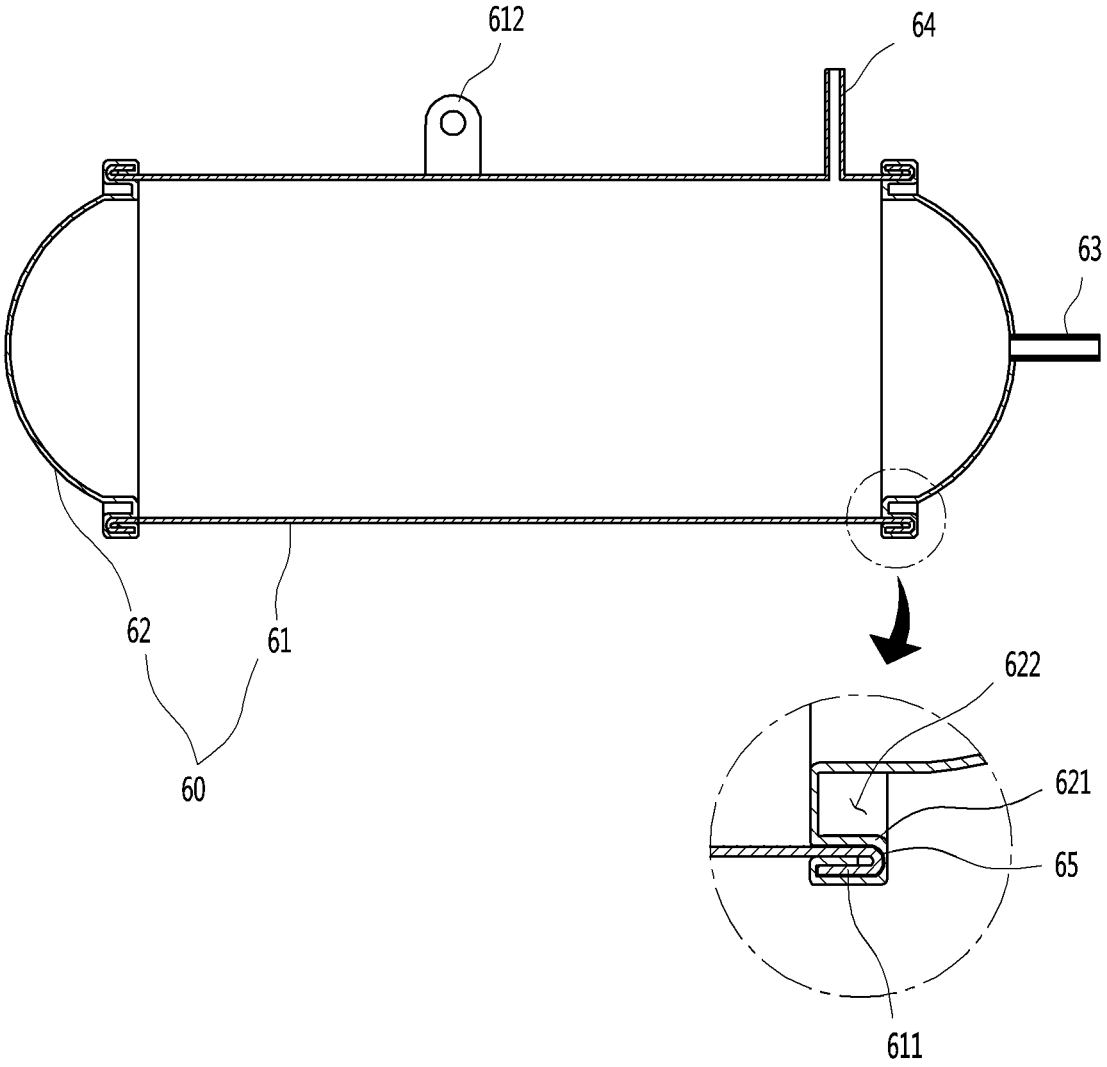
FIG. 20 is a cross-sectional view of an example main water tank.
Figure 21:
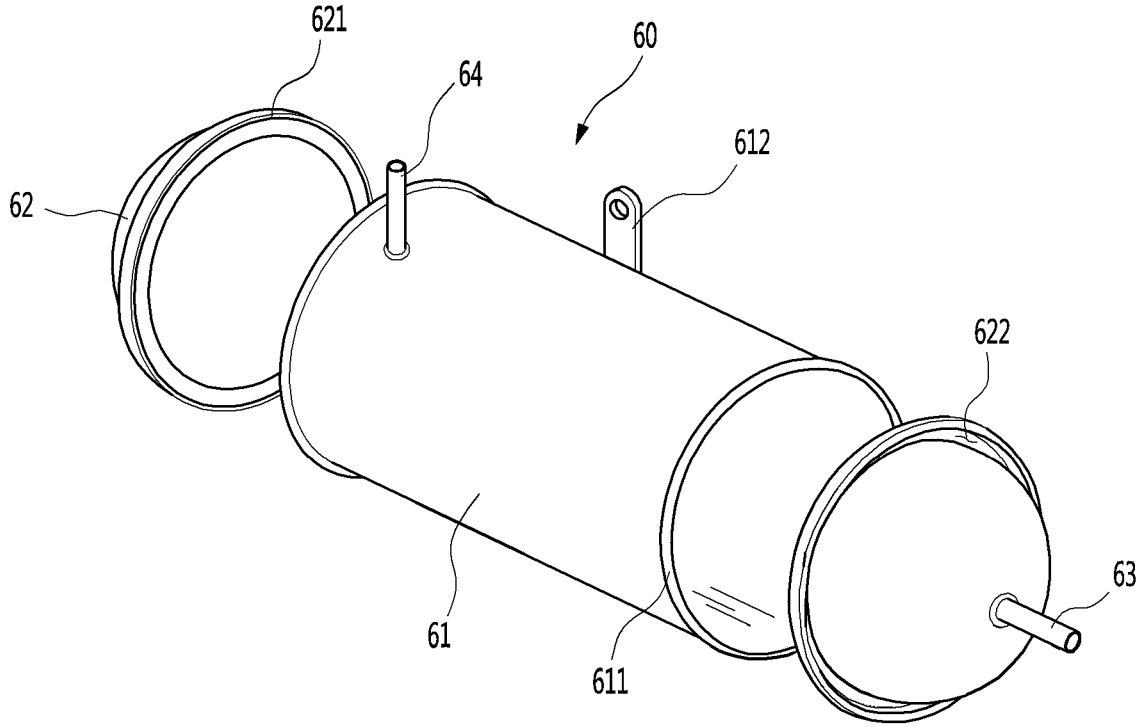
FIG. 21 is an exploded perspective view of an example main water tank.

FIGS. 20 and 21 illustrate example main water tanks.

As illustrated in the drawings, both ends of the main water tank 60 are generally formed in hemispheric shapes. And the main water tank 60 may be formed of the stainless steel material which is harmless to a human body, prevents rust or corrosion, and has excellent cooling efficiency.

Specifically, the main water tank 60 may include a cylindrical tank body 61 of which both ends are opened, and a plurality of hemispheric tank caps 62 which shield openings of the tank body 61. And a water outlet pipe 64 is connected to the tank body 61, and a water inlet pipe 63 is connected to one of the plurality of tank caps 62, and thus the purified water may be supplied, and also the cold water may be discharged.

A sheet formed of the stainless steel material is bent so that both ends are in contact with each other, and thus the tank body 61 is formed in the cylindrical shape, and the ends which are in contact with each other are bonded by welding. And the water outlet pipe 64 which is in communication with an inside of the tank body 61 is bonded by the welding.

At this point, the water outlet pipe 64 is located at an upper end of the tank body 61, and does not protrude to the inside of the tank body 61, but extends upward. Therefore, an inside of the main water tank 60 may be fully filled with the water, and in this state, the water may be discharged through the water outlet pipe 64. This means that the water in the main water tank 60 may be sufficiently cooled. In addition, since the water outlet pipe 64 is located at the upper end of the tank body 61, when the air fills the main water tank 60, the air may be first discharged through the water outlet pipe 64, and thus the water may be prevented from being discharged with the air.

And the tank body 61 is processed by electrolytic polishing while the water outlet pipe 64 is bonded, and moss or foreign substances may be prevented from being attached on an inner surface of the main water tank 60, and a surface thereof may be smoothed, and thus a cleaning operation may be smoothly performed when a cleaning solution is injected.

Each of the plurality of tank caps 62 is formed in the hemispheric shape by machining a circular plate formed of the stainless steel material in a press working, and may be formed to have a size which shields the opened surface of the tank body 61.

The plurality of tank caps 62 are provided at both of left and right sides of the tank body 61, and the water inlet pipe 63 is bonded to a center of one of the tank caps 62. The water inlet pipe 63 is bonded by the welding, and extends laterally. And the water inlet pipe 63 may also be bonded so as not to protrude to the inside of the main water tank 60.

And each of the tank caps 62 may also be processed by the electrolytic polishing while the water inlet pipe 63 is bonded, and the moss or the foreign substances may be prevented from being attached on the inner surface of the main water tank 60, and a surface thereof may be smoothed, and thus the cleaning operation may be smoothly performed when the cleaning solution is injected.

That is, in a state in which the water outlet pipe 64 is bonded to the tank body 61, and the water inlet pipe 63 is bonded to the tank cap 62, the surface of each of the tank body 61 and the tank caps 62 may be processed by the electrolytic polishing, and then may be bonded to each other.

The tank body 61 and the tank caps 62 may be bonded to each other by curling. To this end, an end 611 of the tank body 61 and an end 621 of each of the tank caps 62 may be bent several times to have shapes corresponding to each other, and may be in surface contact with each other.

Also, silicone 65 is interposed between the end 611 of the tank body 61 and the end 621 of each of the tank caps 62, and seals between the tank body 61 and each of the tank caps 62, and thus maintains a sealed state even when the curling is performed.

Due to the curling, a stepped portion is neither generated at the inside of the main water tank 60 nor at a portion at which the tank body 61 and each of the tank caps 62 are in contact with each other, and the same plane may be provided. Also, the surface is smoothly polished by the electrolytic polishing, and thus the foreign substances may be prevented from being attached to the inside of the main water tank 60, and the cleaning operation may be smoothly performed when the cleaning solution is injected.

A recessed portion 622 in which a jig is inserted upon the curling of the tank body 61 and the tank caps 62 may be formed at a circumference of each of the tank caps 62. The recessed portion 622 may be formed along the circumference of each of the tank caps 62, and the jig may be inserted into the recessed portion 622, and thus each of the tank caps 62 may be rotated upon the curling.

And the tank fixing part 612 may be further provided at an upper portion of an outer surface of the tank body 61. The tank fixing part 612 may be formed to extend to an upper side of the tank body 61, to be bent at a predetermined angle, and to be in contact with a front surface of the grill pan 120. Therefore, the main water tank 60 may be further fixed to the grill pan 120 by the screw which passes through and is fastened to the tank fixing part 612 and the grill pan 120.

As illustrated in FIG. 21, a position of the water outlet pipe 64 may be disposed at a center portion of the main water tank 60 to be distant from the water inlet pipe 63. Therefore, since the position of the water outlet pipe 64 is disposed to be distant from that of the water inlet pipe 63, the input water may be sufficiently cooled while flowing through the inside of the main water tank 60, and then may be discharged through the water outlet pipe 64.

The valve cover and the tank installation part may have other structures.

Figure 22:
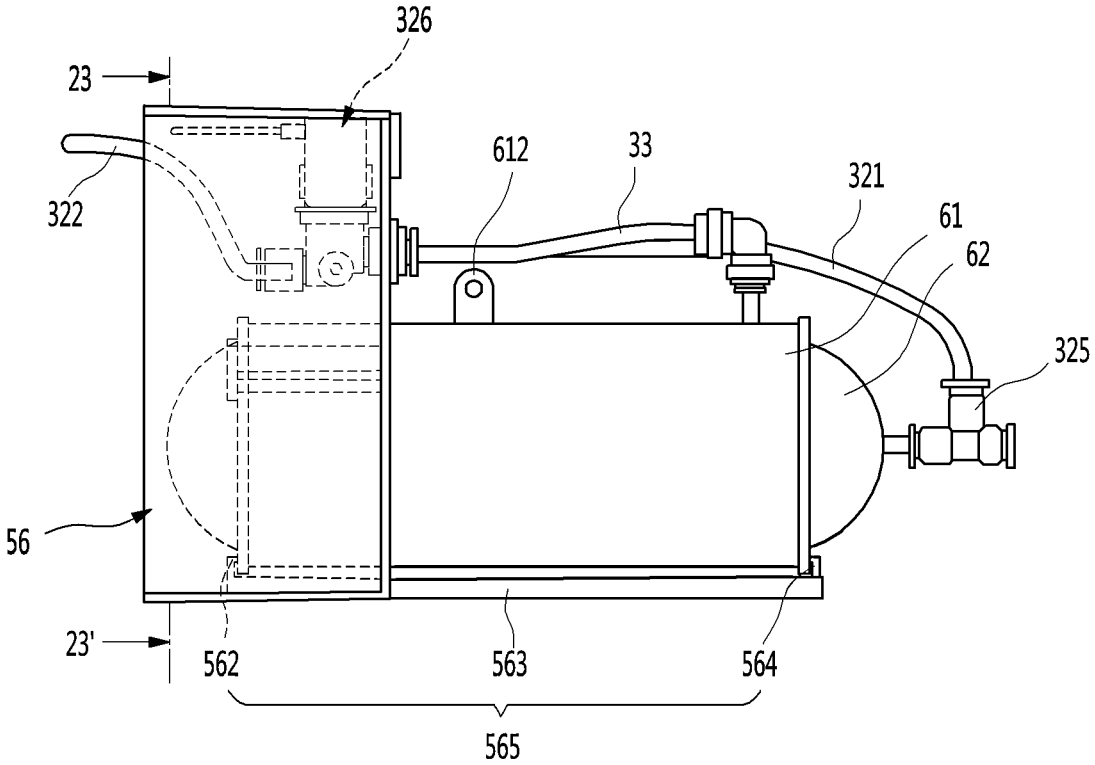
FIG. 22 is a front view of an example main water tank coupled to an example valve cover.

FIG. 22 illustrates an example main water tank coupled to an example valve cover.

Figure 23:
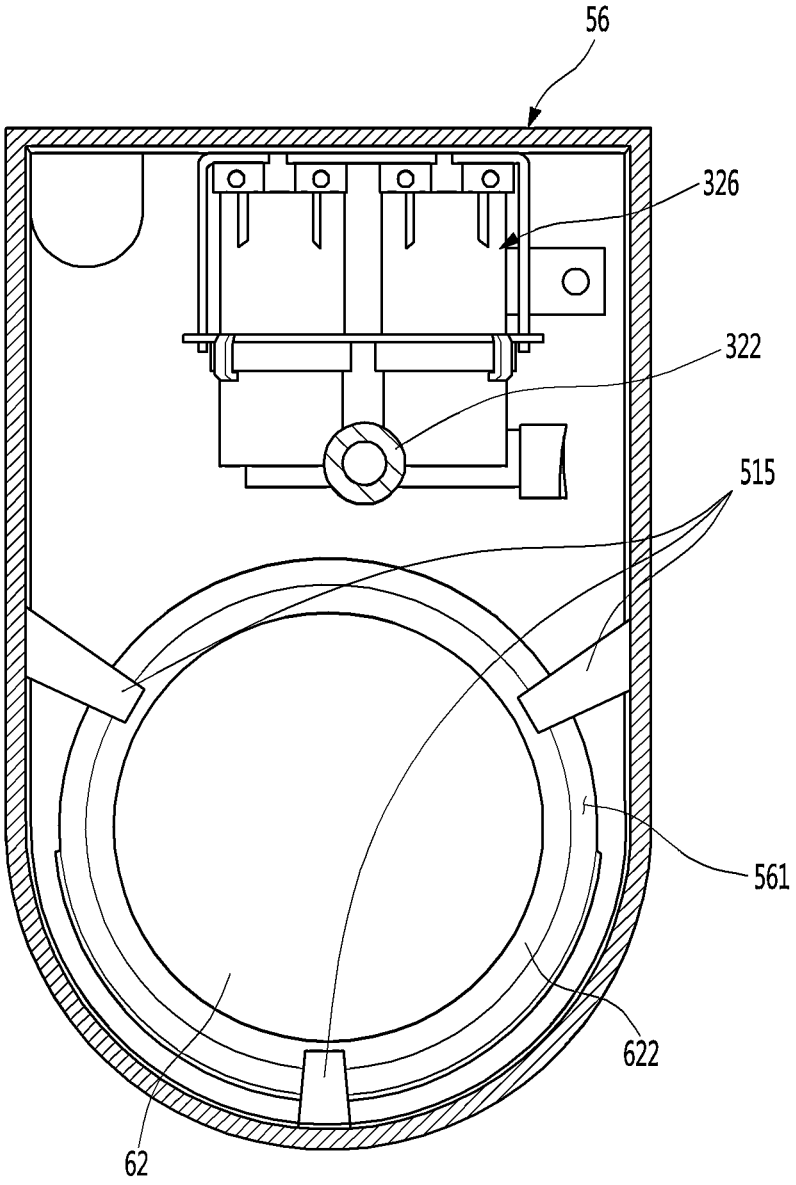
FIG. 23 is a cross-sectional view taken along line 23-23' of FIG. 22.

FIG. 23 illustrates an example cross-sectional view taken along line 23-23' of FIG. 22.

Figure 24:
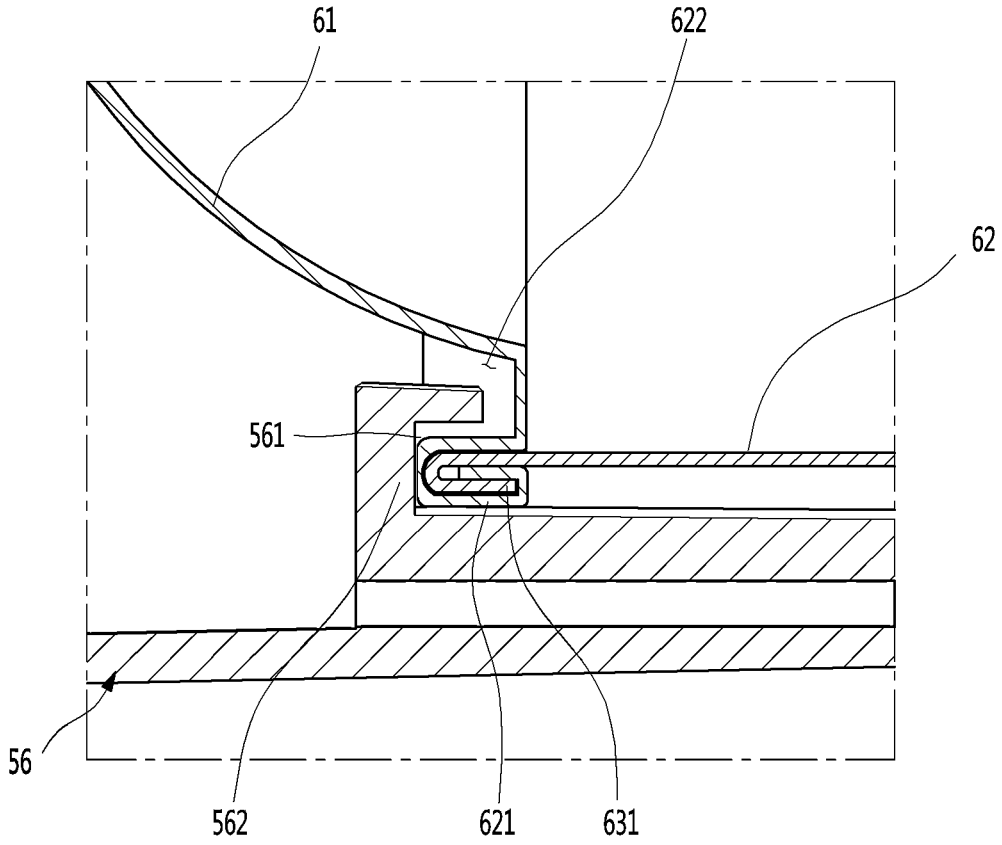
FIG. 24 is a cross-sectional view of an example installation structure of a main water tank.

FIG. 24 illustrates an example a main water tank.

As illustrated in the drawings, a valve cover 56 forms a space in which the first branch valve 326 is accommodated, and is installed and fixed to the side wall surface of the refrigerator compartment 12.

And a tank insertion hole 561 in which a part of the main water tank 60 is inserted is formed at the valve cover 56. And a tank installation part 565 which supports the main water tank 60 from a lower side thereof and also fixes both ends thereof is formed at the valve cover 56.

The tank installation part 565 may include a cover extension part 552 which extends from one side of the valve cover 56, and tank restriction parts 562 and 564 which are inserted onto a circumference of each of the tank caps 62.

Specifically, the cover extension part 552 extends long outward from a lower end of the tank insertion hole 561 of the valve cover 56, and extends to a position corresponding to an end of the tank body 61. At this point, the cover extension part 552 may be in contact with a lower surface of the tank body 61, and may support the main water tank 60.

The tank restriction parts 562 and 564 may include a first restriction part 562 which is provided inside the valve cover 55, and a second restriction part 564 which is provided at an end of the cover extension part 552, and thus may fix the main water tank 60 from both sides thereof.

Specifically, a plurality of first restriction parts 562 are disposed radially based on the tank insertion hole 561, extends toward an inside of the valve cover 55, and also extends to the end of the tank body 61. And an extended end of the first restriction part 562 may be formed in a hook shape, and may be inserted and hooked to an inside of the recessed portion 622 of the tank cap 62.

And the second restriction part 564 may be formed at an end of the cover extension part 552 which faces the first restriction part 562, may be formed in a hook shape at a position corresponding to the end of the tank body 61, and may be inserted and hooked to the inside of the recessed portion 622 of the tank cap 62. Therefore, the tank installation part 565 may be stably fixed to the main water tank 60 by the first restriction part 562 and the second restriction part 564.

Figure 25:
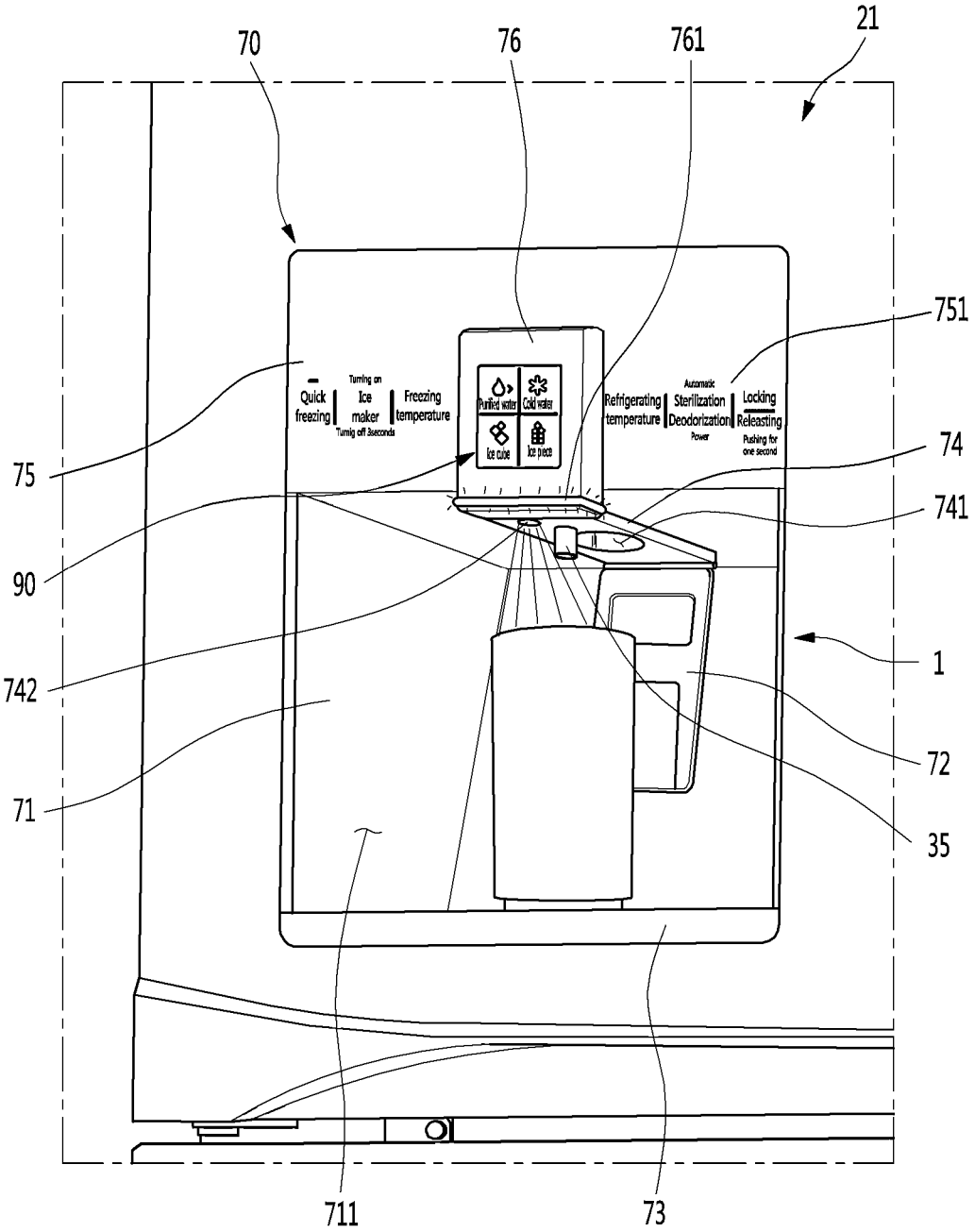
FIG. 25 is a partial perspective view of an example door with an example dispenser.
Figure 26:
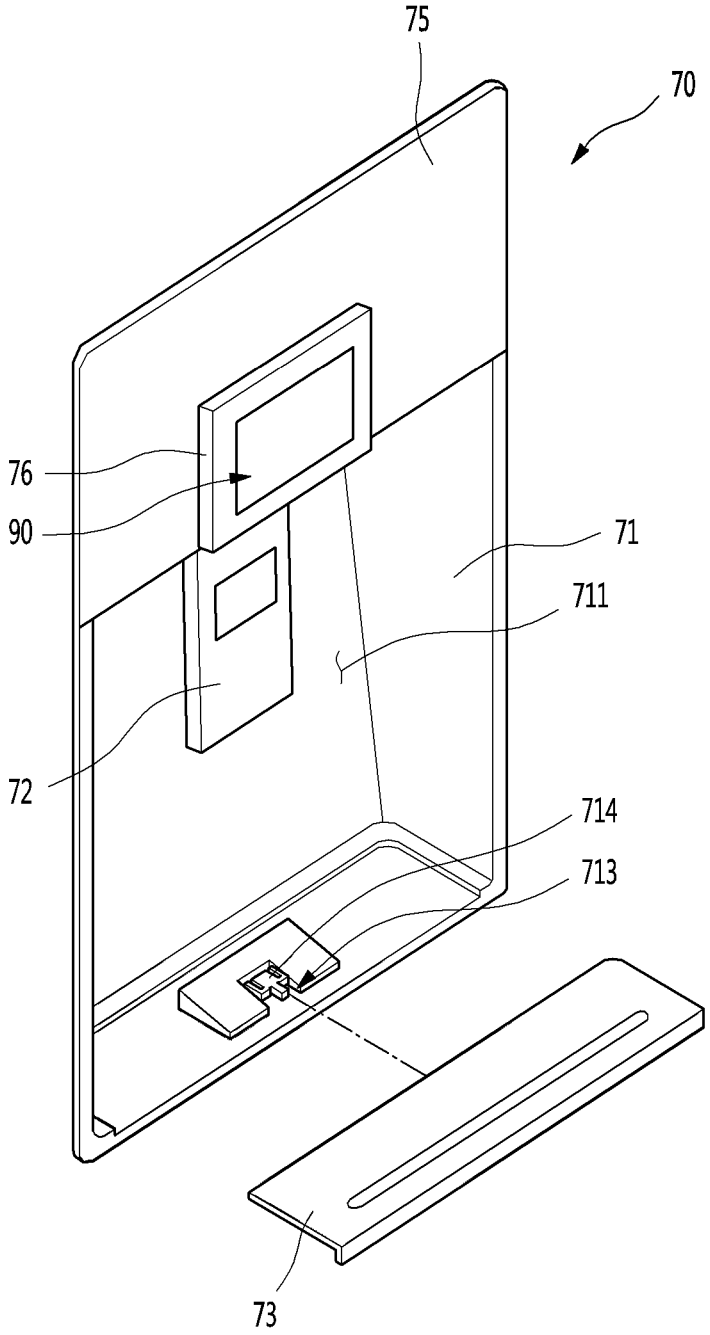
FIG. 26 is an exploded perspective view of an example dispenser tray that is separated from an example dispenser.
Figure 27:
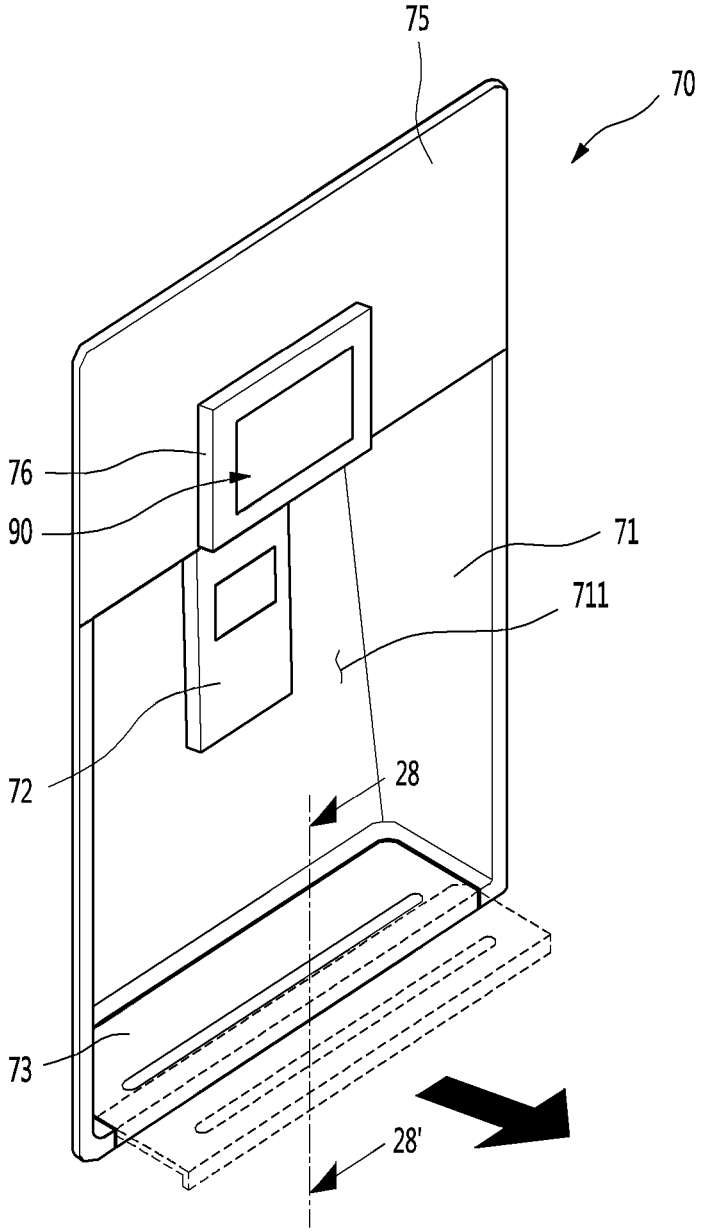
FIG. 27 is a perspective view illustrating an example dispenser tray being inserted and withdrawn.
Figure 28:
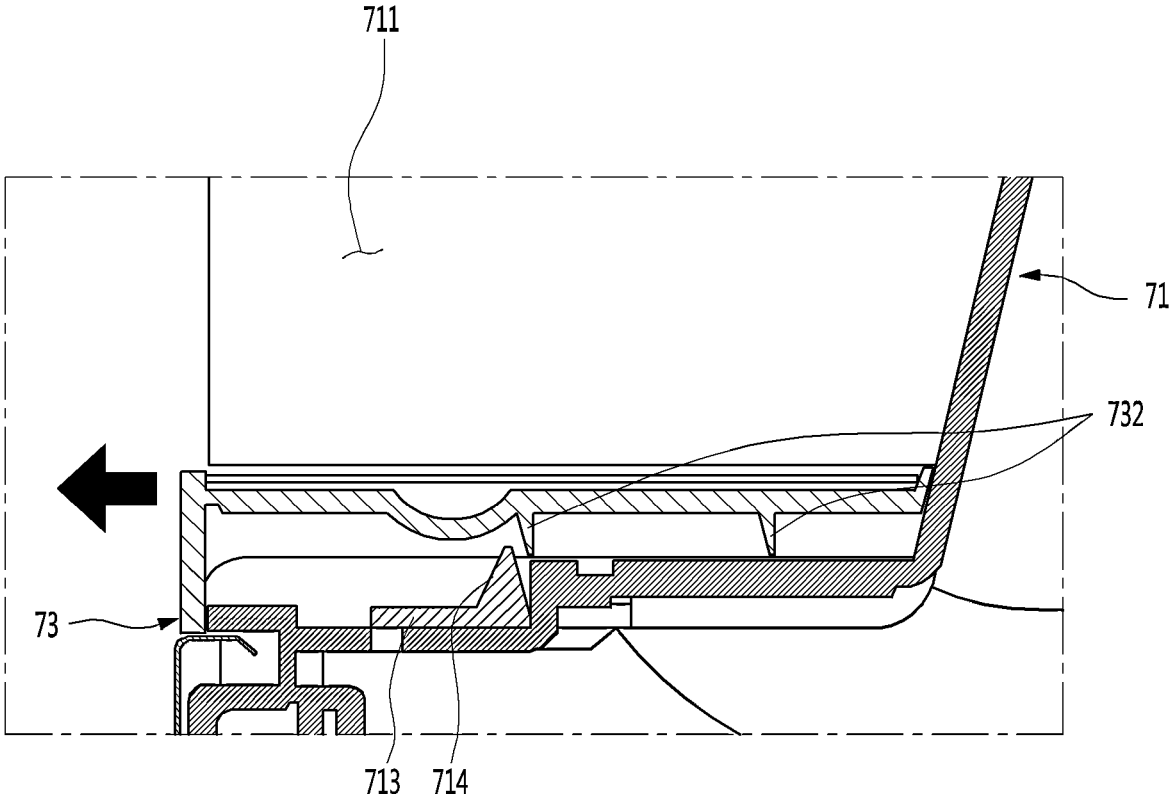
FIG. 28 is a cross-sectional view taken along line 28-28' of FIG. 27.

FIG. 25 illustrates an example door with an example dispenser. FIGS. 26 and 27 illustrate example dispenser trays. FIG. 28 illustrates an example cross-sectional view taken along line 28-28' of FIG. 27.

As illustrated in the drawings, the dispenser 70 is provided at the front surface of the refrigerator compartment door 21. An exterior of the dispenser 70 may be formed by a part or all of a dispenser case 71, a front plate 75, an operation lever 72 and a chute cover 76.

Specifically, the dispenser case 71 may have a space which is recessed to dispense the water or the ice, and the user may locate a container into the recessed space. And a dispenser tray 73 is provided under the dispenser case 71. The dispenser tray 73 may support the container may support the container, and may be withdrawn to a front of the dispenser case 71 to support a large capacity container when the purified water is continuously dispensed.

To this end, an elastic member 713 having a hooking protrusion 714 may be installed and fixed to a bottom surface of the dispenser case 71. And a plurality of restriction protrusions 732 protrude downward from a bottom of the dispenser tray 73, and the hooking protrusion 714 interferes with the restriction protrusions 732 when the dispenser tray 73 is inserted and withdrawn, and thus the dispenser tray 73 may be withdrawn in stages.

The operation lever 72 is provided at a rear surface of the dispenser case 71. The operation lever 72 may be operated by the user to dispense the water or the ice through the dispenser 70. When the operation lever 72 is pushed, the selected water or ice is dispensed, and when the operation lever 72 is released, the operation lever 72 is returned to its original position, and thus dispensing of the water or the ice is terminated. Through an operation of the operation lever 72, the user may dispense a desired amount of water or ice.

And a top cover 74 is provided at an upper surface of the dispenser case 71. And the water discharge pipe 35 or a nozzle is exposed through the top cover 74. The water discharge pipe 35 or the nozzle extends and protrudes to a lower side of the top cover 74, and thus the user may check a water dispensing state.

And an ice chute 741 is provided at a rear of the water discharge pipe 35. The ice chute 741 is a path through which the ice made and stored in the ice making chamber 25 is discharged, and is formed at the top cover 74 to be opened.

Also, a light emitting member 742 may be further provided at the top cover 74. The light emitting member 742 is provided at one side close to the water discharge pipe 35 and the ice chute 741, and may emit light vertically downward. Therefore, when the water or the ice is dispensed, a dispensing state may be recognized by the light emitted from the light emitting member 742 even when a room is dark.

And the front plate 75 is provided at an upper portion of a front surface of the dispenser case 71, more specifically, an upper side of the recessed space of the dispenser case 71. The front plate 75 may shield paths, valves and a PCB which are installed at the dispenser case 71, and may form the same plane as the front surface of the refrigerator compartment door 21.

And a plurality of operation buttons 751 are provided at the front plate 75, and an operation of the refrigerator 1 and the dispenser 70 may be set or operated by operating the plurality of operation buttons 751.

The chute cover 76 may be provided at a center of the front plate 75. The chute cover 76 is located at a front of the ice chute 741 and the water discharge pipe 35, and may shield the ice chute 741 and the water discharge pipe 35. In some implementations, the chute cover 76 may not substantially shield the ice chute 741 and the water discharge pipe 35, but may be located at the front of them.

And a display 90 may be provided at the chute cover 76. The display 90 may display an operation state of the refrigerator 1, and particularly, may be configured with a touchscreen which displays a set state of the dispenser 70 and is directly operated by the user.

Since the display 90 is installed at a front surface of the chute cover 76, all of the display 90, the operation lever 72, the ice chute 741 and the water discharge pipe 35 may be disposed forward and backward on the same extension line. Therefore, the elements which are required to be operated or checked by the user are disposed on the same line, and the dispenser 70 may be very easily operated and recognized.

In particular, the display 90 is formed to indicate operation information of the dispenser 70 and operation information of the user in the form of icons through a screen change, and thus allows an intuitive information transmission and a user's input through the display 90 having a small size.

Figure 29:
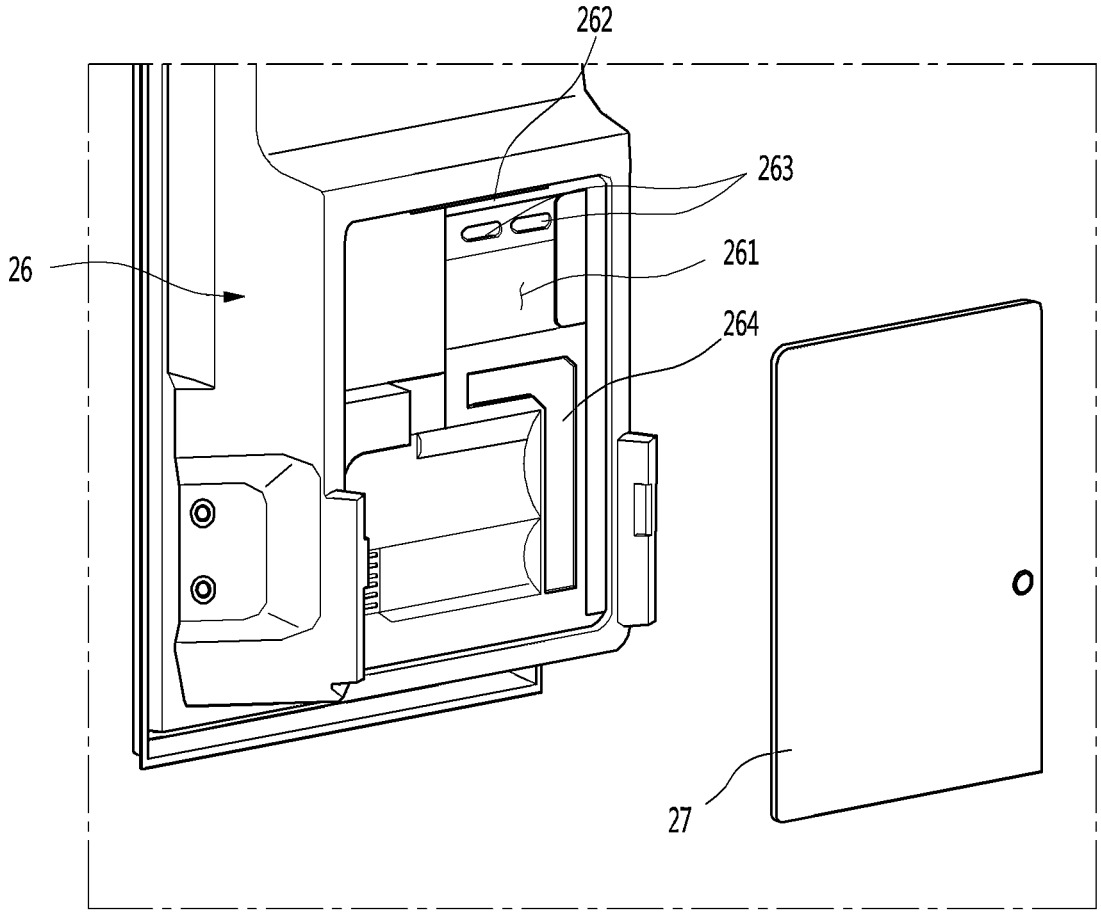
FIG. 29 is an exploded perspective view of an example cover plate that is separated from a refrigerator compartment door.

FIG. 29 illustrates an example cover plate.

As illustrated in the drawing, the door recessed portion 26 is formed at a lower portion of the rear surface of the refrigerator compartment door 21. The sub-water tank 80, the second branch valve 328 and the dispensing valve 351 for supplying the purified water and the cold water to the dispenser 70 and the ice maker 251 may be accommodated in the door recessed portion 26.

To this end, a door liner which forms the rear surface of the refrigerator compartment door 21 is recessed backward, and thus the door recessed portion 26 may have a predetermined space 261. The door recessed portion 26 are located under the dispenser 70 and the ice making chamber 25, and opened toward the inside of the refrigerator compartment 12.

A connector installation part 262 is provided inside the door recessed portion 26. The connector installation part 262 is a portion at which a connector 265 coupled to the electric wire connector connected to the second branch valve 328 and the dispensing valve 351 is installed. The connector installation part 262 is disposed at a position of an upper end of the door recessed portion 26 at which the water is not formed or collected.

A connector hole 263 may be formed at the connector installation part 262, and the connector 265 may be installed and fixed to the connector hole 263, and thus may be electrically connected by simple coupling with the electric wire connector connected to the second branch valve 328 and the dispensing valve 351.

A tube opening portion 264 is provided at one side of the door recessed portion 26. The tube opening portion 264 is formed at one side of the door recessed portion 26 to be opened, such that the purified water pipe 32, e.g., the connection part which extends from the refrigerator compartment 12 is introduced into the door recessed portion 26. And the tube opening portion 264 allows an access of the purified water pipe 32 and the water discharge pipe 35 which are directed to the ice maker 251 and the dispenser 70.

The tube opening portion 264 may be disposed inside the door recessed portion 26 to be close to a portion which serves as a rotating shaft of the refrigerator compartment door 21, and thus may minimize a length of the water supply path.

The door recessed portion 26 may be shielded by the cover plate 27. The cover plate 27 may be formed in a plate shape corresponding to an opening of the door recessed portion 26, and the sub-water tank 80, the second branch valve 328 and the dispensing valve 351 may be installed and fixed to a rear surface of the cover plate 27.

Therefore, the sub-water tank 80, the second branch valve 328 and the dispensing valve 351 may be located inside the door recessed portion 26 by assembling the cover plate 27 which shields the door recessed portion 26.

Figure 30:
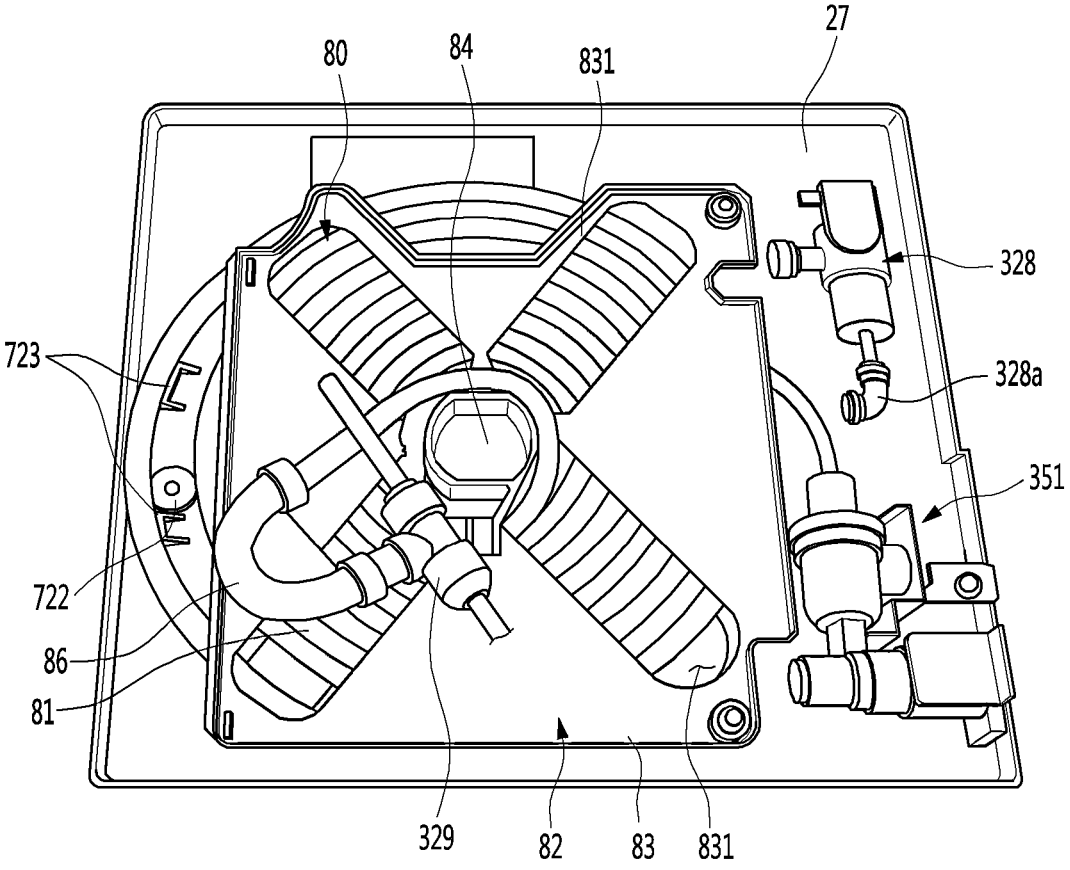
FIG. 30 is a perspective view of a rear surface of an example cover plate.
Figure 31:
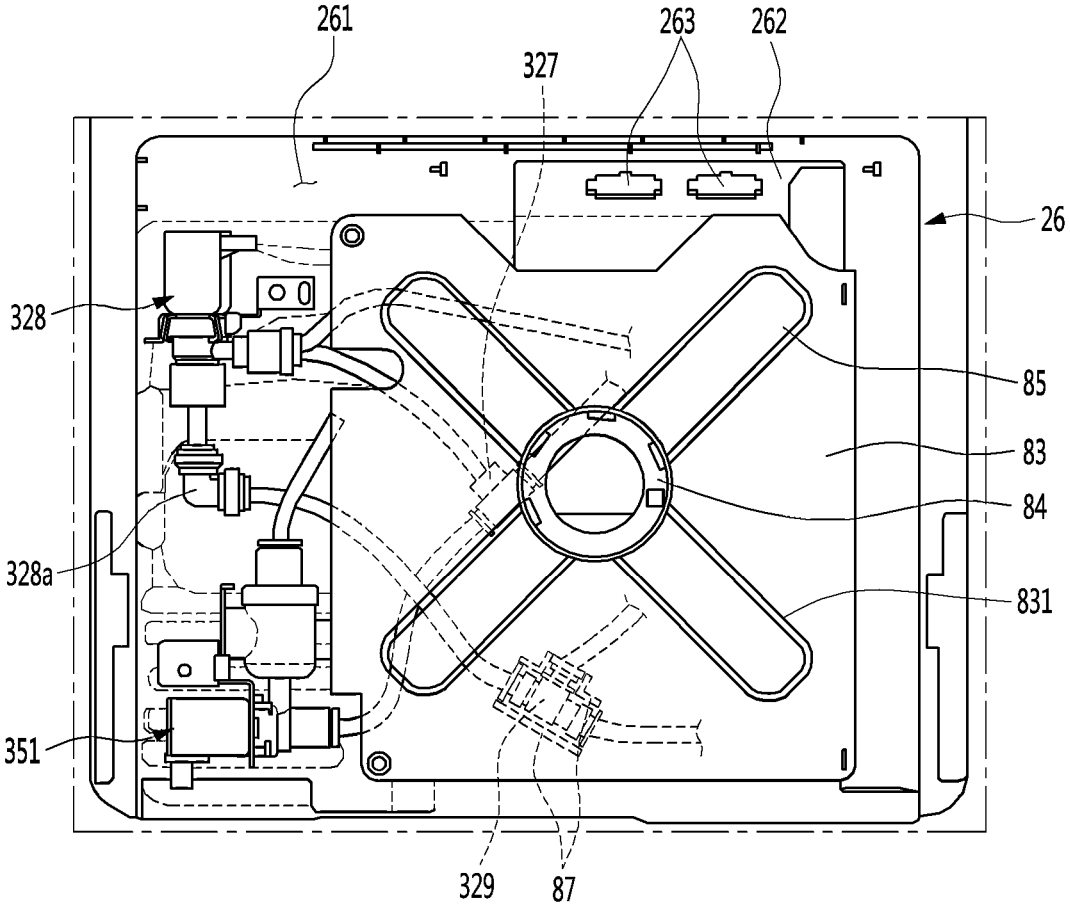
FIG. 31 is a view of an internal structure of an example door recessed portion.
Figure 32:
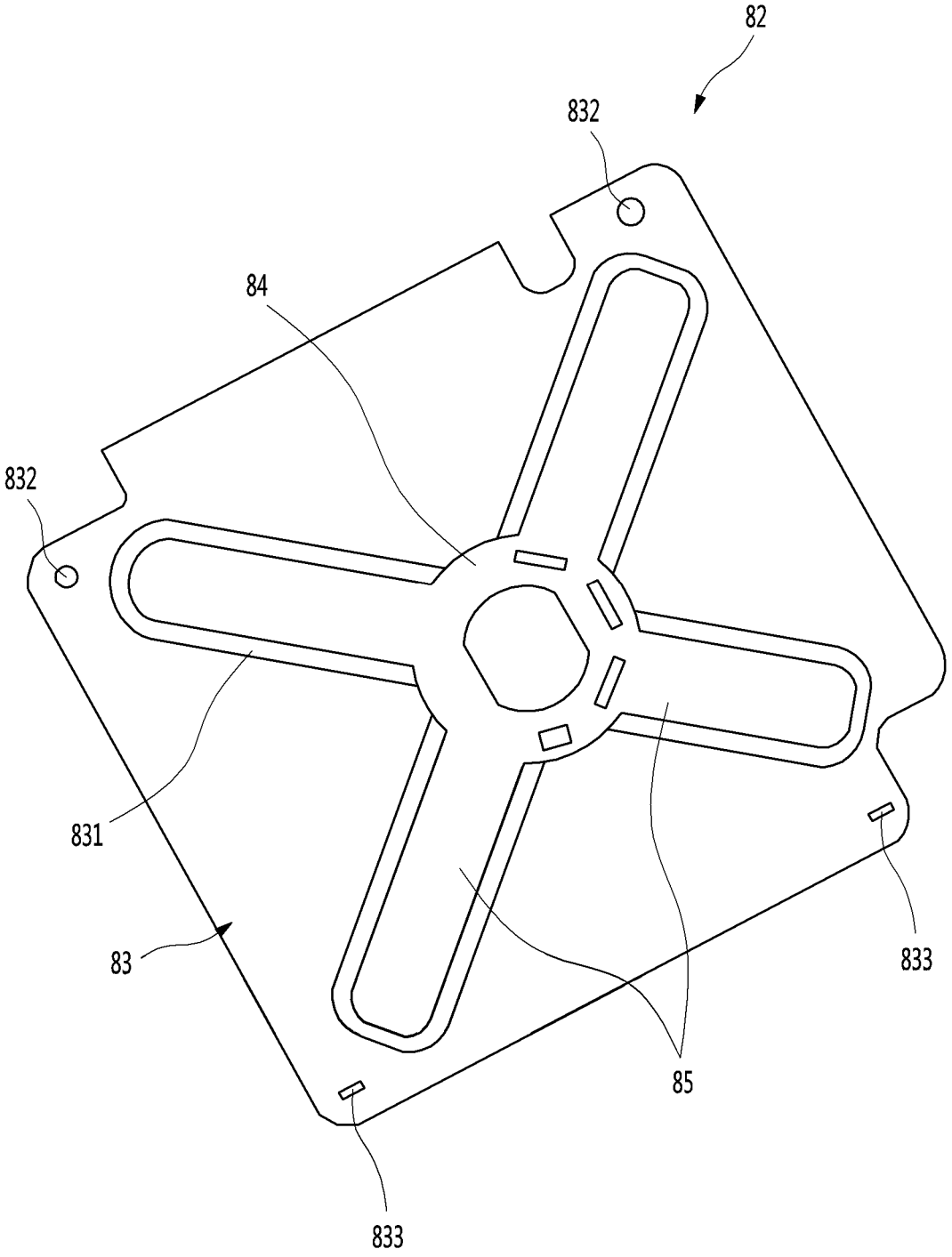
FIG. 32 is a perspective view of an example tube reel.

FIG. 30 illustrates an example cover plate. FIG. 31 illustrates an example door recessed portion. FIG. 32 illustrates an example tube reel.

As illustrated in the drawings, the sub-water tank 80, the second branch valve 328 and the dispensing valve 351 may be installed at the rear surface of the cover plate 27.

The sub-water tank 80 serves to cool again the water which is cooled and supplied from the main water tank 60. When the water cooled in the main water tank 60 passes through the outside of the cabinet 100 while flowing through the water supply path, a temperature thereof may be increased, and the sub-water tank 80 may cool again the water of which the temperature is increased, and thus may enable the cold water to be dispensed at a target cold temperature when the cold water is dispensed.

In particular, when the cold water is first dispensed in a state in which the water is not dispensed for a long time, the temperature of the water remaining for the long time in the water supply path outside of the refrigerator compartment 12 may be increased, and thus may not satisfy the user. However, when the cold water is additionally cooled in the sub-water tank 80, mixed with the cooled water, and then dispensed, the temperature of the cold water may satisfy the user.

The sub-water tank 80 may include a tube reel 82, and a tube 81 which is wound several times on the tube reel 82. At this time, the tube reel 82 may include a base 83 which is fixed to the cover plate 27, a boss 84 which protrudes from a center of the base 83 and on which the tube 81 is wound, and an alignment guide 85 which extends radially along a circumference of the boss 84 and aligns the tube 81.

A height of the boss 84, e.g., heights of the base 83 and the alignment guide 85 may be formed corresponding to a diameter of the tube 81, and thus tube 81 may be continuously wound on the tube reel 82 in one stage, e.g., one layer.

A capacity of the sub-water tank 80 may be determined by a length and a diameter of the wound tube 81. Specifically, the sub-water tank 80 may be formed longer than a length of the water supply path from the outlet port of the main water tank 60 to an inlet port of the sub-water tank 80.

Therefore, since an amount of the water stored in the sub-water tank 80 is larger than that of the water having a relatively higher temperature, the water may be mixed when the water is dispensed from the dispenser 70, and thus the temperature of the dispensed cold water may satisfy the user.

And when a diameter of the tube 81 of the sub-water tank 80 is different from that of the water supply path, the capacity of the sub-water tank 80 may be determined based on a volume. That is, the volume of the sub-water tank 80 is formed larger than that of the water supply path which passes through the outside of the cabinet 100. In other words, the volume of the sub-water tank 80 may be formed larger than that of the water supply path from an outlet side of the main water tank 60 to an inlet side of the sub-water tank 80.

A base fixing part 833 and a base fastening part 832 which fix the tube reel 82 may be provided at the base 83 of the tube reel 82. The base fixing part 833 may be matched with a protrusion of the rear surface of the cover plate 27, and the base fastening part 832 may be fastened to the cover plate 27 by the screw.

An opening 831 corresponding to a shape of the alignment guide 85 may be formed at the base 83. And a length of one of a plurality of alignment guides 85 may be formed shorter than those of the remaining alignment guides 85. Therefore, the tube 81 may be easily wound on the tube reel 82.

A screw hole 722 is formed at the cover plate 27, and the cover plate 27 may be installed and fixed to the refrigerator compartment door 21 by fastening the screw to the screw hole 722. And a plate guide 723 by which a part of the tube 81 of the sub-water tank 80 is bypassed is formed at an outside of the screw hole 722. Therefore, the screw is fastened so as to be spaced apart from a route through which the tube 81 is wound, and thus the tube 81 of the sub-water tank 80 may be prevented from being damaged by the screw.

And a folding prevention member 86 may be provided at one side of the tube 81 of the sub-water tank 80. The folding prevention member 86 is formed in a tube or pipe shape, bent with a predetermined curvature or at a predetermined angle, guides the tube 81 of the sub-water tank 80, and prevents the tube 81 from being folded due to an excessive curve. Also, the folding prevention member 86 may be fixed to the cover plate 27 by the screw, and may fix the tube 81.

And the third branch pipe 329 may be connected to an outlet side of the sub-water tank 80, and a connector fixing part 87 may be fixed to the base 83 of the tube reel 82 so as to fix the third branch pipe 329, as illustrated in FIG. 31.

Figure 33:
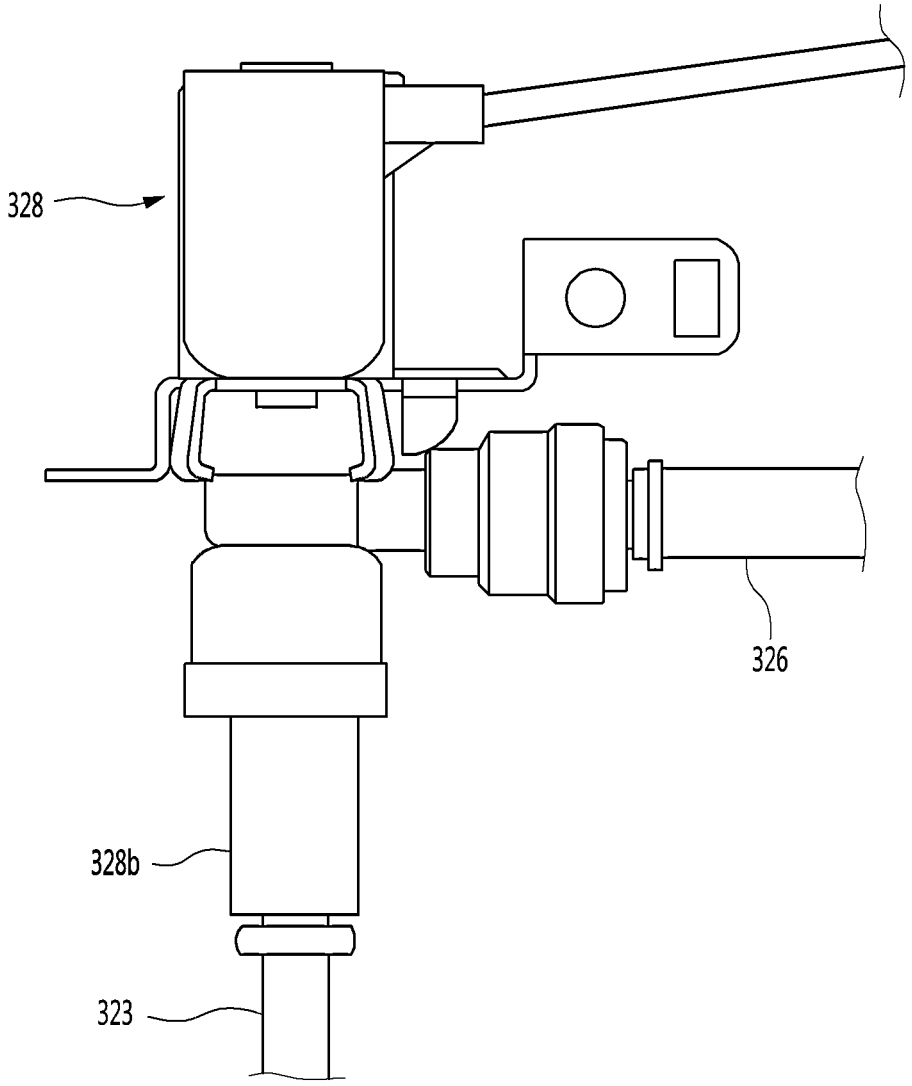
FIG. 33 is a view of an example second branch valve.

Also, a connector **328*a* which is formed to be bent may be provided at an end of an inlet side of the second branch valve 328, and may prevent the tube 81 from being bent when the second branch valve 328 is connected. In some implementations, as illustrated in FIG. 33, an inlet part 328*b*** of the second branch valve 328 may extend long so that the tube 81 is connected so as not to be bent.

Hereinafter, the flow of the water supplied from the refrigerator 1 having the above-described structure will be described.

Figure 34:
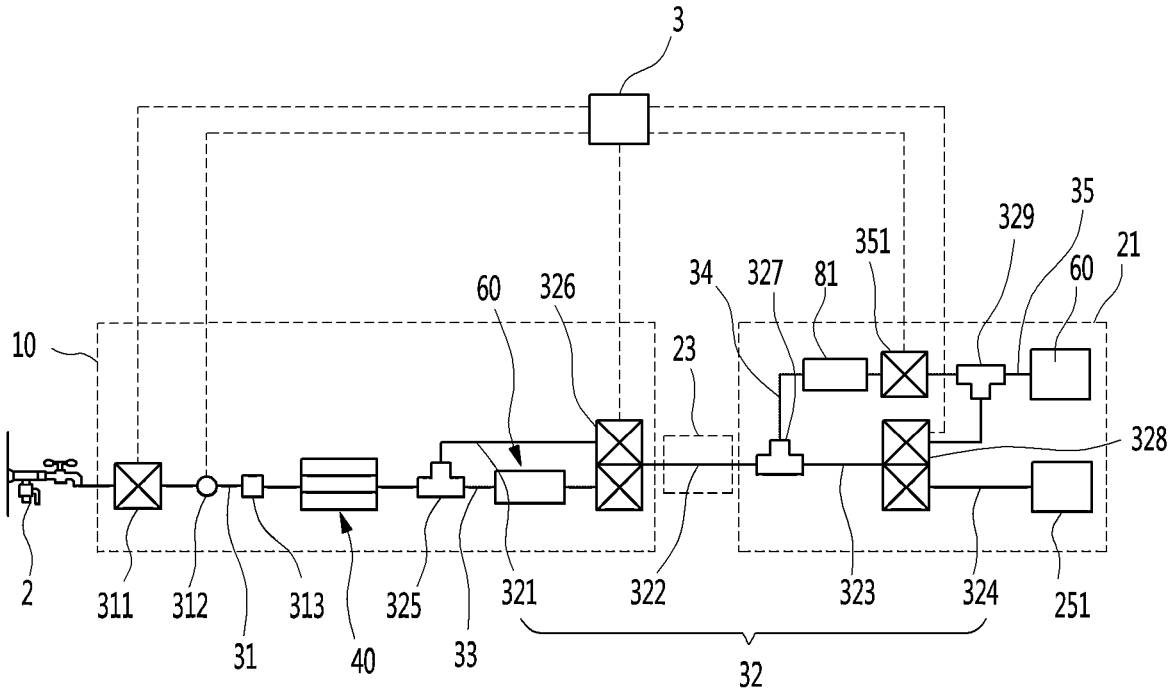
FIG. 34 is a schematic of an example water supply path of a refrigerator.
Figure 35:
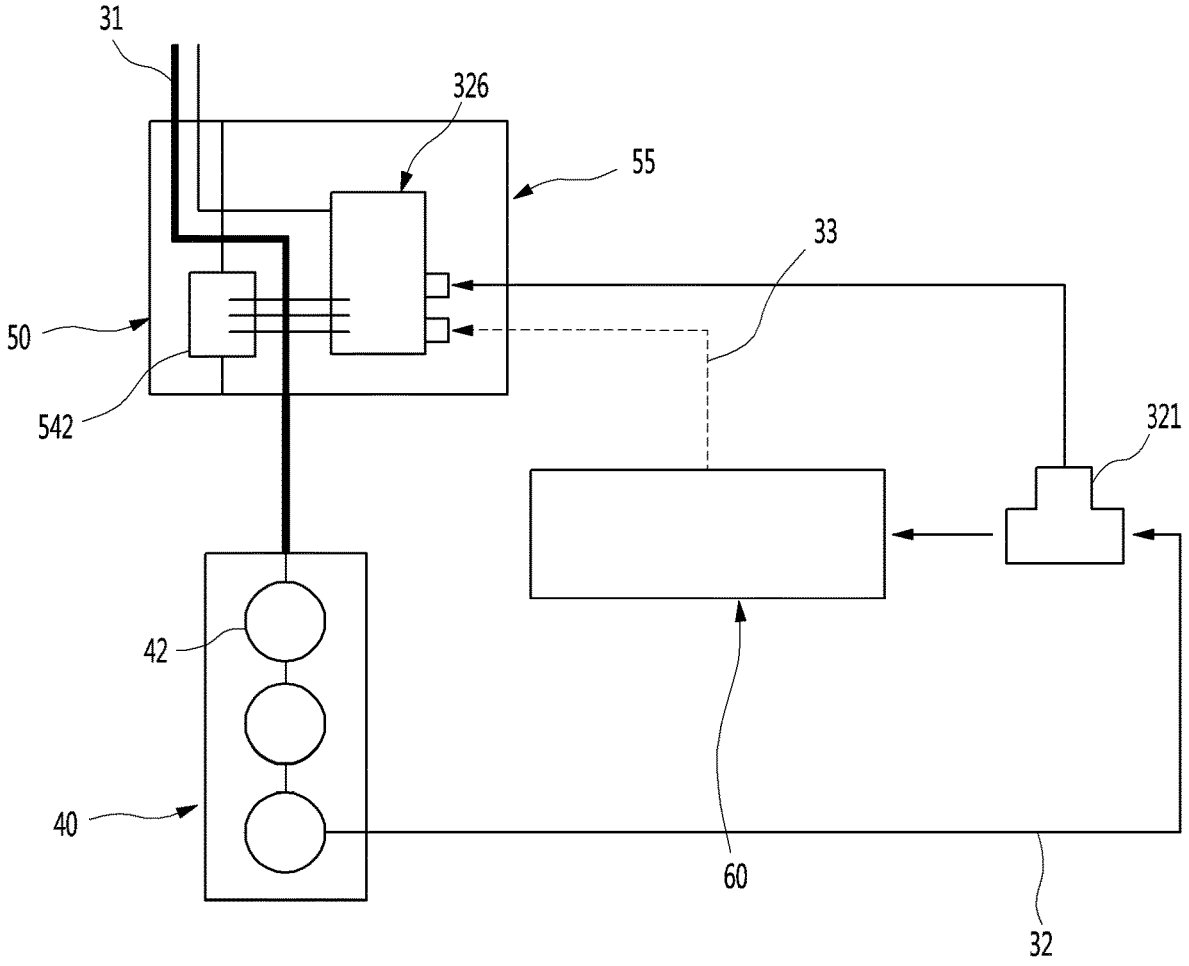
FIG. 35 is a schematic of an example water supply path in a refrigerator compartment.
Figure 36:
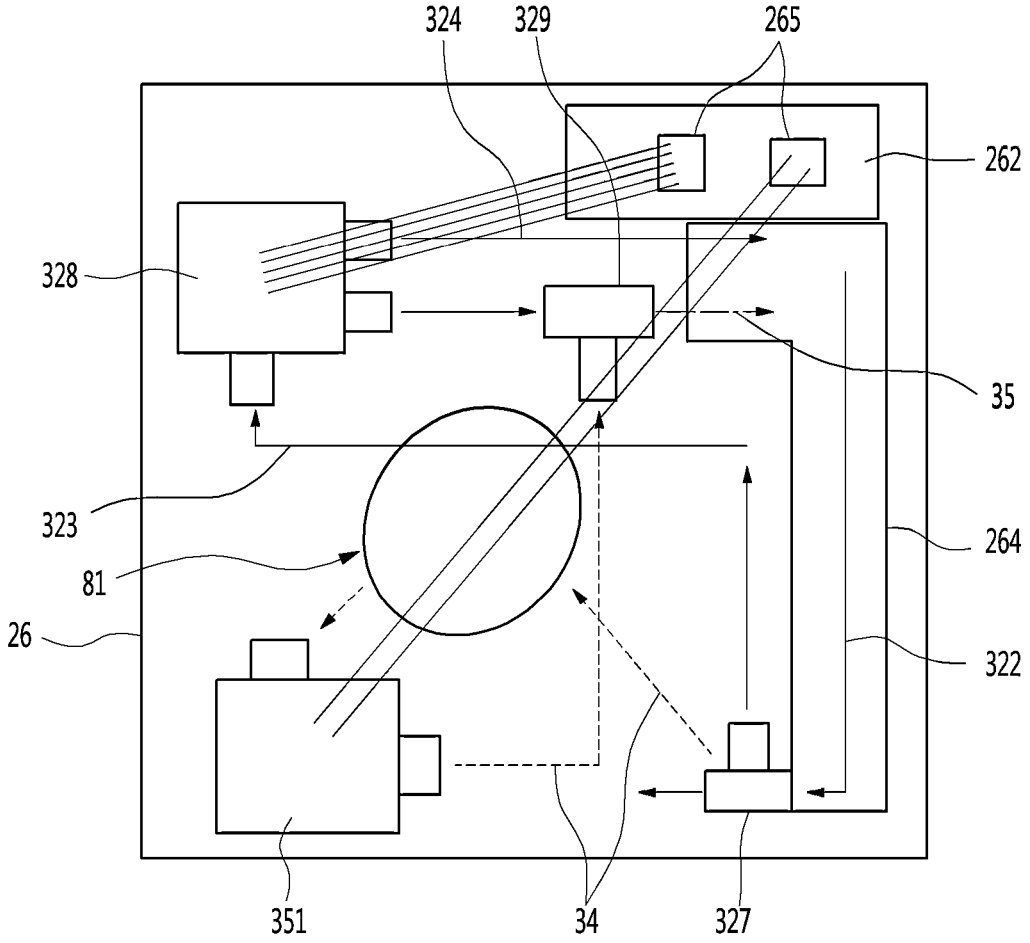
FIG. 36 is a schematic of an example water supply path in a door recessed portion.

FIGS. 34-36 illustrate example water supply paths.

As illustrated in the drawings, the water supplied from the water source 2 like the spigot flows to the refrigerator 1 through the water supply pipe 31. At this point, the supplied water passes through the water supply valve 311 and the flow sensor 312 which are provided at the water supply pipe 31. Therefore, only when the water supply valve 311 is opened, the water may be supplied from the water source 2 to the refrigerator 1.

And a check valve 313 may be provided at the water supply pipe 31. The check valve 313 serves to prevent the water located at a side of the refrigerator 1 from flowing back and flowing toward the water source 2. This is to prevent the contaminated water in the refrigerator 1 from flowing back and contaminating the water source 2 when the valves provided at the water supply path is abnormally operated or is not operated due to a breakdown.

The water supply pipe 31 may be guided to the inside of the refrigerator 1 along the tube guide 50 provided at the cabinet 100, and the water supplied through the water supply pipe 31 may be introduced into the water purifying device 40. And the water is purified in stages while passing through the plurality of filters 42 of the water purifying device 40, and the purified water flows through the purified water pipe 32, and may be supplied to the dispenser 70 or the ice maker 251.

Specifically, the water purified in the water purifying device 40 flows along the water inlet part 321 of the purified water pipe 32, and is branched in the first branch pipe 325, and a portion of the water continuously flows along the water inlet part 321 to the first branch valve 326, and another portion thereof is supplied to the main water tank 60 through the main cold water pipe 33. The purified water stored in the main water tank 60 is cooled by the cooling air inside the refrigerator compartment 12. The water cooled in the main water tank 60 flows to the first branch valve 326 through the main cold water pipe 33.

Therefore, both of the purified water and the cold water may be supplied to the first branch valve 326, and the purified water or the cold water may flow toward the refrigerator compartment door 21 through the connection part 322 of the purified water pipe 32 by switching of the first branch valve 326.

At this point, the connection part 322 is guided from the refrigerator compartment 12 toward the refrigerator compartment door 21 through the tube guide 50, passes through the hinge device 23 via the outside of the cabinet 100, and then is guided to the inside of the refrigerator compartment door 21. In some implementations, the connection part 322 may be guided between the outer case 101 and the inner case 102 toward the hinge device 23.

And the water introduced into the refrigerator compartment door 21 through the connection part 322 reaches the second branch pipe 327. When the water introduced into the second branch pipe 327 is the purified water, the water flows to the water outlet part 323 of the purified water pipe 32, and when the water is the cold water, the water flows to the sub-cold water pipe 34.

Specifically, the purified water flowing to the water outlet part 323 is branched by the second branch valve 328 provided at the water outlet part 323. When the water supply path is switched to the dispenser 70 by the second branch valve 328, the purified water may be supplied to the third branch pipe 329 connected to the water discharge pipe 35, and then may be dispensed through the dispenser 70. And when the water supply path is switched to the ice maker 251 by the second branch valve 328, the purified water may be supplied to the ice maker 251 through the ice making path 324 of the purified water pipe 32.

When the water introduced into the second branch pipe 327 is the cold water, the second branch valve 328 is closed. Therefore, the cold water is supplied to the sub-water tank 80 through the sub-cold water pipe 34, and may pass through the third branch pipe 329 when the dispensing valve 351 is opened, and then may be dispensed to the dispenser 70 through the water discharge pipe 35.

When the ice maker 251 starts an ice forming operation, the water supply valve 311 is opened, and the first branch valve 326 is switched to a side of the purified water, and the second branch valve 328 is switched toward the ice maker 251, and the purified water is supplied to the ice maker 251 so as to make the ice.

And when the user operates the dispenser 70 to dispense the cold water, the water supply valve 311 is opened, and the first branch valve 326 is switched to a side of the cold water, and the cold water stored in the main water tank 60 flows toward the refrigerator compartment door 21 through the first branch valve 326. And the second branch valve 328 is in a closed state, and the water passed through the first branch valve 326 may be supplied to the sub-water tank 80. At this point, when the dispensing valve 351 is opened, the cold water stored in the sub-water tank 80 may be dispensed through the dispenser 70.

And when the user operates the dispenser 70 to dispense the purified water, the water supply valve 311 is opened, and the first branch valve 326 is switched to the side of the purified water, and the second branch valve 328 is switched toward the dispenser 70, and the purified water may be dispensed. And in the case in which the user sets an amount of water to be dispensed, the set amount of water may be dispensed by the flow sensor 312.

Hereinafter, such a user's operation of the dispenser 70 will be described in turn.

Figure 37:
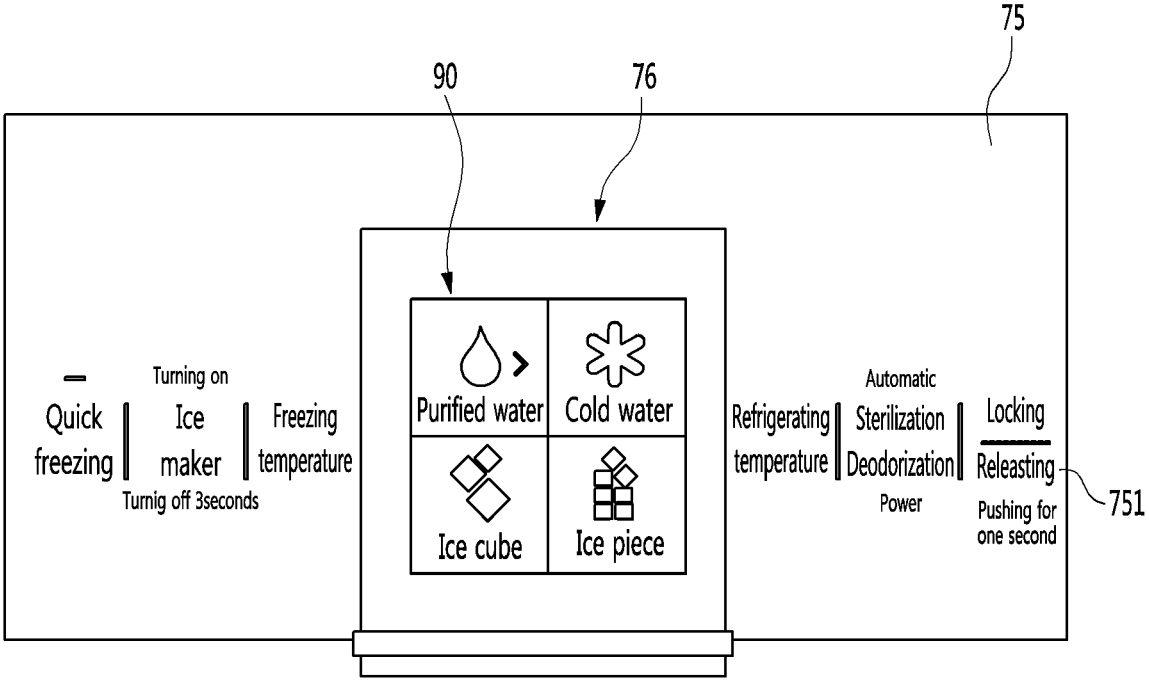
FIG. 37 is a view illustrating an example display and an example front plate of a dispenser.
Figure 38:
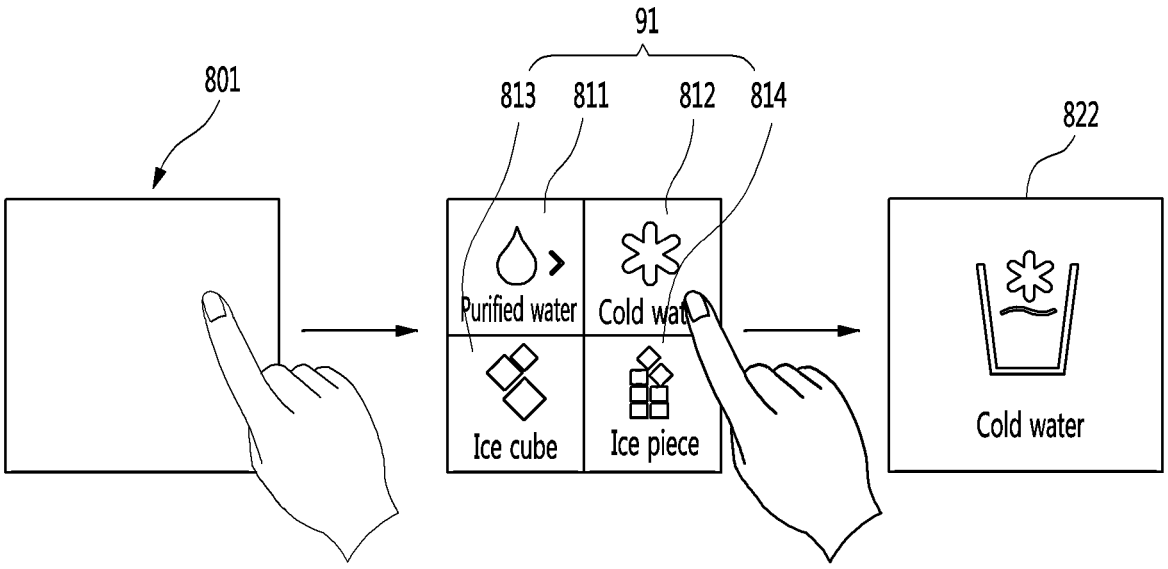
FIG. 38 is a view of an example operation when cold water is dispensed through a dispenser.

FIG. 37 illustrates an example display and an example front plate of a dispenser. FIG. 38 illustrates an example operation when cold water is dispensed through a dispenser.

As illustrated in the drawings, while the dispenser 70 is not used, a state of the refrigerator 1 may be displayed through the display 90, or the display 90 is in a state of an off-screen 801 in which a back light is turned off to save electric power.

In this state, the user may push the operation buttons 751 to set the operation of the refrigerator 1, or may operate the operation lever 72 to dispense the water or the ice. Typically, it may be set so that the purified water is dispensed when the operation lever 72 is operated. However, this may be reset according to the user's taste by an operation of the operation buttons 751.

When the user wants to dispense the cold water through the dispenser 70, first, the display 90 which is in the state of the off-screen 801 may be touched. In this case, the off-screen 801 may be switched to a screen on which a selection input part 91 is output.

The selection input part 91 is divided into areas which select purified water 811, cold water 812, ice cubes 813 and ice pieces 814. When the user touches the cold water 812, the screen through which the selection input part 91 is output may be switched to a cold water confirming screen 822.

At the same time when the screen is switched to the cold water confirming screen 822, the cold water 812 may be supplied through the water discharge pipe 35 of the dispenser 70, as described above. At this point, the amount of water to be dispensed may be a predetermined amount which is set in advance. In some implementations, when the cold water confirming screen 822 is pushed again, the dispensing of the cold water 812 may be stopped.

In some implementations and if necessary, the cold water 812 may not be dispensed at the same time when the screen is switched to the cold water confirming screen 822, but when the cold water confirming screen 822 is pushed again in a state of the cold water confirming screen 822, or the operation lever 72 is operated, the cold water 812 may be dispensed.

And when a set time passed after the screen is switched to the cold water confirming screen 822, the display 90 may be switched to the state of the off-screen 801. In some implementations, the screen may be switched to a screen of the selection input part 91 for a preset period of time, instead of being immediately switched to the state of the off-screen 801, and then may be switched to the state of the off-screen 801.

Figure 39:
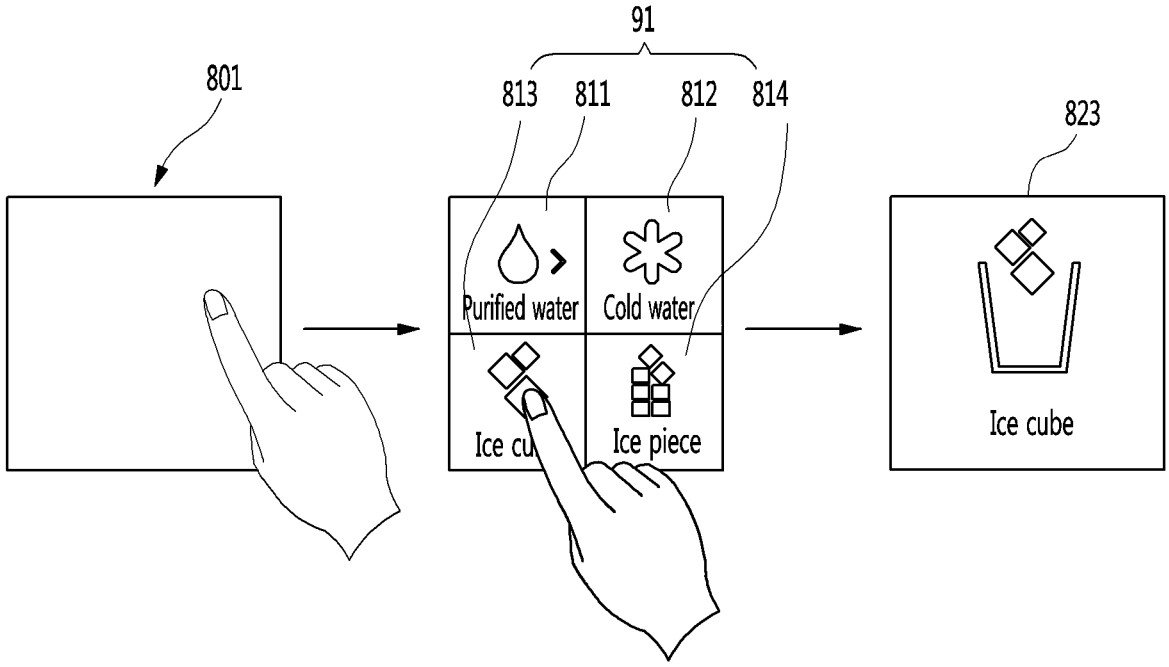
FIG. 39 is a view of an example operation when ice cubes are dispensed through a dispenser.
Figure 40:
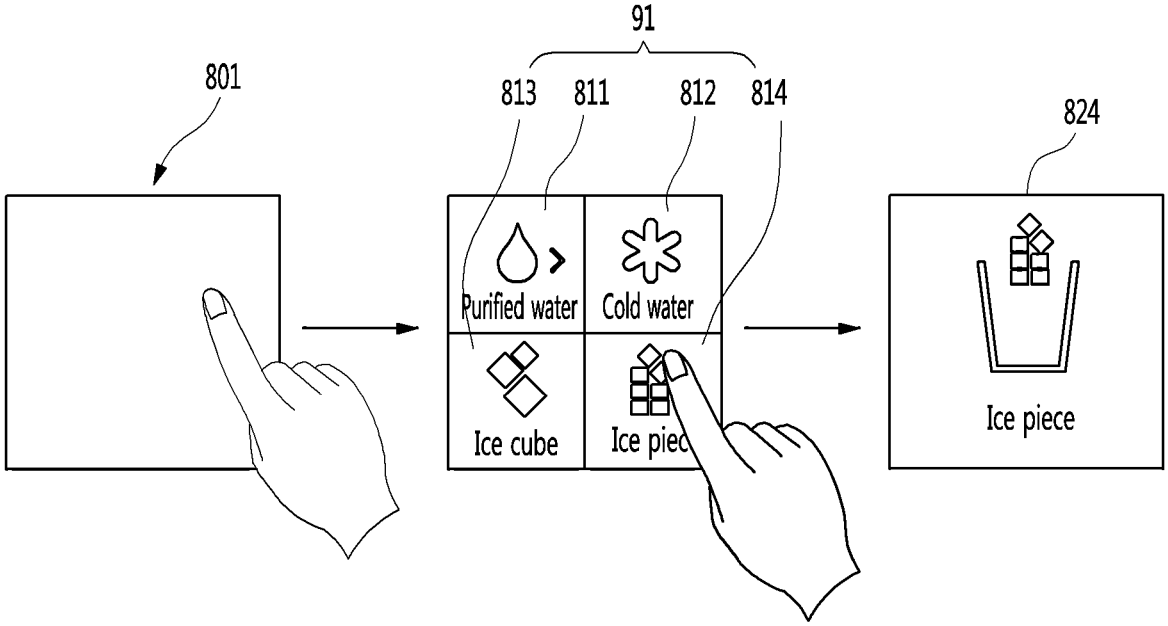
FIG. 40 is a view of an example operation when ice pieces are dispensed through a dispenser.

FIG. 39 illustrates an example operation when ice cubes are dispensed through a dispenser. FIG. 40 illustrates an example operation when ice pieces are dispensed through a dispenser.

As illustrated in the drawings, when the user wants to dispense the ice cubes 813 or the ice pieces 814 through the dispenser 70, first, the display 90 which is in the state of the off-screen 801 is touched so that the selection input part 91 is displayed on the display 90.

The selection input parts 81 is divided into the areas of the purified water 811, the cold water 812, the ice cubes 813 and the ice pieces 814. When the user touches the area of the ice cubes 813 or the ice pieces 814, the screen of the display 90 may be switched to an ice cube or ice piece confirming screen 823 or 824.

At the same time when the screen is switched to ice cube or ice piece confirming screen 823 or 824, the ice stored in the ice making chamber 25 may be dispensed through the ice chute 741 of the dispenser 70. At this point, an amount of the ice to be dispensed may be a predetermined amount which is set in advance. In some implementations, when the ice cube or ice piece confirming screen 823 or 824 is pushed again, the dispensing of the ice cubes or ice pieces may be stopped.

In some implementations and if necessary, the ice cubes 813 or ice pieces 814 may not be dispensed at the same time when the screen is switched to the ice cube or ice piece confirming screen 823 or 824, but when the ice cube or ice piece confirming screen 823 or 824 is pushed again in a state of the ice cube or ice piece confirming screen 823 or 824, or the operation lever 72 is operated, the ice cubes 813 or ice pieces 814 may be dispensed.

And when a set time passed after the screen is switched to the ice cube or ice piece confirming screen 823 or 824, the display 90 may be switched to the state of the off-screen 801. In some implementations, the screen may be switched to the screen of the selection input part 91 for a preset period of time, instead of being immediately switched to the state of the off-screen 801, and then may be switched to the state of the off-screen 801.

Figure 41:
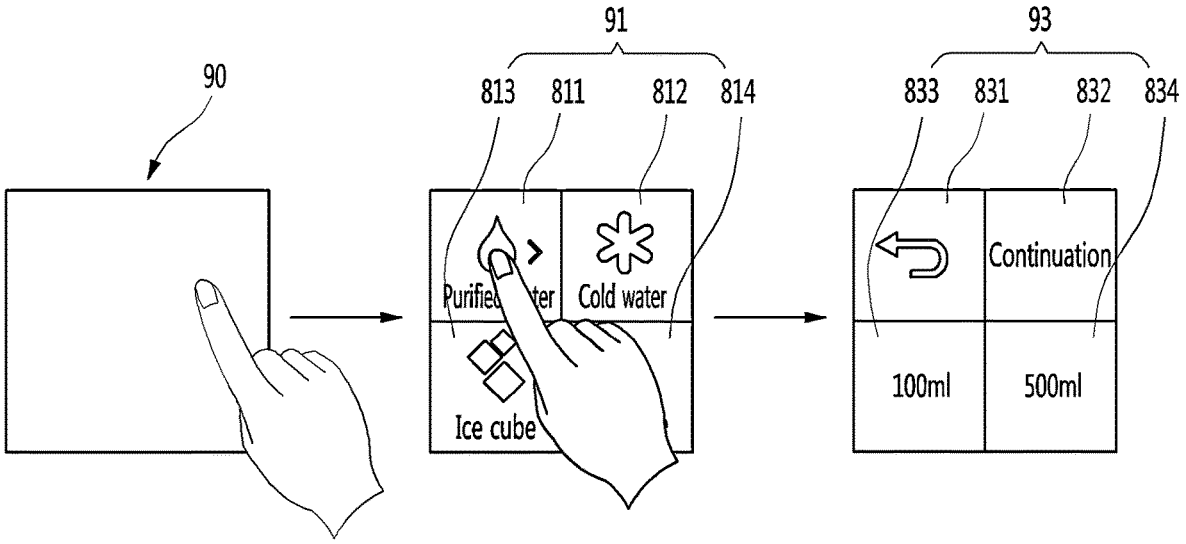
FIGS. 41 and 42 are views of example operations when purified water is dispensed through a dispenser.
Figure 42:
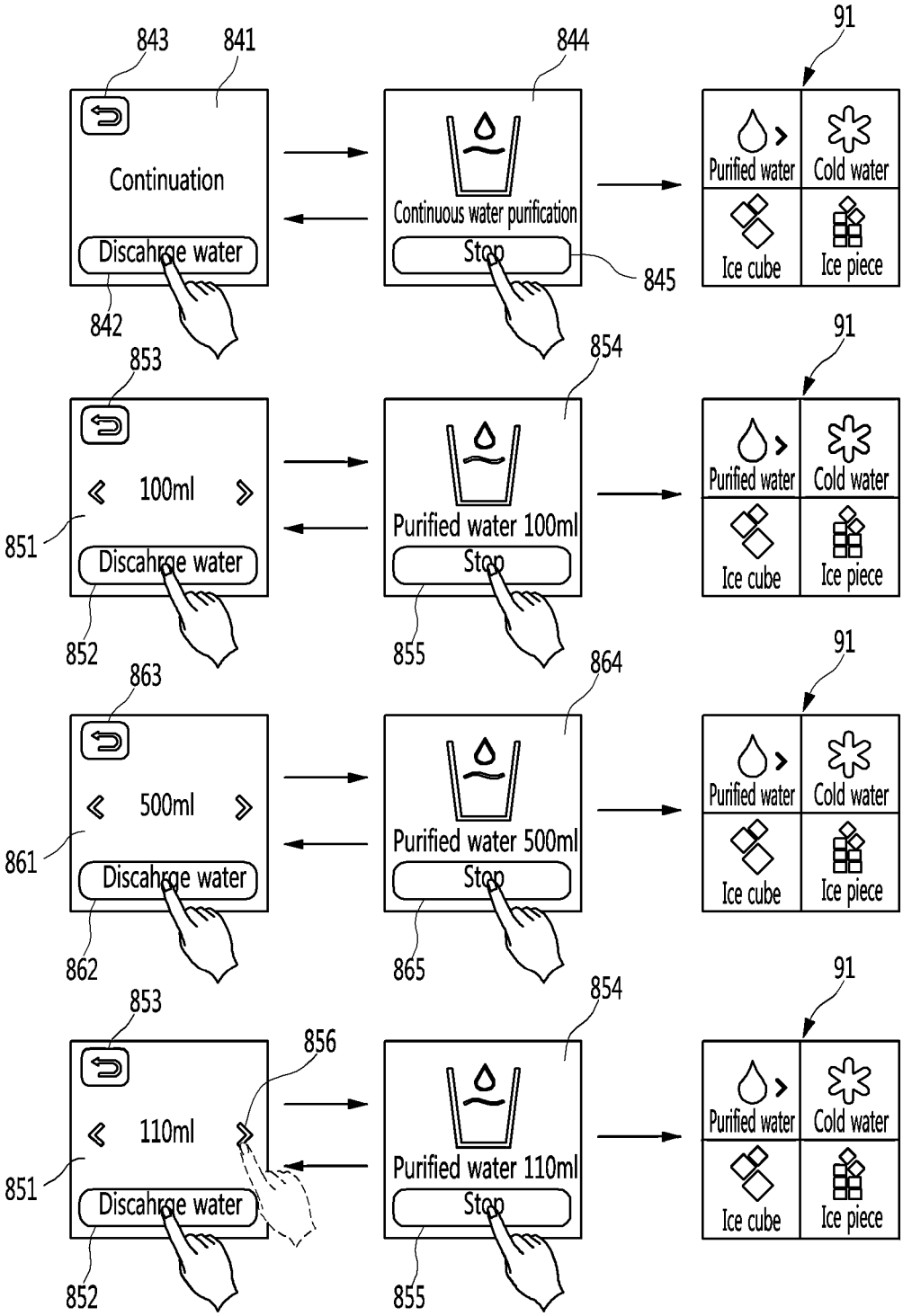

FIG. 40 illustrates an example operation when ice pieces are dispensed through a dispenser. FIGS. 41 and 42 illustrates example operations when purified water is dispensed through a dispenser.

As illustrated in the drawings, when the user wants to dispense the purified water through the dispenser 70, first, the display 90 which is in the state of the off-screen 801 is touched so that the selection input part 91 is displayed on the display 90.

The selection input part 91 is divided into the areas of the purified water 811, the cold water 812, the ice cubes 813 and the ice pieces 814. When the user touches the purified water 811, a dispensing amount input part 93 may be output through the display 90. And while the dispensing amount input part 93 is selected, the user may select a desired amount.

The dispensing amount input part 93 is divided into a returning area 831, a continuation area 832, a first amount area 833 (of 100 ml in FIG. 41) and a second amount area 834 (of 500 ml in FIG. 41), and the dispensing amount may be set depending on a user's selection. In some implementations, when the returning area 831 is touched, a previous screen may be displayed on the display 90.

When the continuation area 832 is selected in the dispensing amount input part 93, the screen is switched to a continuation confirming screen 841, and a start input part 842 and a returning area 843 may be displayed on the continuation confirming screen 841. In this state, when the start input part 842 is touched, the purified water may be continuously dispensed through the water discharge pipe 35 of the dispenser 70.

And the screen is switched at the same time when the start input part 842 is touched, and a purified water continuing screen 844 is output, and a stop input part 845 is displayed. Therefore, the water may be continuously dispensed until the stop input part 845 is input.

At this point, an amount of water to be dispensed may not exceed a set time based on time, and when the set time passed, the dispensing is automatically terminated by the control part 3, and the water may be prevented from overflowing due to an abnormal situation.

And even when the purified water may not be normally dispensed, for example, even when the filter 42 is separated or erroneously coupled, or a malfunction of the valve occurs, or a malfunction of the flow sensor 312 occurs, the control part 3 may terminate the dispensing, or may prevent the dispensing from being continuously performed.

When the dispensing of the water is terminated, the screen may be switched to the selection input part 91, and may be in a standby state of waiting for an additional operation input, and may be switched to the state of the off-screen 801 when a set time passed.

When the first amount area 833 or the second amount area 834 is selected in the dispensing amount input part 93, the screen which displays the dispensing amount input part 93 is switched to a first amount or second amount confirming screen 851 or 861. In the first amount or second amount confirming screen 851 or 861, a start input part 852 or 862, an increase and decrease input part 856 and a returning area 853 or 863 may be displayed. In this situation, when the start input part 852 or 862 is touched, the purified water may be dispensed through the water discharge pipe 35 of the dispenser 70 by the preset first or second amount.

And at the same time when the start input part 852 or 862 is touched, the screen is switched to a first amount or second amount dispensing screen 854 or 864, and a stop input part 855 or 865 is displayed. And the purified water is dispensed until reaching the first amount or the second amount.

When the dispensing of the water is terminated, the screen is switched from the first amount or second amount dispensing screen 854 or 864 to the screen which displays the selection input part 91, and is in the standby state of waiting for the additional operation input, and may be switched to the state of the off-screen 801 when the set time passed.

In the first amount or second amount confirming screen 851 or 861, the user may operate the increase and decrease input part 856, and may finely adjust the set capacity, and may also reset an amount which is increased or reduced from the preset amount.

In this state, when the start input part 852 or 862 is touched, the screen is switched at the same time when the start input part 852 or 862 is touched, and a reset amount dispensing screen 854 or 864 is output on the display 90, and the stop input part 855 or 865 is displayed. And the purified water is dispensed until reaching the reset amount.

When the dispensing of the water is terminated, the screen is switched from the first amount or second amount dispensing screen 854 or 864 to the screen which displays the selection input part 91, and is in the standby state of waiting for the additional operation input, and may be switched to the state of the off-screen 801 when the set time passed.

In some implementations, the refrigerator includes a cabinet configured to form a storage space; a door configured to open and close the storage space and having a dispenser; a water purifying device provided at the cabinet and configured to purify supplied water; a water tank provided at the storage space and configured to store and cool the water supplied from the water purifying device; a water supply path configured to connect the water purifying device, the water tank and the dispenser and to supply purified water and cold water; a flow sensor provided at the water supply path; a dispensing valve provided at the water supply path and opened and closed to selectively supply the water to the dispenser; a display provided at the door and on which an input part for operating the dispenser is output; and a control part configured to control the flow sensor, the dispensing valve, the dispenser and the display, wherein the control part controls the water dispensed by an operation of the output input part to be continuously dispensed or to be dispensed by a predetermined amount.

The display may be disposed at a chute cover which is located at a front of a dispensing hole of the dispenser.

The dispenser may further include an operation lever which inputs a dispensing operation through the dispenser, and the operation lever, the dispensing hole of the dispenser and the display may be arranged on a straight line.

The input part may be output in the form of an icon, and a plurality of icons may be provided on one screen.

The input part may include a selection input part which simultaneously outputs a screen displaying the purified water and the cold water dispensed through the dispenser so that a user selectively inputs; and a dispensing amount input part which is screen-switched when the selection input part is operated so that the user selects an amount of dispensed water and continuous dispensing of the water.

When the continuous dispensing of the water through the dispenser is performed for a preset time or more, the control part may forcibly close the dispensing valve and may terminate the dispensing.

When an error of the flow valve is recognized, the control part may control the dispensing amount input part so that the continuous dispensing is activated or a selection input is not input.

After the dispensing amount input part is selected, an increase and decrease input part for operating an increase or decrease in the dispensing amount may be displayed, and the input dispensing amount may also be simultaneously displayed on the display.

After the dispensing amount input part is selected, a screen of the display is switched, and a start input part for displaying a selected dispensing amount and inputting a start of the dispensing may be displayed.

After the start input part is selected, a stop input part for inputting a stop of the dispensing may be displayed on the display.

A dispenser tray which supports a container for accommodating the water dispensed from the dispenser may be provided under the dispensing hole of the dispenser, and the dispenser tray may be provided to extend forward.

A light emitting member which emits light in a dispensing direction and allows a dispensing state to be checked may be provided at the dispenser.

The light emitting member may be turned on when the dispensing of the dispenser is operated, and then may be turned off when the dispensing is completed.

In some implementations, the refrigerator includes an outer case configured to form an exterior; an inner case coupled to the outer case and configured to form a refrigerator compartment and a freezer compartment; an insulator configured to fill a space between the outer case and the inner case; an evaporator provided at the refrigerator compartment; a grill pan configured to divide an inside of the refrigerator compartment and to cover the evaporator; a water purifying device provided at the refrigerator compartment; a water tank provided at a front of the grill pan, and configured to store water supplied from the water purifying device; a water supply path configured to connect the water purifying device, the water tank and a dispenser provided at a refrigerator compartment door, and configured to guide purified water and cold water; and a tube guide provided at the space between the outer case and the inner case, and configured to connect a side surface of the inner case with a rear surface of the outer case and to guide an access of the water supply path.

The water supply path may include a water supply pipe which connects the water purifying device with a water source and has access through the tube guide.

Both ends of the tube guide may be opened in a direction that intersects with each other, and openings formed at both ends of the tube guide may be connected by a path formed to be rounded with a predetermined curvature.

The tube guide may include a rear surface which is in close contact with the outer case and has an inlet port in which the water supply path is inserted, and a side surface which is in close contact with the inner case and has an outlet port through which the water supply path is withdrawn. The rear surface and the side surface may be disposed perpendicularly to each other.

A valve which is connected to the water tank and the water purifying device so as to switch, open and close the water supply path may be further provided at the refrigerator compartment.

The tube guide may include a path guide part which guides the water supply path from an inside of the refrigerator compartment to an outside thereof; and a connector installation part to which an electric wire connected to the valve is connected.

A valve cover which accommodates the valve may be installed and fixed to an inner side wall of the refrigerator compartment. A valve cover coupling part which is exposed toward the refrigerator compartment and coupled to the valve cover may be provided at the tube guide.

The valve cover which accommodates the valve may be installed and fixed to a side wall of the refrigerator compartment. A tank installation part on which the water tank is seated may be provided at the valve cover.

The tank installation part may be formed to extend downward from one side of the valve cover. The tank installation part may cover a circumference of the water tank.

The tank installation part may protrude from positions corresponding to both ends of the water tank. The tank installation part may be inserted and fixed into a recessed portion formed at each of both ends of the water tank.

The water tank may include a cylindrical tank body, and a plurality of hemispheric tank caps which are coupled to both ends of the tank body. The recessed portion is formed to be recessed from a portion at which the tank body and the plurality of tank caps are coupled.

The tank installation part may include a cover extension part which extends from one side of the valve case so as to support the water tank, and a tank restriction part which restricts a circumference of each of both ends of the water tank.

The tank restriction part may include a plurality of first restriction parts which are formed along a circumference of a tank insertion hole through which the water tank is inserted, and a second restriction part which is provided at an end of the cover extension part located at an opposite side to the first restriction parts.

A cooling air hole which is in communication with a storage compartment and through which cooling air in the storage compartment is suctioned may be formed at the grill pan, and the water tank may be located on a flowing route of the cooling air introduced into the cooling air hole.

The water supply path may include a water supply pipe which is connected from a water source to the water purifying device inside the refrigerator compartment, and a purified water pipe which connects the water purifying device, the water tank and the dispenser. Both of the water supply pipe and the purified water pipe may be guided from an inside of the refrigerator compartment to an outside thereof through the tube guide.

Ends of the water purifying device and the water tank may be disposed toward the tube guide. The water purifying device and the water tank may be disposed to intersect with each other.

In some implementations, the refrigerator includes an outer case configured to form an exterior of the refrigerator; an inner case coupled to the outer case and configured to form a refrigerator compartment and a freezer compartment; an insulator configured to fill between the outer case and the inner case; a drawer provided at the refrigerator compartment; a filter case provided at a space between the drawer and a side wall of the refrigerator compartment; a plurality of filters vertically installed at an inside of the filter case in parallel with each other; a water supply pipe which is connected to one of the plurality of filters, passes through the refrigerator compartment and extends to an outside; a water tank disposed at a space between the drawer and a rear wall of the refrigerator compartment to intersect with an installation direction of the plurality of filters; a branch valve provided at a space among a corner of the inner case, the filter case and the water tank; a connection pipe which is connected to the branch valve, passes through the refrigerator compartment and extends to an outside of the refrigerator compartment; and a tube guide buried in a space between the outer case and the inner case and through which the water supply pipe and the connection pipe pass together.

The tube guide may be installed at one side surface of the inner case at which the branch valve is provided.

The tube guide may form a path through which the side surface of the inner case is in communication with a rear surface of the outer case so that the water supply pipe and the connection pipe are guided toward the rear surface of the outer case through the side surface of the inner case.

The branch valve and the connection pipe may be connected to each other at a space among a corner of the refrigerator compartment, the filter case and the water tank.

The water supply pipe and the connection pipe may be connected to the plurality of filters and the branch valve, respectively, and then may be inserted from an inside of the refrigerator compartment into the tube guide.

The connection pipe may pass through an outside of the outer case, and may be inserted into an inside of a refrigerator compartment door through a hinge device of the refrigerator compartment door.

The branch valve may be connected to a purified water pipe which is in communication with the filter and a cold water pipe which is in communication with the water tank. The branch valve may selectively supply cold water and purified water to the connection pipe.

A table which divides the inside of the refrigerator compartment is provided at an upper side of the drawer, and the drawer and the filter case may be coupled to the table.

After the water supply pipe and the connection pipe are inserted into an inside of the tube guide, the filter case, the drawer and the table which are coupled to each other may be installed at the inside of the refrigerator compartment to cover the water tank.

A valve cover which forms a space in which the branch valve is accommodated may be installed at the side wall of the refrigerator compartment.

The valve cover may be coupled and fixed to one side of the tube guide which is exposed through the inner case.

The drawer may shield the water tank from a front of the water tank.

A filter insertion hole which is opened forward between the drawer and the side wall of the refrigerator compartment and in which the plurality of filters are inserted may be formed at the filter case. A plurality of filter insertion holes corresponding to the number of the plurality of filters may be vertically arranged.

A rear surface of the filter case may be disposed to be spaced apart from a rear wall surface of the refrigerator compartment.

The branch valve may be disposed at a space formed at a rear of the filter case and a lateral side of the water tank.

In some implementations, the refrigerator includes an outer case configured to form an exterior of the refrigerator; an inner case coupled to the outer case and configured to form a refrigerator compartment and a freezer compartment; an insulator configured to fill a space between the outer case and the inner case; a filter case disposed in the refrigerator compartment; a plurality of filters installed at an inside of the filter case; a water supply pipe which is connected to the plurality of filters, passes through the refrigerator compartment and extends to an outside of the refrigerator compartment; a water tank disposed at an inside of the refrigerator compartment; a connection pipe which is connected to the water tank, passes through the refrigerator compartment and extends to the outside of the refrigerator compartment; and a tube guide buried in the space between the outer case and the inner case and through which the water supply pipe and the connection pipe pass together. The tube guide may include an inlet port which is in contact with the inner case, an outlet port which is in contact with the outer case, and a curved surface part which connects the inlet port with the outlet port, and the water supply pipe and the connection pipe may be bent while passing through the tube guide.

The inlet port may be opened so as to be in communication with a side surface of the refrigerator compartment, and the outlet port may be opened so as to be in communication with a rear surface of the outer case.

The tube guide may include a side surface at which the inlet port is formed and which is in close contact with the inner case, and a rear surface at which the outlet port is formed and which is in close contact with the outer case. The side surface and the rear surface may be disposed perpendicularly to each other.

A branch valve which is connected to the connection pipe, and opened and closed to selectively supply water supplied from the water tank and the filter may be provided at the refrigerator compartment.

A connector installation part at which a cable connector connected with an electric wire connected to the branch valve is installed may be provided at the tube guide.

A tube hole may be opened at a position of the inner case corresponding to the inlet port, and an electric wire hole may be opened at a position of the inner case corresponding to the connector installation part.

A valve cover which accommodates the valve may be provided at the refrigerator compartment, and a valve cover coupling part which is exposed to the inside of the refrigerator compartment and coupled to the valve cover may be provided at the tube guide.

An evaporator for cooling the refrigerator compartment may be provided at a rear of the refrigerator compartment, and the curved surface part may be disposed to bypass the evaporator.

A drawer may be provided at the refrigerator compartment, and the water tank may be disposed between the drawer and the evaporator.

The connection pipe may pass through an outside of the refrigerator, and may be inserted into an inside of a refrigerator compartment door through a hinge device of the refrigerator compartment door.

The branch valve may be connected to a purified water pipe which is in communication with the filter, and a cold water pipe which is in communication with the water tank. The branch valve may selectively supply cold water in the cold water pipe and purified water in the purified water pipe to the connection pipe.

In some implementations, the refrigerator includes a cabinet in which a storage space is formed; a door configured to open and close the storage space and having a dispenser; a water tank formed of a metallic material and installed at an inside of the storage space; a water purifying device provided at the cabinet and configured to purify supplied water; and a water supply path which connects the water purifying device, the water tank and the dispenser and guides a flow of cold water and purified water. The water tank may include a tank body which is formed by rolling a plate-shape material in the form of a cylinder to form a space in which the water is accommodated, welding the material so as to be in communication with a water outlet pipe, and then processing a surface thereof by electrolytic polishing, and one pair of tank caps each of which is formed in a hemispheric shape, and welded so as to be in communication with a water inlet pipe, and then a surface of which is processed by the electrolytic polishing.

The pair of tank caps may be processed by curling so as to shield openings of both sides of the tank body, and thus each of the tank caps and an end of an inner surface of the tank body may be bonded to each other.

The water outlet pipe may be connected to an upper end of the tank cap, and may extend upward.

The water inlet pipe may be connected to a center of one of the tank caps.

The water outlet pipe may be disposed to be distant from the inlet pipe based on a center portion of the water tank.

The water tank may be disposed in parallel with a bottom surface of the storage space so that the water outlet pipe is directed upward.

An end of the tank body which is in contact with each of the tank caps may be processed by curling with silicone interposed therebetween.

A recessed portion in which a jig is inserted upon the curling may be formed at a circumference of each of the tank caps.

A tank installation part which is inserted into an inside of the recessed portion so as to fix the water tank may be provided at the storage space.

In some implementations, the refrigerator includes a cabinet in which a refrigerator compartment and a freezer compartment are formed; a refrigerator compartment evaporator and a freezer compartment evaporator provided at the refrigerator compartment and the freezer compartment, respectively; a refrigerator compartment door and a freezer compartment door configured to open and close the refrigerator compartment and the freezer compartment; a grill pan provided at the refrigerator compartment and configured to divide a space in which the refrigerator compartment evaporator is accommodated and a food storing space; a drawer provided at the refrigerator compartment to be inserted therein and withdrawn therefrom; a water tank of a metallic material provided at a space between the drawer and the grill pan of the refrigerator compartment; a water purifying device provided at the refrigerator compartment; and a water supply path configured to connect a water source, the water purifying device, the water tank and a dispenser provided at the door.

A cooling air hole through which cooling air discharged to the refrigerator compartment is suctioned toward the evaporator may be formed at the grill pan, and the water tank may be located at a front of the cooling air hole.

The water tank may be disposed to be spaced apart from a lower surface of the refrigerator compartment and the cooling air hole.

A tank fixing part which extends from one side of the water tank, and is coupled to a front surface of the grill pan so that the water tank is disposed and fixed to a front of the grill pan may be formed at the water tank.

The water tank may be formed in a cylindrical shape, and may extend in a lengthwise direction of the cooling air hole.

The water purifying device may be disposed perpendicularly to the water tank, and may be disposed between a side wall of the refrigerator compartment and the drawer, and a plurality of filters may be disposed to be vertically stacked.

The refrigerator can provide the following effects.

First, since the water purifying device, the main water tank and the first branch valve are disposed at the inside of the refrigerator compartment to intersect with each other, the paths can be connected in the shortest distance. Also since the refrigerator has an arrangement structure in which the water purifying device, the main water tank and the first branch valve are in close contact with the side wall of the refrigerator compartment and the front surface of the grill pan, a loss of the storage space of the refrigerator compartment can be prevented, in spite of an additional configuration for the purified water and the cold water.

Also, since the tube guide for access of the water supply path is installed at the side wall of the refrigerator compartment, and the water purifying device, the main water tank and the first branch valve are disposed at a position close to the tube guide, a path structure can be simply formed, and a length of the path can be minimized, and thus assemblability can be enhanced.

In particular, when the evaporator is provided at a rear of the refrigerator compartment, there is a problem that the water supply path is not easily arranged. However, the water supply path can be bypassed from the side surface of the refrigerator compartment to the rear surface of the cabinet by the tube guide, and thus the assemblability can be remarkably enhanced.

Also, since the first branch valve is disposed at the inner wall surface of the refrigerator compartment, and the main water tank is disposed at the front surface of the grill pan, and then the drawer assembly integrally formed with the water purifying device is installed, and thus the arrangement of each configuration is completed, the assemblability and the installation convenience can be enhanced.

Also, since the first branch valve which can selectively supply the purified water and the cold water is provided at the inside of the refrigerator compartment, the pipe which is directed from the cabinet toward the refrigerator compartment door via the hinge device can be configured with a single pipe.

Therefore, an inner diameter of a hinge shaft of the hinge device can be maintained in an appropriate size, and particularly, since the single pipe can be applied even to a structure in which both of the cold water and the purified water are supplied, the inner diameter of the hinge shaft can be prevented from being increased, and a design of the door and the hinge device can be facilitated.

Also, due to the structure in which the single pipe is introduced into the inside of the refrigerator compartment door, confusion of a path connection in the refrigerator compartment door can be prevented, and a path connection structure can be easily realized.

Also, the display which can display state information and an operation of the dispenser is provided on the chute cover of the dispenser, and thus a user interface which can be easily and intuitionally operated can be realized on the display through screen-switching, and thus user convenience can be enhanced.

In particular, since the display is disposed close to the portion through which the water or the ice is dispensed and the operation lever, user's state confirmation and operation can be simultaneously performed, and thus the user convenience can be enhanced.

Also, since the main water tank is formed in a cylindrical shape, and a structure of the inner surface thereof is formed simply and smoothly, foreign substances can be prevented from being attached to the inner surface of the main water tank, and a cleaning operation can be effectively performed when the cleaning operation is performed using a cleaning solution.

Also, since the main water tank is formed of a stainless steel material, and formed at a position close to the refrigerator compartment evaporator, the main water tank can be directly cooled, and thus can be effectively cooled.

And since the main water tank is disposed between the cooling air hole of the grill pan and the cooling air flowing hole of the shielding plate, and thus indirectly cooled by the cooling air collected toward the evaporator, the cooling efficiency can be enhanced.

Also, since the main water tank is formed in the cylindrical shape so as not to disturb the flow of the cooling air, and also disposed to be spaced apart from the lower surface of the refrigerator compartment, an area thereof which is in contact with the cooling air can be maximized, and thus the cooling efficiency can be further enhanced.

What is claimed is:

1. A refrigerator comprising:

a cabinet that includes (i) a refrigerator compartment located at an upper portion of the cabinet and (ii) a freezer compartment located at a lower side of the refrigerator compartment;

a refrigerator compartment door that is configured to open and close the refrigerator compartment and that includes a dispenser;

a hinge that is configured to rotatably connect the refrigerator compartment door to the cabinet;

a water purifying device that is located at the cabinet and that is configured to purify water;

a main water tank that is located at the refrigerator compartment and that is configured to receive and lower a temperature of the water from the water purifying device;

a sub-water tank that is located at the refrigerator compartment door and that is configured to further reduce the temperature of the water from the main water tank; and a water supply path that is defined by connections between the water purifying device, the main water tank, the sub-water tank, and the dispenser and that is configured to guide the water with a reduced temperature and the purified water, wherein the water supply path passes through the hinge, passes along an outside of the refrigerator compartment, and enters the refrigerator compartment door, and wherein a volume of an inner space of the sub-water tank is greater than a volume of an inner space of a portion of the water supply path that is located at the outside of the refrigerator compartment.

2. The refrigerator of claim 1, wherein the volume of the inner space of the sub-water tank is greater than a volume of an inner space of a portion of the water supply path between an outlet port of the main water tank and an inlet port of the sub-water tank.

3. The refrigerator of claim 1, wherein:

the sub-water tank comprises a tube having a spiral shape, and a length of the tube is greater than a length between an outlet port of the main water tank and an inlet port of the sub-water tank.

4. The refrigerator of claim 3, wherein a diameter of the tube of the sub-water tank is different from a diameter of the water supply path.

5. The refrigerator of claim 3, wherein the sub-water tank comprises a tube reel on which the tube is wound, and wherein the tube is continuously wound in a single layer on the tube reel.

6. The refrigerator of claim 1, wherein the sub-water tank is located at a rear side of the dispenser.

7. The refrigerator of claim 1, wherein the refrigerator compartment door comprises:

a door recessed portion that is recessed from a rear surface of the refrigerator compartment door and that is located under an ice making chamber, and a cover plate that covers the door recessed portion.

8. The refrigerator of claim 7, wherein the sub-water tank is disposed at the cover plate.

9. The refrigerator of claim 1, wherein the water supply path comprises:

a first path connected to an outlet port of the main water tank, and a second path bypassing the main water tank, and wherein the first path and the second path are connected to a first branch valve.

10. The refrigerator of claim 9, wherein the water supply path comprises:

a third path connected to an inlet port of the sub-water tank, and a fourth path bypassing the sub-water tank, wherein the third path and the fourth path are connected to a branch pipe.

11. The refrigerator of claim 10, wherein the water supply path comprises a connection part that passes the hinge and connects to the first branch valve and the branch pipe.

12. The refrigerator of claim 1, wherein the water purifying device includes a case and a plurality of filters vertically oriented in the case.

13. The refrigerator of claim 12, wherein the water purifying device further comprises:

a head unit that is located inside the case, that is selectively connected to an end of each of the plurality of filters, and that is connected to the water supply path, and a plurality of filter holes that are configured to receive the plurality of filters and that are located at a front surface of the case.

14. The refrigerator of claim 13, wherein the water purifying device further comprises a case cover that is disposed at the front surface of the case and that covers all of the plurality of filter holes.

* * * * *